US011279546B2

(12) United States Patent
Seiders et al.

(10) Patent No.: US 11,279,546 B2
(45) **Date of Patent: *Mar. 22, 2022**

(54) INSULATING CONTAINER HAVING VACUUM INSULATED PANELS AND METHOD

(71) Applicant: YETI Coolers, LLC, Austin, TX (US)

(72) Inventors: Roy Joseph Seiders, Austin, TX (US); Christopher M. Keller, Austin, TX (US); Edward Abante, Austin, TX (US); Dustin Bullock, Austin, TX (US); Matthew Neeley, Austin, TX (US); Mark Carlson Rane, Austin, TX (US); James William Sonntag, Austin, TX (US); Dennis Zuck, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/896,065

(22) Filed: Jun. 8, 2020

(65) Prior Publication Data

US 2020/0339335 A1 Oct. 29, 2020

Related U.S. Application Data

(63) Continuation-in-part of application No. 15/618,457, filed on Jun. 9, 2017, now abandoned, and a (Continued)

(51) Int. Cl.

| | |
|---|---|
| ***B65D 81/38*** | (2006.01) |
| ***B65B 31/04*** | (2006.01) |
| ***B65D 81/30*** | (2006.01) |

(52) U.S. Cl.
CPC ..... *B65D 81/3823* (2013.01); *B65B 31/04* (2013.01); *B65D 81/30* (2013.01); *B65D 81/3818* (2013.01); *B65D 81/38* (2013.01)

(58) Field of Classification Search
CPC ..... B29C 44/129; B65D 81/38; B65D 7/12; B31B 3/00; F25D 3/08; F25D 2303/081; F25D 2331/804; B32B 27/302
(Continued)

(56) References Cited

U.S. PATENT DOCUMENTS

| | | | |
|---|---|---|---|
| 1,000,103 | A | 8/1911 | Mills |
| 1,001,141 | A | 8/1911 | Grosskopf |

(Continued)

FOREIGN PATENT DOCUMENTS

| | | | |
|---|---|---|---|
| AU | 2015203857 | A1 | 7/2015 |
| CA | 2512003 | A1 | 1/2007 |

(Continued)

OTHER PUBLICATIONS

Apr. 3, 2017—(WO) International Search Report and Written Opinion.

(Continued)

*Primary Examiner* — J. Gregory Pickett
*Assistant Examiner* — Tia Cox
(74) *Attorney, Agent, or Firm* — Banner & Witcoff, Ltd.

(57) ABSTRACT

Systems and methods for making an insulating container having at least one cavity in a lid insulating structure or base insulating structure and having at least one vacuum insulated panel disposed within the at least one cavity.

20 Claims, 34 Drawing Sheets

Related U.S. Application Data continuation-in-part of application No. 15/596,747, filed on May 16, 2017, now Pat. No. 10,676,267, which is a continuation-in-part of application No. PCT/US2016/063658, filed on Nov. 23, 2016.

(60) Provisional application No. 62/259,879, filed on Nov. 25, 2015, provisional application No. 62/348,295, filed on Jun. 10, 2016.

(58) Field of Classification Search
USPC ..... 220/592.25, 1.5, 592.27, 618, 617, 615, 220/623, 608; 206/521, 523, 522; 229/103.11; 428/212
See application file for complete search history.

(56) References Cited

U.S. PATENT DOCUMENTS 1,002,984 A 9/1911 Gilmore
2,184,336 A 12/1939 Devine
2,239,128 A 4/1941 Sykes
2,301,657 A 11/1942 Hlavaty
2,555,126 A 5/1951 Greve
2,570,300 A 10/1951 Acton
2,892,564 A 6/1959 Morrison
2,927,712 A 3/1960 Armato, Sr.
2,980,285 A * 4/1961 Parsons ..... B65D 7/12 220/668
3,025,995 A 3/1962 Koelsch et al.
3,035,733 A 5/1962 Knapp
3,168,362 A 2/1965 Perkins
3,302,358 A 2/1967 Jackson
3,384,264 A 5/1968 Wallace et al.
3,389,824 A 6/1968 Berchtold
3,406,532 A 10/1968 Rownd
3,420,363 A 1/1969 Blickensderfer
3,915,304 A 10/1975 Pasco et al.
3,979,007 A 9/1976 Thornbloom, Jr.
4,024,731 A 5/1977 Branscum
4,047,633 A * 9/1977 Trombly ..... A47J 41/0072 220/592.2
4,143,695 A 3/1979 Hoehn
4,249,392 A 2/1981 Hotta
4,537,044 A 8/1985 Putnam
4,573,581 A 3/1986 Galloway et al.
4,577,475 A 3/1986 Herrera
4,873,841 A 10/1989 Bradshaw et al.
5,024,471 A 6/1991 Kahl et al.
5,040,834 A 8/1991 Kahl et al.
5,082,335 A 1/1992 Cur et al.
5,123,681 A 6/1992 Kos et al.
5,153,561 A 10/1992 Johnson
D331,064 S 11/1992 Wilson et al.
5,175,975 A 1/1993 Benson et al.
5,176,215 A 1/1993 Ackerman
5,329,787 A 7/1994 Friday
5,392,960 A 2/1995 Kendt et al.
5,408,832 A 4/1995 Boffito et al.
5,433,085 A 7/1995 Rogers
D362,900 S 10/1995 Miska
D363,767 S 10/1995 Swaim
5,465,078 A 11/1995 Jones, Jr.
5,570,588 A 11/1996 Lowe
5,605,056 A 2/1997 Brown et al.
5,638,896 A * 6/1997 Nishino ..... F25D 23/062 165/132
5,655,570 A 8/1997 Page
5,671,611 A 9/1997 Quigley
5,780,521 A 7/1998 Shmidt et al.
5,827,385 A 10/1998 Meyer et al.
5,843,353 A 12/1998 De Vos et al.
5,845,515 A 12/1998 Nelson
5,865,037 A 2/1999 Bostic
5,875,916 A 3/1999 Crockett, Sr. et al.
5,896,641 A 4/1999 Yamada et al.
5,904,264 A 5/1999 Yamada et al.
5,918,478 A 7/1999 Bostic et al.
5,943,876 A 8/1999 Meyer et al.
6,003,719 A 12/1999 Stewart, III
D418,397 S 1/2000 Sasa
6,026,978 A 2/2000 Clegg et al.
6,027,249 A 2/2000 Bielinski
6,067,813 A 5/2000 Smith
D429,966 S 8/2000 Israel et al.
6,116,285 A 9/2000 Wilson
6,128,914 A 10/2000 Tamaoki et al.
6,131,404 A 10/2000 Hase et al.
6,179,155 B1 1/2001 Komiya et al.
6,192,703 B1 2/2001 Salyer et al.
6,193,097 B1 2/2001 Perianes et al.
6,220,473 B1 4/2001 Lehman et al.
6,234,341 B1 5/2001 Tattam
6,244,066 B1 6/2001 LaRose
6,244,458 B1 6/2001 Frysinger et al.
6,253,942 B1 7/2001 Elias
6,305,185 B1 10/2001 Sloan
6,308,518 B1 10/2001 Hunter
6,325,281 B1 12/2001 Grogan
6,349,559 B1 2/2002 Hasanovic
6,381,981 B1 5/2002 Yaddgo et al.
6,397,620 B1 6/2002 Kelly et al.
6,415,623 B1 7/2002 Jennings et al.
6,446,382 B1 9/2002 Cloutier et al.
6,457,323 B1 10/2002 Marotta
6,488,172 B1 12/2002 Wenning et al.
6,497,438 B1 12/2002 Holub et al.
6,536,089 B1 3/2003 Komiya et al.
6,536,228 B1 3/2003 Hall
6,651,444 B2 11/2003 Morimoto et al.
6,698,230 B1 3/2004 Brusky
6,763,678 B2 7/2004 Harper
6,782,711 B2 8/2004 Abfalter
6,863,949 B2 3/2005 Ehrmanntraut
6,913,160 B2 7/2005 Bourreau et al.
6,929,137 B1 8/2005 Granger et al.
6,938,968 B2 9/2005 Tanimoto et al.
D510,370 S 10/2005 Bertani
7,057,527 B2 * 6/2006 Hunter ..... B65D 81/3823 220/592.25
7,100,393 B2 9/2006 D'Angelo
7,140,508 B2 11/2006 Kuhn et al.
7,147,125 B1 * 12/2006 Slovak ..... B65D 81/3818 220/592.2
D544,756 S 6/2007 Jones et al.
D544,757 S 6/2007 Jones et al.
D544,758 S 6/2007 Jones et al.
D544,759 S 6/2007 Jones et al.
D545,404 S 6/2007 Nightlinger et al.
D545,405 S 6/2007 Nightlinger et al.
D547,129 S 7/2007 Jones et al.
D547,617 S 7/2007 Jones et al.
7,263,855 B2 9/2007 Meyer et al.
7,269,969 B2 9/2007 Strickland et al.
D552,426 S 10/2007 Jones et al.
7,313,928 B2 1/2008 Girard
D566,479 S 4/2008 Kabalin
D569,955 S 5/2008 Chen
7,389,608 B1 6/2008 MacKay
7,500,593 B2 3/2009 Mayer
7,604,290 B1 10/2009 Giordano
7,669,436 B2 3/2010 Mogil et al.
7,681,405 B2 3/2010 Williams
7,722,204 B1 5/2010 Sandberg
7,784,301 B2 8/2010 Sasaki et al.
7,815,269 B2 10/2010 Wenning et al.
7,833,605 B2 11/2010 Fenra et al.
D634,982 S 3/2011 Melchert et al.
7,937,958 B2 5/2011 Shinya et al.
7,950,246 B1 5/2011 Mayer et al.
D646,362 S 10/2011 Olateru et al.
8,065,889 B1 11/2011 Silberman
8,066,139 B2 11/2011 Baughman
D652,262 S 1/2012 Yang et al.

(56) References Cited

U.S. PATENT DOCUMENTS 8,176,749 B2 5/2012 LaMere et al.
8,215,518 B2 7/2012 Hyde et al.
8,230,697 B2 7/2012 Lavallee
8,256,242 B1 9/2012 Evans
8,381,939 B2 2/2013 Schultz et al.
8,418,812 B1 4/2013 Rosen et al.
8,443,623 B2 5/2013 Matta et al.
8,573,002 B2 11/2013 Ledoux et al.
8,622,235 B2 1/2014 Suchecki
8,627,968 B2 1/2014 Baban
8,701,916 B2 4/2014 Cook et al.
8,763,423 B2 7/2014 Tattam
8,763,847 B2 7/2014 Mortarotti
8,800,795 B2 8/2014 Hwang
D716,916 S 11/2014 Snow
8,875,934 B2 11/2014 Deka
8,881,398 B2 11/2014 Hanley et al.
8,887,515 B2 11/2014 Patstone
8,960,370 B2 2/2015 Langwald et al.
8,986,805 B2 3/2015 Yoon et al.
9,022,249 B2 5/2015 Ranade
9,074,716 B2 7/2015 Nomura et al.
9,074,717 B2 7/2015 Nomura et al.
9,091,449 B2 7/2015 Donaldson et al.
9,139,352 B2 9/2015 Seiders et al.
9,140,481 B2 9/2015 Cur et al.
9,163,871 B1 10/2015 Costello
D744,786 S 12/2015 Bagwell
D745,809 S 12/2015 Rowley et al.
9,199,657 B2 12/2015 Martin
D748,227 S 1/2016 von Lepel et al.
D749,197 S 2/2016 von Lepel et al.
9,259,090 B1 2/2016 Cronin
9,272,475 B2 3/2016 Ranade et al.
9,389,013 B2 7/2016 Rolek et al.
9,464,751 B2 10/2016 Toshimitsu et al.
9,476,633 B2 10/2016 Allard et al.
9,527,652 B2 * 12/2016 Furneaux ..... B65D 81/3823
9,550,618 B1 1/2017 Jobe
9,555,946 B1 1/2017 Warman
D781,400 S 3/2017 Montoya et al.
D784,089 S 4/2017 Furneaux et al.
9,688,048 B2 6/2017 Caps
9,718,608 B2 8/2017 Tattam et al.
9,751,682 B2 9/2017 Mayer et al.
9,751,683 B1 9/2017 Jobe
9,796,517 B2 10/2017 Seiders et al.
9,821,945 B2 11/2017 Kuhn et al.
9,828,165 B2 11/2017 Ranade et al.
9,834,365 B2 12/2017 Pointer et al.
9,868,530 B2 1/2018 Burd
9,878,841 B2 1/2018 Holderness et al.
9,890,990 B2 2/2018 Allard et al.
9,901,153 B2 2/2018 Nash
9,902,548 B2 2/2018 Seiders et al.
D812,716 S 3/2018 Ebertowski et al.
9,944,449 B2 4/2018 Wood et al.
9,950,851 B2 4/2018 Ranade
9,957,098 B2 5/2018 Jobe
9,957,099 B2 5/2018 White et al.
9,957,859 B2 5/2018 Cohen
9,975,686 B2 5/2018 Caps
10,022,856 B2 7/2018 Bensman et al.
10,047,998 B2 8/2018 McGarry
10,065,786 B2 9/2018 Kuhn
10,119,741 B2 11/2018 Jackson et al.
10,247,468 B2 4/2019 Hiemeyer et al.
10,253,918 B2 4/2019 McCormick
10,272,934 B2 4/2019 DeFrancia
10,279,979 B2 5/2019 Ranade
10,281,188 B2 5/2019 Shew
10,287,085 B2 5/2019 Kuhn
10,322,867 B2 6/2019 Furneaux et al.
10,329,074 B2 6/2019 Ranade et al.
2001/0048985 A1 12/2001 Legare
2002/0130121 A1 * 9/2002 Taniguchi ..... F23Q 7/001 219/270
2002/0130131 A1 9/2002 Zucker et al.
2002/0144482 A1 10/2002 Henson et al.
2003/0082357 A1 5/2003 Gokay et al.
2003/0102317 A1 6/2003 Gordon
2003/0124300 A1 7/2003 Gregorio et al.
2004/0045314 A1 3/2004 Roth et al.
2004/0185203 A1 9/2004 Gregorio et al.
2004/0200232 A1 * 10/2004 Gano, III ..... B65D 81/3883 62/457.2
2004/0231355 A1 11/2004 Mayer
2005/0189404 A1 9/2005 Xiaohai et al.
2005/0205584 A1 9/2005 Degermann
2006/0279947 A1 12/2006 Henley et al.
2007/0125118 A1 6/2007 Hooper
2007/0217187 A1 9/2007 Blakely et al.
2008/0006628 A1 1/2008 Goncharko et al.
2008/0127668 A1 6/2008 DeVito et al.
2008/0178629 A1 7/2008 Meether
2008/0245793 A1 10/2008 Hanson et al.
2009/0001086 A1 1/2009 Roderick et al.
2009/0032541 A1 2/2009 Rogala et al.
2009/0071088 A1 3/2009 Viegas et al.
2009/0078699 A1 * 3/2009 Mustafa ..... B65D 81/3862 220/1.5
2009/0078708 A1 3/2009 Williams
2009/0126600 A1 5/2009 Zupancich et al.
2009/0193765 A1 8/2009 Lantz
2009/0241584 A1 10/2009 Hayes et al.
2009/0283525 A1 11/2009 Martinez et al.
2010/0200599 A1 8/2010 Molthen et al.
2010/0212351 A1 * 8/2010 Chapin ..... F25D 3/08 62/457.5
2010/0326993 A1 12/2010 Mayer et al.
2011/0100868 A1 5/2011 Lantz
2011/0147391 A1 6/2011 Corder et al.
2011/0226003 A1 9/2011 Chaney et al.
2011/0226785 A1 9/2011 Sakell
2011/0248038 A1 10/2011 Mayer
2011/0260351 A1 10/2011 Corradi et al.
2011/0284556 A1 11/2011 Palmer et al.
2012/0132657 A1 5/2012 Seiders
2012/0225236 A1 9/2012 Cox
2012/0237715 A1 9/2012 McCracken
2012/0297813 A1 11/2012 Hanley et al.
2012/0318808 A1 12/2012 McCormick
2013/0033854 A1 2/2013 Statham
2013/0140317 A1 6/2013 Roskoss
2013/0213978 A1 8/2013 Libourel et al.
2013/0248649 A1 9/2013 Burd
2014/0008374 A1 1/2014 Lubart et al.
2014/0151382 A1 6/2014 White et al.
2014/0252010 A1 9/2014 Miller
2014/0352350 A1 12/2014 Wickline
2014/0353317 A1 * 12/2014 Ranade ..... B65D 81/3823 220/592.01
2015/0090728 A1 4/2015 Lubart et al.
2015/0129597 A1 5/2015 McBroom et al.
2015/0166244 A1 6/2015 Wood et al.
2015/0259126 A1 9/2015 Mcgoff et al.
2015/0284169 A1 10/2015 Nehring
2015/0369529 A1 12/2015 Monroe
2016/0025399 A1 1/2016 Miller et al.
2016/0039594 A1 2/2016 Ranade
2016/0090227 A1 3/2016 Miller
2016/0187045 A1 6/2016 McGarry
2016/0230918 A1 8/2016 Kim et al.
2016/0244239 A1 8/2016 Nash
2016/0376082 A1 12/2016 Gammons et al.
2017/0045286 A1 2/2017 Ungor et al.
2017/0121097 A1 5/2017 Pranadi et al.
2017/0210542 A1 7/2017 Seiders et al.
2017/0225869 A1 8/2017 Ranade
2017/0267438 A1 9/2017 Welch et al.
2017/0283157 A1 10/2017 Jobe
2017/0305639 A1 10/2017 Kuhn et al.
2017/0313492 A1 11/2017 Seiders et al.
2017/0321955 A1 11/2017 Hiemeyer et al.

(56) References Cited

U.S. PATENT DOCUMENTS

| | | | |
|---|---|---|---|
| 2018/0015938 | A1 | 1/2018 | DeFrancia |
| 2018/0016083 | A1 | 1/2018 | Knight et al. |
| 2018/0044094 | A1 | 2/2018 | Seiders et al. |
| 2018/0073625 | A1 | 3/2018 | Miyazono et al. |
| 2018/0080700 | A1 | 3/2018 | Cooper |
| 2018/0086538 | A1 | 3/2018 | Jobe |
| 2018/0100684 | A1 | 4/2018 | Allard et al. |
| 2018/0110312 | A1 | 4/2018 | Nash |
| 2018/0120021 | A1 | 5/2018 | Pompen et al. |
| 2018/0141718 | A1 | 5/2018 | Ahlstrom et al. |
| 2018/0149400 | A1 | 5/2018 | Valencia |
| 2018/0162626 | A1 | 6/2018 | Munie et al. |
| 2018/0194534 | A1 | 7/2018 | Jobe |
| 2018/0320947 | A1 | 11/2018 | Jain et al. |
| 2018/0328644 | A1 | 11/2018 | Rizzo et al. |
| 2019/0039811 | A1 | 2/2019 | Kuhn et al. |
| 2019/0071238 | A1 | 3/2019 | Seiders et al. |
| 2019/0152677 | A1 | 5/2019 | Hoyt |
| 2019/0161240 | A1 | 5/2019 | Ahlstrom et al. |
| 2019/0210789 | A1 | 7/2019 | Ranade |
| 2019/0210790 | A1 | 7/2019 | Rizzo et al. |

FOREIGN PATENT DOCUMENTS

| | | | |
|---|---|---|---|
| CA | 2981246 | A1 | 11/2016 |
| CA | 3001052 | A1 | 4/2017 |
| CA | 2968503 | A1 | 11/2017 |
| CN | 201128555 | Y | 10/2008 |
| CN | 102305335 | A | 1/2012 |
| CN | 102748558 | A | 10/2012 |
| CN | 202463019 | U | 10/2012 |
| CN | 202594113 | U | 12/2012 |
| CN | 202644758 | U | 1/2013 |
| CN | 103723379 | A | 4/2014 |
| CN | 103968196 | A | 8/2014 |
| CN | 104964124 | A | 10/2015 |
| CN | 303435939 | S | 11/2015 |
| CN | 205686756 | U | 11/2016 |
| CN | 107434096 | A | 12/2017 |
| DE | 10301318 | A1 | 8/2004 |
| DE | 202004016939 | U1 | 3/2005 |
| DE | 102004050549 | A1 | 3/2006 |
| DE | 102014003413 | A1 | 9/2015 |
| DE | 102014006579 | A1 | 9/2015 |
| DE | 102014007987 | A1 | 12/2015 |
| DE | 202015004047 | U1 | 9/2016 |
| DE | 202018102967 | U1 | 6/2018 |
| DE | 202018105918 | U1 | 11/2018 |
| DE | 102017007365 | A1 | 2/2019 |
| EP | 1177879 | A2 | 2/2002 |
| EP | 1177984 | A2 | 2/2002 |
| EP | 1428643 | A2 | 6/2004 |
| EP | 1505359 | A1 | 2/2005 |
| EP | 1896786 | A2 | 3/2008 |
| EP | 2022728 | A1 | 2/2009 |
| EP | 2221569 | A1 | 8/2010 |
| EP | 2372218 | A1 | 10/2011 |
| EP | 2765375 | A2 | 8/2014 |
| EP | 2883812 | A1 | 6/2015 |
| EP | 2943414 | A1 | 11/2015 |
| EP | 2985551 | A1 | 2/2016 |
| EP | 2989025 | A1 | 3/2016 |
| EP | 3004479 | A1 | 4/2016 |
| EP | 3018398 | A1 | 5/2016 |
| EP | 3114046 | A1 | 1/2017 |
| EP | 3117135 | A1 | 1/2017 |
| EP | 3148901 | A1 | 4/2017 |
| EP | 3212525 | A2 | 9/2017 |
| EP | 3215441 | A1 | 9/2017 |
| EP | 3224557 | A1 | 10/2017 |
| EP | 3224558 | A1 | 10/2017 |
| EP | 3249324 | A1 | 11/2017 |
| EP | 3253683 | A1 | 12/2017 |
| EP | 3265731 | A1 | 1/2018 |
| EP | 3359889 | A1 | 8/2018 |
| EP | 3368442 | A1 | 9/2018 |
| EP | 3408599 | A1 | 12/2018 |
| EP | 3436368 | A1 | 2/2019 |
| FR | 2447174 | A1 | 8/1980 |
| GB | 2222791 | A | 3/1990 |
| GB | 2538105 | A | 11/2016 |
| GB | 2558682 | A | 7/2018 |
| JP | H0654767 | A | 3/1994 |
| JP | 2005035632 | A | 2/2005 |
| JP | 2007246097 | A | 9/2007 |
| JP | 2012062076 | A | 3/2012 |
| KR | 20000010993 | A | 2/2000 |
| KR | 20020021938 | A | 3/2002 |
| WO | 9711842 | A1 | 4/1997 |
| WO | 05036076 | A1 | 4/2005 |
| WO | 12017903 | A1 | 2/2012 |
| WO | 2015156305 | A1 | 10/2015 |
| WO | 2016070956 | A1 | 5/2016 |
| WO | 2016181111 | A1 | 11/2016 |
| WO | 17129377 | A1 | 8/2017 |
| WO | 17136754 | A1 | 8/2017 |
| WO | 17172029 | A1 | 10/2017 |
| WO | 17197230 | A1 | 11/2017 |
| WO | 18005859 | A2 | 1/2018 |
| WO | 18086752 | A1 | 5/2018 |
| WO | 18227047 | A1 | 12/2018 |
| WO | 19011478 | A1 | 1/2019 |
| WO | 19030225 | A1 | 2/2019 |
| WO | 19125527 | A1 | 6/2019 |

OTHER PUBLICATIONS

Aug. 1, 2018—U.S. Office Action—U.S. Appl. No. 15/596,747.
Aug. 13, 2018—(WO) International Search Report and Written Opinion—App. PCT/US2018/032972.
Feb. 26, 2019—(CN) Office Action—App. 201680079515.2.
Mar. 8, 2019—U.S. Office Action—U.S. Appl. No. 15/596,747.
60 Qt. Stainless Steel Party Cooler by Oakland Living, retrieved from Internet Jul. 6, 2017, URL: https://www.wayfair.com/Oakland-Living-60-Qt.-Stainless-Steel-Party-Cooler-OAA2986.html, 5 pp.
80 Qt. Stainless Steel Rolling Cooler with Cover by Trinity, retrieved from Internet Jul. 6, 2017, URL: https://www.wayfair.com/Trinity-80-Qt.-Stainless-Steel-Rolling-Cooler-with-Cover-TTY1173.html, 5 pp.
Coleman Steel Belted Review, retrieved from Internet Jul. 6, 2017, URL: http://www.coolersonsale.com/coleman-steel-belted, 10 pp.
Igloo Stainless Steel 54-Quart Cooler, retrieved from Internet Feb. 5, 2018, URL: https://www.igloocoolers.com/products/44669-legacy-stainless-steel-54-qt-cooler-stainless, 4 pp.
Kitchenall Beverage Air DW64-S Deep Well Beer Cooler, Stainless Steel, retrieved from Internet Jul. 6, 2017, URL: https://www.kitchenall.com/beverage-air-dw64-s.html, 3 pp.
Koolatron 54-Qt Corona Stainless Steel Ice Chest Cooler, retrieved from Internet Jul. 6, 2017, URL: https://www.wayfair.com/Koolatron-54-Qt.-Corona-Stainless-Steel-Ice-Chest_Cooler-KOO1576.html, 4 pp.
Portable Plastic Inner Ice Box Refrigerated Cooler box by Shengshi, retrieved from Internet Jul. 7, 2017, URL: https://www.alibaba.com/product-detail/Portable-Plastic-Inner-Ice-Box-Regrigerated_1073478882.html?s=p , 7 pp.
Vintage Beer Cooler, retrieved from Internet Jul. 6, 2017, URL: http://www.ebay.com/bhp/vintage-beer-cooler, 8 pp.
Dec. 11, 2019—(CN) Second Office Action—App. 201680079515.2.
Jul. 6, 2020—(CN) Office Action—App. No. 201680079515.2.
Apr. 15, 2021—(EP) Extended Search Report—App. No. 18801950.9.
May 26, 2021—(CN) First Office Action—App. No. 201880031149.2.

* cited by examiner

2100

INSULATING CONTAINER HAVING VACUUM INSULATED PANELS AND METHOD

CROSS REFERENCE TO RELATED APPLICATIONS

This application is a continuation-in-part of pending U.S. application Ser. No. 15/618,457 filed Jun. 9, 2017; which claims priority to U.S. Provisional Application No. 62/348,295 filed Jun. 10, 2016. This application is also a continuation-in-part of pending U.S. application Ser. No. 15/596,747 filed May 16, 2017, issued Jun. 9, 2020 as U.S. Pat. No. 10,676,267, which is a continuation-in-part of now expired International Application No. PCT/US2016/063658 filed Nov. 23, 2016, which claims priority to U.S. Provisional Application No. 62/259,879 filed Nov. 25, 2015. This application claims the benefits of the above-identified applications which are expressly incorporated herein by reference in their entirety for any and all non-limiting purposes.

BACKGROUND

An insulating container may be configured to reduce a heat rate transfer through one or more surfaces to keep items within a storage compartment of the insulating container cool. Insulating containers may be molded from a polymer and may comprise one or more cavities configured to be filled with an additional insulating material, such as foam. However, a need exists for an insulating container that may provide increased thermal resistance and/or increased storage capacity. Aspects of this disclosure relate to improved insulating containers and methods for production of insulating containers.

BRIEF SUMMARY

According to one aspect, an insulating container having at least one vacuum insulated panel is disclosed. According to another aspect, a method of making an insulating container having at least one vacuum insulated panel is disclosed.

According to another aspect, an insulating container is disclosed. The insulating container may comprise a base insulating structure and a lid insulating structure that, when closed, encloses an internal storage compartment. The base insulating structure may comprise at least one side insulating structure having an outer face comprising, or coextensive with, a surface of an insulating component containing a vacuum insulated panel.

According to another aspect, an insulating container may include a base insulating structure and a lid insulating structure that, when closed, encloses an internal storage compartment. The base insulating structure may include at least one side insulating structure; and a bottom insulating structure. Each of the lid insulating structure and the bottom insulating structure may comprise at least one vacuum insulated panel. The lid insulating structure may further comprise a first retaining portion having a first cavity, a first insulating portion disposed in the first cavity, a first cover, enclosing the first cavity and the first insulating portion. The at least one side insulating structure may further comprise an internal cavity. The bottom insulating structure may further comprise a second retaining portion having a second cavity, a second insulating portion disposed in the second cavity, a second cover, enclosing the second cavity and the second insulating portion. Each of the first and second insulating portions may comprise at least one vacuum insulated panel.

According to another aspect, a method of manufacturing an insulating container is disclosed. The method may include molding a lid insulating structure from a polymer, the lid insulating structure may include a retaining portion having a first cavity. The method may include molding a base insulating structure from a polymer, the base insulating structure may include at least one side insulating structure having an internal cavity, and a bottom insulating structure having a second retaining portion having a second cavity. The method may also include inserting a first insulating portion into the first cavity; engaging a first cover portion with the first retaining portion to enclose the first cavity and the first insulating portion; inserting a second insulating portion into the second cavity; engaging a second cover portion with the second retaining portion to enclose the second cavity and the second insulating portion. Each of the first and second insulating portions may comprise at least one vacuum insulated panel.

According to another aspect, an insulating container is disclosed. The insulating container may include a base insulating structure and a lid insulating structure that, when closed, encloses an internal storage compartment. The base insulating structure may further include at least one side insulating structure that has a first retaining portion with a first cavity, a first insulating portion positioned within the first cavity, and a first cover portion enclosing the first cavity and the first insulating portion. The base insulating structure may additionally include a bottom insulating structure that has a second retaining portion that has a second cavity, a second insulating portion positioned within the second cavity, and a second cover portion enclosing the second cavity and the second insulating portion. The lid insulating structure may further include a third retaining portion with a third cavity, a third insulating portion positioned within the third cavity, and a third cover portion that encloses the third cavity and the third insulating portion. Further, the first, second, and third insulating portions may include at least one vacuum insulated panel. Additionally, the first, second, and third cover portions may be coupled to the first, second, and third retaining portions, respectively, and form inner walls of the internal storage compartment.

According to another aspect, an insulating container is disclosed, the insulating container may include a base insulating structure and a lid insulating structure that enclose an internal storage compartment. The base insulating structure may include a cavity enclosed by an outer shell structure and an inner wall structure. An insulating portion may be positioned within the cavity and at least partially surrounded by a mass of insulating foam. Further, the insulating portion may include at least one vacuum insulated panel.

According to another aspect, a method of manufacturing an insulating container is disclosed. The method may include molding a lid insulating structure and a base insulating structure. The molding may further include molding a polymer foam around a first insulating portion to form a base core structure, and molding the polymer foam around a second insulating portion to form a lid core structure. Further, the molding may include rotational molding a first outer shell around at least a portion of the base core structure to form the base insulating structure, and rotational molding a second outer shell around at least a portion of the lid core structure to form the lid insulating structure. Further, the first and second insulating portions may include at least one vacuum insulated panel.

According to another aspect, an insulating container having a base insulating structure and lid insulating structure that when closed, enclose an internal storage compartment, the insulating container is disclosed. The base insulating structure may include a base cavity enclosed by a base outer shell structure and a base inner wall structure, the base inner wall structure including a base collar extending around the perimeter of the base insulating structure; and a base insulating portion positioned within the base cavity, the base insulating portion at least partially surrounded by a mass of insulating foam. The lid insulating structure may be pivotally engaged with the base insulating structure, the lid insulating structure may include a lid cavity enclosed by a lid outer shell structure and a lid inner wall structure, the lid inner wall structure including a lid collar extending around the perimeter of the lid insulating structure; and a lid insulating portion positioned within the cavity, the lid insulating portion at least partially surrounded by a mass of insulating foam. At least one of the base insulating portion and the lid insulating portion comprise at least one vacuum insulated panel.

The base insulating portion may include a first sidewall vacuum insulated panel, a second sidewall vacuum insulated panel, and a 3-piece vacuum insulated panel. The 3-piece vacuum insulated panel may include a foldable insulating panel having two foldable portions such that the foldable insulating portions are folded to extend around two corners of the base insulating structure. The 3-piece vacuum insulated panel may comprise one vacuum insulated panel. The two foldable portions of the insulating container may be compressed such that a thickness of the two foldable portions is less than a thickness of the remaining portions of the 3-piece vacuum insulated panel. The 3-piece vacuum insulated panel may include a cut-out portion. The lid insulating portion may include one vacuum insulated panel. The lid insulating portion may include a cut-out portion.

The insulating container may also include an end cap engaged with a bottom end of the base outer shell structure.

The base outer shell structure may include a top flange and a bottom flange, wherein the top flange is engaged within a channel in the base inner wall structure, and wherein the bottom flange is engaged within a channel in the end cap. The lid outer shell structure may include a flange, and wherein the flange is engaged within a channel in the lid collar.

The insulating container of may also include at least one base engagement structure extending from the base collar, wherein the base engagement structure includes a base engagement structure channel that is substantially perpendicular to the channel in the base inner wall structure and wherein the top flange is engaged within the base engagement channel. At least one of a latch, a handle, and a hinge is engaged with the base engagement structure using at least one mechanical fastener.

The insulating container of may include at least one lid engagement structure extending from the lid collar, wherein the lid engagement structure includes a lid engagement structure channel that is substantially perpendicular to the channel in the lid inner wall structure and wherein the flange of the lid outer wall is engaged within the lid engagement channel. At least one of a latch, a handle, and a hinge may be engaged with the base engagement structure and the lid engagement structure using at least one mechanical fastener.

According to another aspect an insulating container having a base insulating structure and lid insulating structure that when closed, enclose an internal storage compartment is disclosed. The base insulating structure may include a base cavity enclosed by a base outer shell structure composed of stainless steel and a base inner wall structure composed of polyethylene, the base inner wall structure including a base collar extending around the perimeter of the base insulating structure; an end cap composed of polyethylene engaged with a bottom end of the base outer wall; and a base insulating portion positioned within the base cavity, the base insulating portion at least partially surrounded by a mass of insulating foam. The lid insulating structure may be pivotally engaged with the base insulating structure, and the lid insulating structure may include a lid cavity enclosed by a lid outer shell structure composed of stainless steel and a lid inner wall structure composed of polyethylene, the lid inner wall structure including a lid collar extending around the perimeter of the lid insulating structure; and a lid insulating portion positioned within the cavity, the lid insulating portion at least partially surrounded by a mass of insulating foam. The base insulating portion and the lid insulating portion may each comprise at least one vacuum insulated panel, and the base insulating portion may include a foldable vacuum insulated panel having at least one foldable portion such that the foldable portion is folded to extend around at least one corner of the base insulating structure. The insulating foam may be polyurethane.

The foldable portion of the folded vacuum insulated panel may be compressed such that a thickness of the foldable portion is less than a thickness of the remaining portions of the foldable vacuum insulated panel. The foldable vacuum insulated panel may include a cut-out portion.

In another aspect an insulating container having a base insulating structure and lid insulating structure that when closed, enclose an internal storage compartment is disclosed. The base insulating structure may include a base cavity enclosed by a base outer shell structure composed of stainless steel and a base inner wall structure composed of polyethylene, the base inner wall structure including a base collar extending around the perimeter of the base insulating structure; an end cap composed of polyethylene engaged with a bottom end of the base outer wall; a base insulating portion positioned within the base cavity, the base insulating portion at least partially surrounded by a mass of insulating foam; and at least one base engagement structure extending from the base collar, wherein the base engagement structure includes a base engagement structure channel that is substantially perpendicular to the channel in the base inner wall structure and wherein the top flange is engaged within the base engagement channel. The lid insulating structure may be pivotally engaged with the base insulating structure, the lid insulating structure may include a lid cavity enclosed by a lid outer shell structure composed of stainless steel and a lid inner wall structure composed of polyethylene, the lid inner wall structure including a lid collar extending around the perimeter of the lid insulating structure; and a lid insulating portion positioned within the cavity, the lid insulating portion at least partially surrounded by a mass of insulating foam. The base insulating portion and the lid insulating portion each may comprise at least one vacuum insulated panel. The base outer wall may further comprises a top flange and a bottom flange, wherein the top flange is engaged within channel in the base inner wall structure, and wherein the bottom flange is engaged within a channel in the end cap. The lid outer wall may further comprise a flange, and wherein the flange is engaged within a channel in the lid collar. At least one of a latch, a handle, and a hinge may be engaged with the base engagement structure using at least one mechanical fastener and wherein the mechanical faster passes through all the base engagement structure and the base outer wall.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present disclosure is illustrated by way of example and not limited in the accompanying figures in which like reference numerals indicate similar elements and in which.

Figure 1:
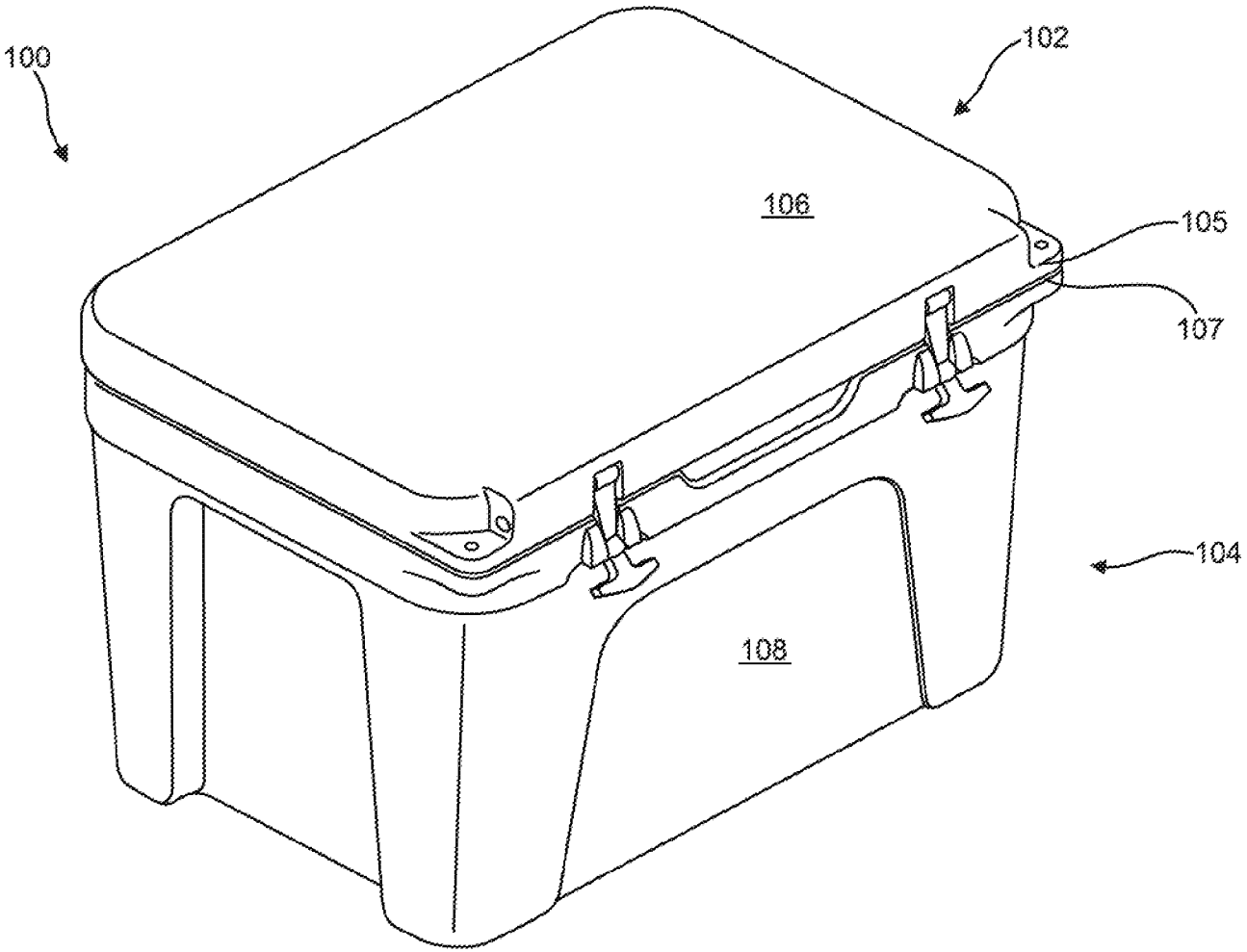
FIG. 1 depicts an isometric view of an example of an insulating container, according to one or more aspects described herein.

Further, it is to be understood that the drawings may represent the scale of different component of one single embodiment; however, the disclosed embodiments are not limited to that particular scale.

DETAILED DESCRIPTION

Exemplary embodiments are shown in the drawings and will herein be described in detail with the understanding that the present disclosure is to be considered as an exemplification, and is not intended to be limited to the embodiments illustrated. It is to be understood that other embodiments may be utilized, and structural and functional modifications may be made, without departing from the scope and spirit of the present disclosure.

In the following description of the various embodiments, reference is made to the accompanying drawings, which form a part hereof, and in which is shown by way of illustration, various embodiments of the disclosure that may be practiced. It is to be understood that other embodiments may be utilized.

In the following description of various example structures, reference is made to the accompanying drawings, which form a part hereof, and in which are shown by way of illustration various example devices, systems, and environments in which aspects of the disclosures herein may be practiced. It is to be understood that other specific arrangements of parts, example devices, systems, and environments may be utilized and structural and functional modifications may be made without departing from the scope of the present disclosures. Also, while the terms "top," "bottom," "front," "back," "side," "rear," "upward," "downward," and the like may be used in this specification to describe various example features and elements, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of these disclosures. Also, the reader is advised that the attached drawings are not necessarily drawn to scale.

In general, aspects of this disclosure relate to systems and methods for production of an insulating container, or device, that may have one or more vacuum insulated panels. According to various aspects and embodiments, the insulating container may be formed of one or more of a variety of materials, such as metals (including metal alloys), plastics, polymers, and composites, and may be formed in one of a variety of configurations, without departing from the scope of these disclosures.

The various figures in this application illustrate examples of insulating containers/structures according to this disclosure. When the same reference number appears in more than one drawing, that reference number is used consistently in this specification and the drawings refer to the same or similar parts throughout.

FIG. 1 depicts an isometric view of one example of an insulating container 100, according to one or more aspects described herein. In particular, the insulating container 100 may be described as a "cooler" device, having a lid insulating structure 102 with a lid upper face 106 and a base insulating structure 104 that includes side insulating structures 475 (see FIGS. 4B, 4C) with respective side outer faces 108*a*, 108*b*, 108*c*, 108*d* (see also FIG. 4A) and a bottom insulating structure 465 with bottom outer face 455 (see FIGS. 4B, 4C). Lid insulating structure 102, when closed, together with base insulating structure 104, including side insulating structures 475 and bottom insulating structure 465. enclose an internal storage compartment 445 (see FIGS. 4A-C). In one example, the insulating container 100 may be configured, by virtue of various features of lid insulating structure 102, side insulating structures 475, and bottom insulating structure 465, discussed in greater detail below, to reduce a rate of heat transfer to/from internal storage compartment 445. In one example, lid insulating structure 102 may be hinged (e.g., along respective mating edges 105, 107 of lid insulating structure 102 and base insulating structure 104) relative to base insulating structure 104 to either enclose or allow access to internal storage compartment 445.

The insulating container 100 may have one or more structural elements configured to increase a thermal resistance of the container 100. As such, the insulating container 100, or elements of the insulating container, may be molded from one or more polymers, for example using a rotational molding (rotomolding) process. In this way, load-bearing structures of the insulating container 100 may be formed from one or more molded polymers. In one example, utilizing one or more polymers to form the structural elements of the insulating container 100 may offer the advantage of comparatively higher thermal resistivity properties exhibited by polymers, when compared to, for example, metals or alloys. Any of lid insulating structure 102 and base insulating structure 104, including side insulating structures 475 and bottom insulating structure 465, may be molded from one type of polymer, from different types of polymers in different regions (e.g., in the case of discreet polymer layers), or from blends of different polymers (e.g., in the case of homogeneously distributed polymers). Likewise, any elements (e.g., inner, outer, top, and bottom walls) of insulating structure 102 and base insulating structure 104, including side insulating structures 475 and bottom insulating structure 465, as described in greater detail below, may be molded from one type of polymer, from different types of polymers in different regions (e.g., in the case of discreet polymer layers), or from blends of different polymers (e.g., in the case of homogeneously distributed polymers).

In one implementation, the insulating container 100 may represent one example of a device that may be utilized with the systems and methods described herein in order to achieve improved thermal resistance. As such, the dimensions of insulating container 100, in addition to the various depicted geometrical features of insulating container 100 are not specific. Systems and methods described herein may be utilized with any insulating device structure that has one or more internal cavities configured to be partially or wholly filled with an additional insulating material.

Figure 2A:
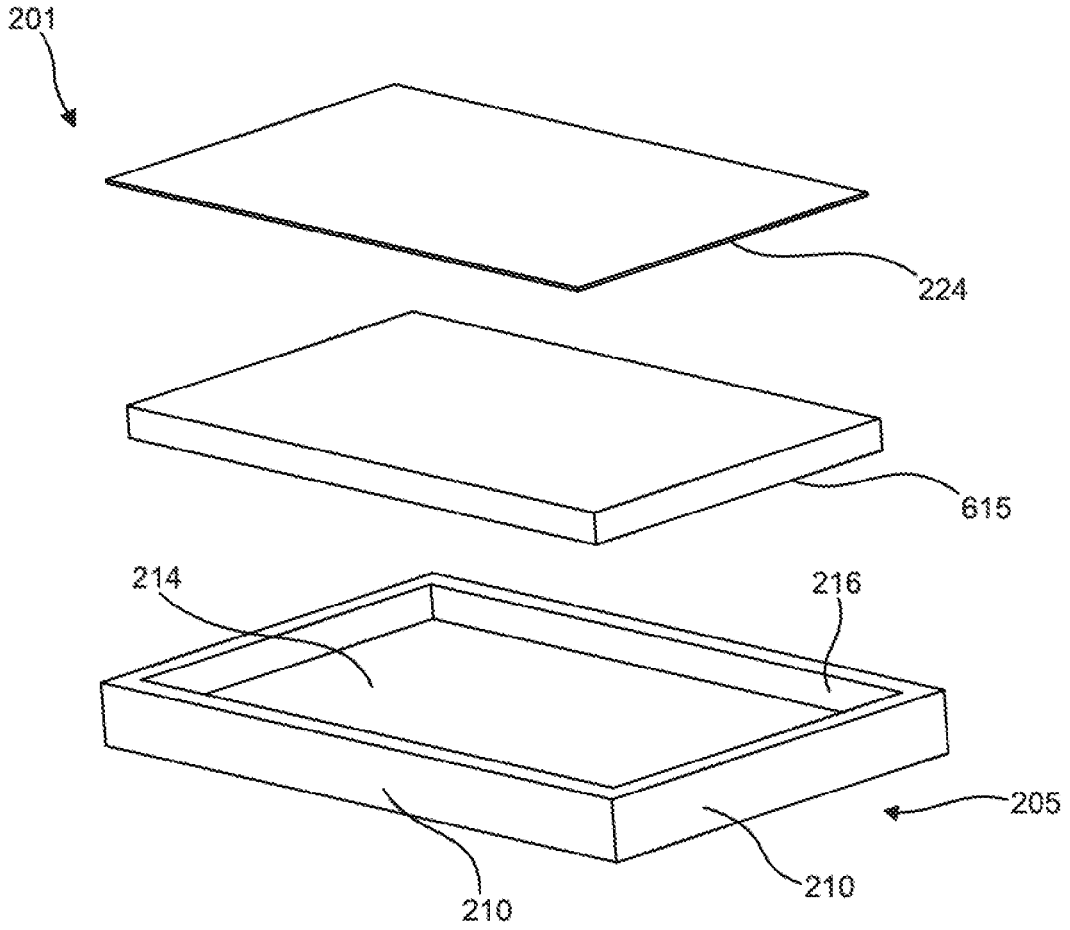
FIGS. 2A-2B schematically depict insulating components, according to one or more aspects described herein.
Figure 2B:
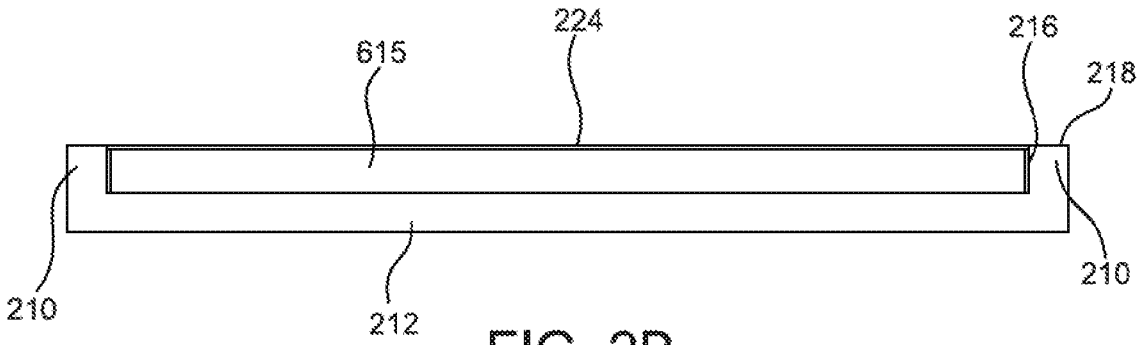
Figure 2C:
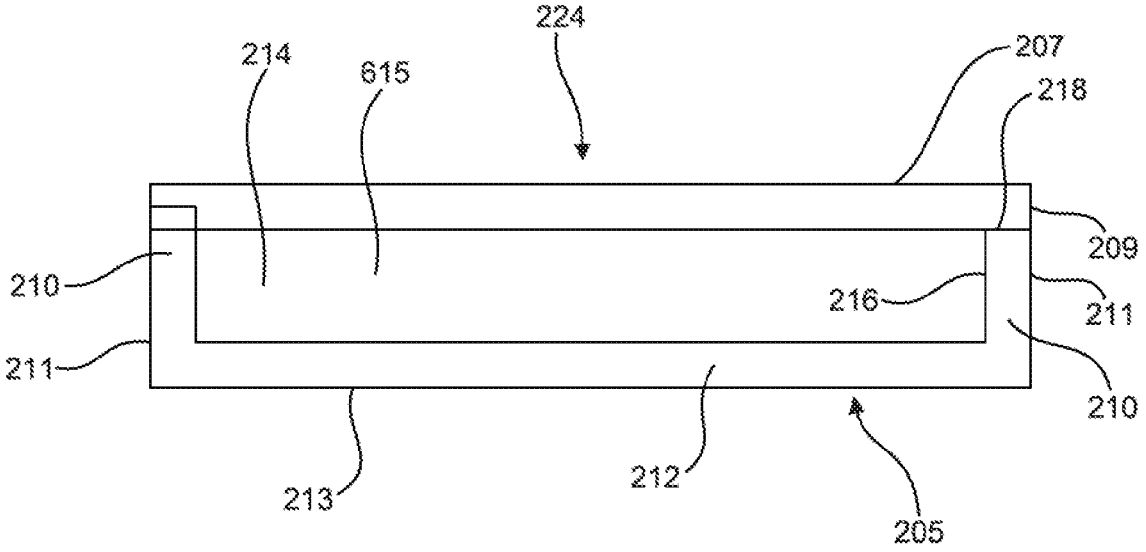
FIG. 2C schematically depicts an insulating component, according to one or more aspects described herein.

FIGS. 2A-2C schematically depict an insulating component 201 that may be used in conjunction with any one of, any combination of, or all of, lid insulating structure 102, and base insulating structure 104, including side insulating structures 475 and bottom insulating structure 465. The use of one, some, or all of these insulating structures in conjunction with insulating component 201 refers to this component being internal to an insulating structure or otherwise the insulating structure having a surface comprising, or being coextensive with, all or a portion of a surface of insulating component 201, as described in greater detail below. FIG. 2A depicts an exploded view of elements of insulating component 201 and FIG. 2B depicts a cross-sectional view of assembled elements of insulating component 201 shown in FIG. 2A. In one example, the insulating component 201 may be utilized with the systems and methods described herein for achieving improved thermal resistance. The insulating component 201 may be used in lid insulating structure 102 of insulating container 100 shown in FIG. 1.

In one example, as shown in FIGS. 2A-2C, insulating component 201 may include a retaining portion 205, a cover portion 224, and an insulating portion 615 disposed between retaining portion 205 and cover portion 224. Retaining portion 205 may include four side walls 210, and a bottom wall 212, which form a cavity 214. Side walls 210 and bottom wall 212 may form respective retaining portion outer surfaces 211 and retaining portion bottom surface 213 (see FIG. 2C). In one specific example, and similar to insulating container 100 as a whole, insulating component 201, or any of its elements, may be molded from polyethylene. In another example, insulating component 201, or any of its elements, may be molded from polyurethane. In some embodiments, all elements of insulating component 201 may be molded from the same type of polymer. In other embodiments, different elements of insulating component 201 may be molded from different polymers.

As discussed in more detail below, the insulating portion 615 may comprise one or more vacuum insulated panels 625, for example in any of the configurations shown in FIGS. 5A-5H and discussed in greater detail below. Insulating portion 615 may be sized to fit within the cavity 214, such that it may be contained in insulating component 201. Additionally or alternatively, the insulating portion 615 may comprise a mass of insulating foam that partially or wholly fills a cavity within the insulating portion 615.

As shown in FIGS. 2A-2C, cover portion 224 may be disposed over insulating portion 615 and may secure insulating portion 615 within cavity 214. In some embodiments, cover portion 224 may correspond with the upper face of the lid 106. Insulating portion 615 may also be secured within cavity 214 using, as an alternative to, or in addition to, cover portion 224, adhesives, tape, or other devices. As shown in FIG. 2B, cover portion 224 may abut, and/or be bonded to, an inner surface 216 of retaining portion 205 (e.g., corresponding to an inner surface of side wall 210). In other embodiments, as shown for example in FIG. 2C, cover portion 224 may abut, and/or be bonded to top surface 218 of retaining portion 205 (e.g., corresponding to a top surface of side wall 210). In the case of cover portion 224 abutting inner surface 216, a cover portion top surface 207 (see FIG. 2C) and top surface 218 of retaining portion 205 (or side wall 210 thereof) may be substantially co-planar. In the case of cover portion 224 abutting top surface 218, a cover portion side surface 209 and an outer surface 211 of retaining portion 205 (or side wall 210 thereof) may be substantially co-planar. As shown with dashed lines on the left-hand side of FIG. 2C, cover portion 224 may abut both inner surface 216 and top surface 218 of retaining portion 205 (or side wall 210 thereof).

Cover portion 224 may be fastened to retaining portion 205 by any means suitable, including for example, using chemical bonding agents including adhesives, using mechanical fasteners including screws, rivets or interference fittings, and/or using thermal bonding (e.g., by melting) with or without a separate bonding agent such as a low melting point polymer. For example, cover portion 224 may be attached to retaining portion 205 by welding or plastic welding cover portion 224 to retaining portion 205. In some examples, engagement between cover portion and retaining portion 205 may provide a watertight seal, advantageously preventing liquids from entering cavity 214 and/or insulating portion 615 which may reduce the efficiency of the insulating portion 615 and overall performance of insulating container 100. In one specific example, this seal may include a gasket element that extends around a perimeter of the cover portion 224. It is contemplated that any gasket design (c-shaped gasket, among others) may be utilized, without departing from the scope of these disclosures. In one implementation, a coupling between a cover portion 224 and a retaining portion 205 may be rigid, or may be removable, without departing from the scope of these disclosures.

Cover portion 224 may be manufactured of any suitable material. In some examples cover portion 224 may be manufactured of metals such as stainless steel, plastics, and composites including, for example, carbon fiber. In some examples, cover portion 224 and retaining portion 205 may be molded, for example, through rotomolding, as a single piece and in other examples cover portion 224 and retaining portion 205 may be molded as separate pieces. In some examples, insulating portion 615 may be included within cavity 214 of insulating component 201 during the molding, for example rotomolding, process. In still other examples, cover portion 224 and retaining portion 205 may be molded as a single piece without insulating portion 615 included within cavity 214. In such a process, cover portion 224 may be removed, for example, by cutting, allowing insulating portion 615 to be inserted into cavity 214, followed by re-engagement of cover portion 224 with retaining portion 205 as discussed above.

Figure 3A:
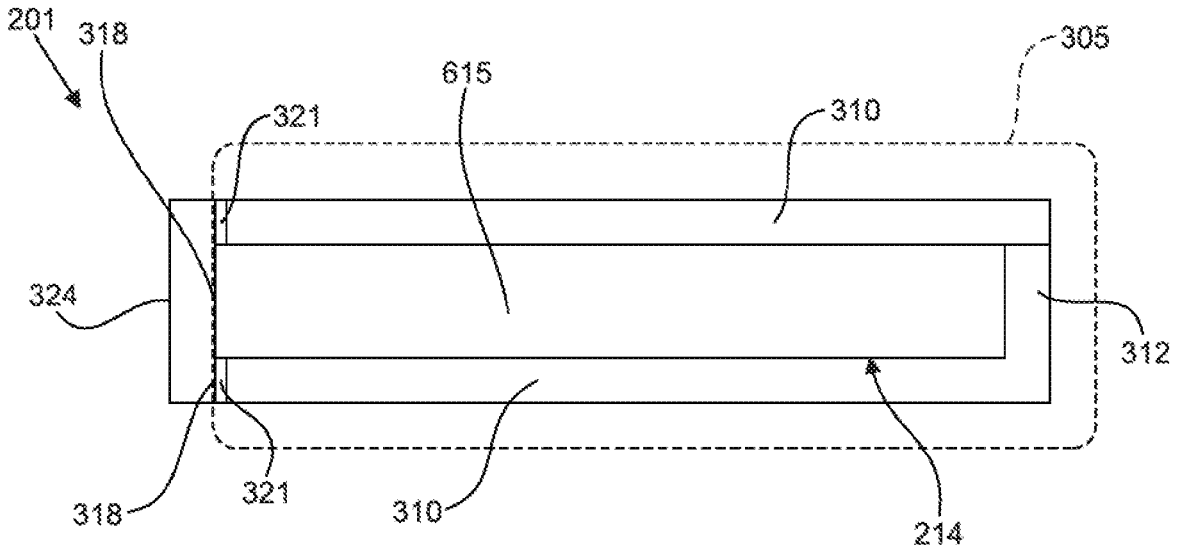
FIGS. 3A-3B schematically depict insulating components, according to one or more aspects described herein.
Figure 3B:
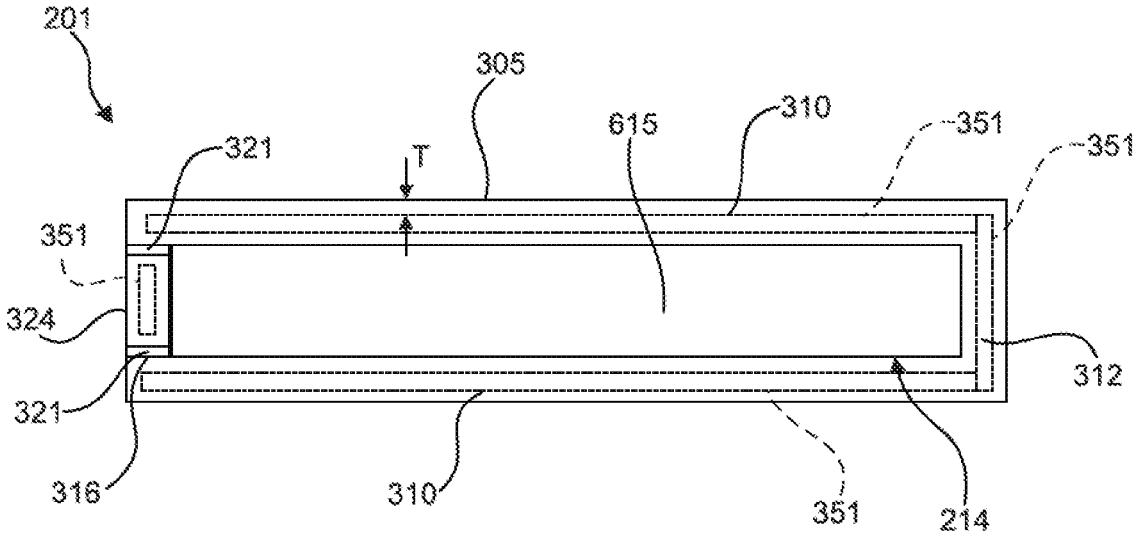

As shown in FIGS. 3A and 3B, retaining portion 305, cover portion 324, and insulating portion 615 may have other configurations and/or geometries. FIGS. 3A and 3B schematically depict cross-sections of alternative embodiments of insulating component 201. As described above, any of, any combination of, or all of, lid insulating structure 102 and base insulating structure 104, including side insulating structures 475 and bottom insulating structure 465, or portions thereof, may include insulating component 201, or otherwise have a face in common with (comprising or coextensive with) a surface of insulating component 201, according to representative insulating containers as described herein, including insulating container 100 as depicted in FIG. 1. For example, an outer face 108*a*, 108*b*, 108*c*, 108*d* of side insulating structure 475 may comprise or may be coextensive with a surface of insulating component 201. According to more particular embodiments, any of, or any portion of, (i) lid upper face 106 of lid insulating structure 102, (ii) outer faces 108*a*, 108*b*, 108*c*, 108*d* of side insulating structures 475, and/or (iii) bottom outer face 455 of bottom insulating structure 465 may comprise, or be coextensive with, all or a portion of cover portion top surface 207, cover portion side surface 209, retaining portion outer surface 211, or retaining portion bottom surface 213. According to other embodiments, insulating component 201 may be contained entirely within any of, any combination of, or all of, lid insulating structure 102 and base insulating structure 104, including side insulating structures 475 and bottom insulating structure 465.

In one example, as shown in FIG. 3A, insulating component 201 may include retaining portion 305, cover portion 324, and insulating portion 615 disposed within retaining portion 305 and cover portion 324. Retaining portion 205 may include side walls 310 and bottom wall 312, which form cavity 214 as illustrated in FIG. 2A.

As described above, insulating portion 615 may be sized to fit within cavity 214, and as discussed in more detail below, insulating portion 615 may comprise one or more vacuum insulated panels 625.

As shown in FIG. 3A, cover portion 324 may be engaged with retaining portion 305 to secure insulating portion 615 within cavity 214. As shown for example in FIG. 3B, cover portion 324 may engage inner surfaces 316 of retaining portion 305. As shown in FIG. 3A cover portion 324 may intersect top surfaces 318 of retaining portion 305.

As described above, cover portion 324 may be engaged/attached to the retaining portion 305 by any means suitable, including for example, using chemical bonding agents including adhesives, using mechanical fasteners including screws, welding and/or using thermal bonding (e.g., by melting) with or without a separate bonding agent such as low melting point polymer. In some examples, the portion 324 may be engaged with retaining portion 305 such that a watertight seal, or even an airtight seal, is created. This can advantageously prevent liquids from reaching cavity 214 and/or insulating portion 615 which may reduce the efficiency of insulating portion 615 and insulating container 100 in general.

In some embodiments, the insulating component 201 may include one or more gaskets 321, for example to form or improve a seal between cover portion 324 and retaining portion top surfaces 318, as shown in FIG. 3A or between cover portion 324 and retaining portion inner surfaces 316, as shown in FIG. 3B. In some embodiments, insulating component 201 may include one or more gaskets 321 engaged between retaining portion 305 and cover portion 324 at any abutting surfaces. Such configurations may reduce thermal conductivity between retaining portion 305 and cover portion 324 and may create a watertight, and possibly airtight, seal between retaining portion 305 and cover portion 324. In some embodiments, gaskets 321 may impart both functional and aesthetic enhancements, for example by being installed such that the seam between retaining portion 305 and cover portion 324 is concealed by the one or more gaskets 321. Additionally, in some embodiments fastening members used to fasten retaining portion 305 to cover portion 324 may be concealed by the one or more gaskets 321.

In some embodiments, portions of insulating component 201 including retaining portion 205, 305 and cover portion 224, 324 may optionally include one or more hollow portions. For example, possible hollow portions 351 in side walls 310 or bottom wall 312 of retaining portion 305 or in cover portion 324 are depicted using dashed lines in FIG. 3B. Elements of insulating component 201, including side walls 310 and/or bottom wall 312 of retaining portion 305 and/or cover portion 324 may have a thickness dimension T (or possibly a minimum thickness dimension T if the thickness is not constant) generally in the range of about 0.05 in. to about 0.25 in., with a representative thickness dimension T being about 0.15 inches. One or more hollow portions 351 may be configured to be, or may be, at least partially filled with an insulating material. Likewise, one or more, or all, cavities 214 may be configured to be, or may be, at least partially filled with an insulating material, in which case such insulating material is namely the insulating portion 615. In one example, the insulating material may comprise a polymeric foam, such as a polyurethane foam. However, in another example, additional or alternative insulating materials may be utilized to fill one or more hollow portions 351, or one or more cavities 214, without departing from the scope of the disclosures described herein. For example, one or more hollow portions 351 may be configured to be, or may be, at least partially filled with an alternative polymeric foam, such as polystyrene foam, polyvinyl chloride foam, or polyimide foam, among many others. As such, in one example, a polymer or polymer blend that is used to mold one or more, or all, elements of the insulating component 201, including side walls 310 and/or bottom wall 312 of retaining portion 305 and/or cover portion 324, may have a first thermal resistivity, and an insulating material used to at least partially fill one or more hollow portions 351 and/or one or more cavities 214 may have a second thermal resistivity, higher than the polymer or polymer blend. In yet another implementation, one or more hollow portions 351 and/or one or more cavities 214 may be configured to be, or may be, at least partially filled with a second insulating material that adheres to one or more molded polymeric surfaces of the hollow portion(s) and/or the cavity(ies). The second insulating material may also adhere the insulating material to these molded polymeric surfaces or may adhere the insulating material to itself (i.e., act as a binder for the insulating material). For example, a mix of polymer flakes, or pellets, in addition to a second insulating material that is namely a binder may be injected into one or more hollow portions 351, one or more cavities 214, or any combination thereof.

In one example, one or more hollow portions 351 and/or one or more cavities 214, or any combination thereof, may be partially filled with an insulating material as described above, such as an insulating foam (polyurethane foam). Partially filling the hollow portion(s) and/or cavity(ies) may refer to injecting, or otherwise providing, insulating foam such that the hollow portion(s) 351 and/or cavity(ies) 214 may be at least about 50% filled, at least about 80% filled, at least about 85% filled, at least about 90% filled, at least about 95% filled, at least about 97% filled, at least about 99% filled, at least about 99.7% filled, or at least about 99.9% filled, with the percentage filled meaning the total volume, in bulk form, of the insulating material and any second insulating material, divided by the volume of the hollow portion 351 or cavity 214.

In still other examples, insulating component 201, when used in conjunction with one of, some of, or all of, lid insulating structure 102 and base insulating structure 204, including side insulating structures 475 and bottom insulating structure 465, may forego the use of insulating portion 615, such that cavity 214 of insulating component 201, surrounded by retaining portion 205 and cover portion 224, is unfilled. In yet other examples, insulating component 201, when used in conjunction with one of, some of, or all of, lid insulating structure 102, side insulating structures 475, and bottom insulating structure 465, may use an insulating portion 615 that is a solid material (e.g., polymer or polymer blend), such that cavity 214 of insulating component 201 is filled with a solid material of the same or different composition relative to the surrounding by retaining portion 205 and cover portion 224. For example, in some embodiments lid insulating structure 102 may be formed of one material, and in other embodiments lid insulating structure 102 may be formed of two or more materials of varying density, such as in the case in which insulating portion 615 is formed of a polymer having a density that is lower than that of a polymer for forming the surrounding retaining portion 205 and cover portion 224. In general, material forming lid insulating structure 102 and base insulating structure 104 may have a higher density on outside surfaces and a lower density on the internal portions. In some examples, the material forming lid insulating structure 102 and base insulating structure 104 may be polyethylene having a varying density or the same density throughout.

Figure 4A:
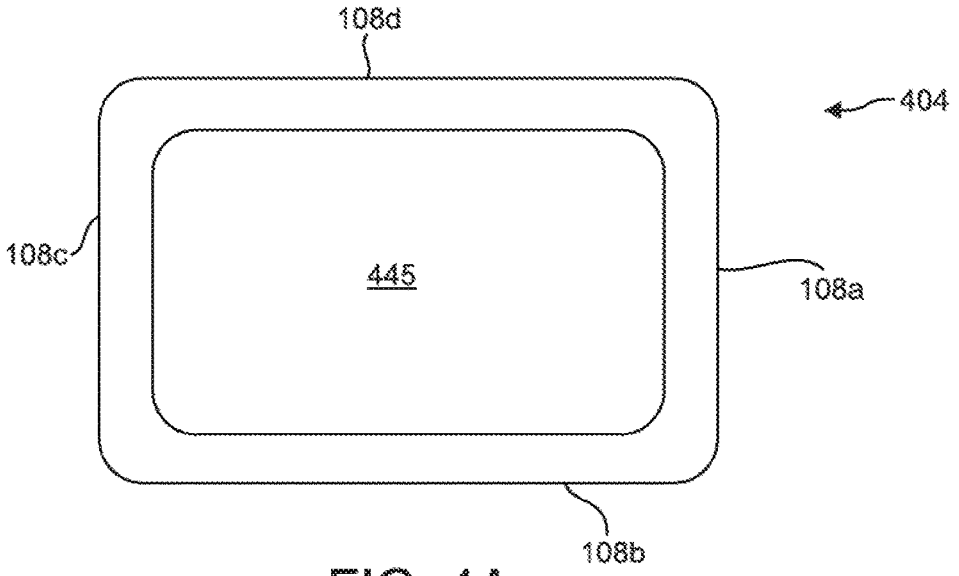
FIGS. 4A-4C schematically depict base insulating structures, according to one or more aspects described herein.
Figures 4B, 4C:
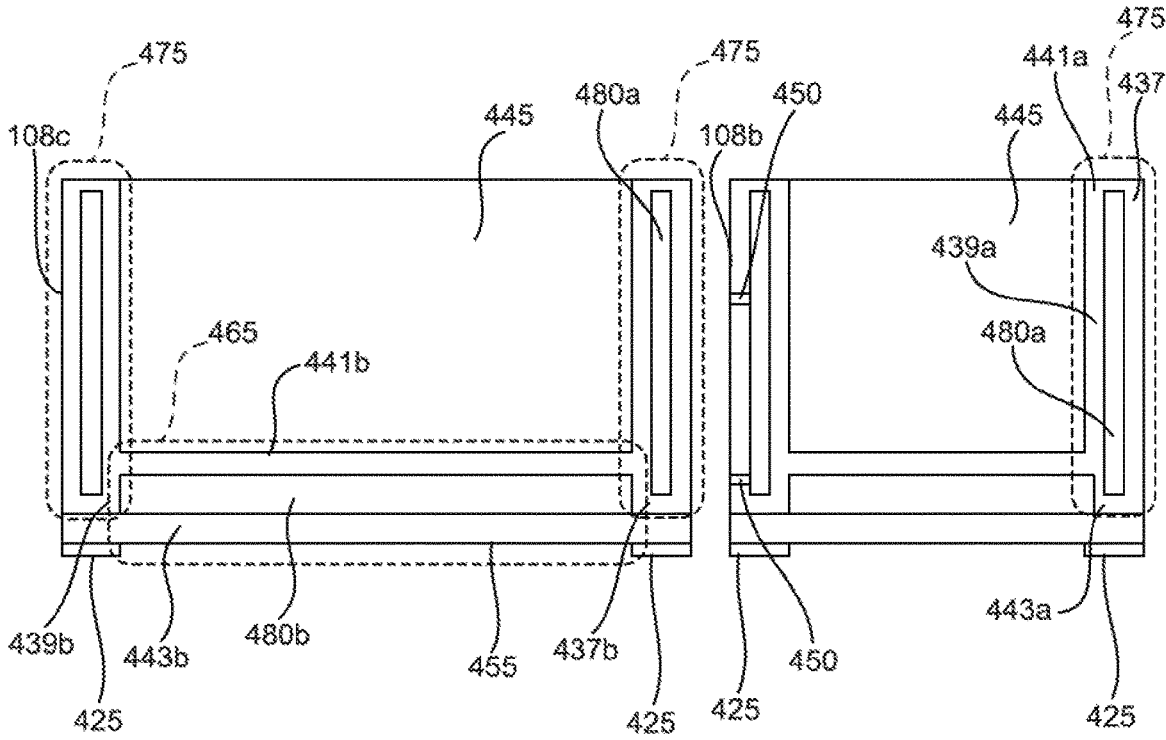

FIGS. 4A-4C schematically depict base insulating structure 404 that may be utilized with the systems and methods described herein for achieving improved thermal resistance of insulating container 100. Base insulating structure 404 and the lid insulating structure 102 cooperate to enclose storage compartment 445 and these structures may be manufactured of similar materials. In one example, base insulating structure 404 may correspond to base insulating structure 104 of insulating container 100 depicted in FIG. 1. Accordingly, in one example, FIG. 4A schematically depicts a top view of base structure 404, FIG. 4B schematically depicts a cross-sectional front elevation view of insulating base structure 404, and FIG. 4C schematically depicts a cross-sectional end elevation view of base structure 404. In one example, the base insulating structures schematically depicted in FIGS. 4A-4C may be formed from one or more molded polymers, and may include storage compartment 445, which may be referred to as an inner trough structure. Inner trough structure 445 may be surrounded by (e.g., bounded at is periphery, for example on four sides) by side insulating structure(s) 475, having outer surface(s) corresponding to side outer faces 108*a*, 108*b*, 108*c*, and 108*d* of FIG. 1. A single side insulating structure 475 may include a single element, such as an insulating component 201 (see FIG. 2A), with or without insulating portion 615, extending continuously about the periphery of inner trough structure 445. Multiple side insulating structures 475 may include different, or additional elements, such as an enclosed space 480*a*, as better depicted in FIGS. 4B and 4C. In the case of multiple side insulating structures, these may extend about discreet sections (e.g., sides) of the periphery of inner trough structure 445. For example, two side insulating structures 475, having insulating components 201 with respective cavities 214 that are filled with granulated foam polymer may have outer surfaces corresponding to some or all of opposite side outer faces 108*a*, 108*c*, whereas two side insulating structures 475 having enclosed spaces 480*a* may have outer surfaces corresponding to some or all of opposite side outer faces 108*b*, 108*d*. According to the embodiment of FIGS. 4B and 4C, side insulating structure 475 may include outer wall 437*a* with its outer surface corresponding to all or a portion of one or more of side outer faces 108*a*, 108*b*, 108*c*, and 108*d* of FIG. 1. Outer wall 437*a* of side insulating structure 475 may cooperate with opposing inner wall 439*a*, as well as opposing top and bottom walls 441*a*, 443*a*, to form an internal cavity or enclosed space 480*a*. Although enclosed space 480*a* is shown as having a rectangular geometry, those skilled in the art with the knowledge of the present disclosure will appreciate that other geometries are possible, including rounded (e.g. oval) geometry, as dictated by the geometries of walls 437*a*, 439*a*, 441*a*, and 443*a*. Also, whereas four discreet walls are depicted in FIGS. 4B, 4C, enclosed space 480*a* may likewise be formed from a single continuous (e.g., curved), surrounding wall or any number of discreet walls. In some embodiments, walls 437*a*, 439*a*, 441*a*, and 443*a* may have wall thicknesses, or possibly minimal wall thicknesses (if not constant) generally in the range of about 0.05 in. to about 0.25 in., with a representative thickness being about 0.15 inches. In some examples, enclosed space 480*a* may surround inner trough structure 445 on four sides of its periphery, for example in the case of side insulating structure 475 having respective outer surfaces corresponding to side outer faces 108*a*, 108*b*, 108*c*, and 108*d* of FIG. 1. One or more side insulating structures 475 may include enclosed space(s) that are optionally filled or at least partially filled with insulating material as described above with respect to hollow portions 351 and/or cavities 214. One or more side insulating structure(s) 475, rather than having enclosed space 480*a* as shown in the embodiments of FIGS. 4B and 4C, may instead be used in conjunction with insulating component(s) 201 and their respective cavity/cavities 214, as described above. In one implementation of side insulating structure 475, enclosed space 480*a* may be only substantially enclosed and include one or more openings 450, which may be resealable or closeable, through which insulating material, as described above, may be inserted. In other examples, one or more enclosed spaces may be formed in other parts of insulating base structure 404, including for example in the top wall 441*b* between the enclosed space 480*b* of bottom insulating structure 465 and the inner trough structure 445.

Similar to the description above with respect to side insulating structure 475, bottom insulating structure 465 may likewise include an element, such as an insulating component 201 (see FIG. 2A), with or without insulating portion 615, or an enclosed space 480*b* formed from opposing top and bottom walls 441*b*, 443*b*, in cooperation with opposing side walls 437*b*, 439*b*, as depicted in FIGS. 4B and 4C. According to the embodiment of FIGS. 4B and 4C, an outer surface of bottom wall 443*b* of bottom insulating structure 465 may correspond to all or a portion of bottom outer face 455 of insulating container 100. As is also apparent from FIGS. 4B and 4C, walls of side insulating structure 475 may connect to, or otherwise share common portions with, walls of bottom insulating structure 465.

In one example, bottom insulating structure 465 rather than having enclosed space 480*b* as shown in the embodiments of FIGS. 4B and 4C, may instead be used in conjunction with insulating component(s) 201 and their respective cavity/cavities 214 as described above. A cavity 214, surrounded by retaining portion 205 and cover portion 224, may have insulating portion 615 disposed therein. In this case, cover portion 224 in the embodiment of FIG. 2A may correspond to bottom wall 443*b* in the embodiment of FIG. 4B. Insulating portion 615 may be sized to fill all or a portion of cavity 214 and be secured therein by bottom wall 443*b* or other cover portion 224. As discussed in more detail below, insulating portion 615 may comprise one or more a vacuum insulated panels 625.

In embodiments in which bottom insulating structure 465 is used in conjunction with insulating component 201, cover portion 224 may be placed over the insulating portion 615 and may secure the insulating portion 615 within cavity 214. Insulating portion 615 may also be secured within cavity 214 using, as an alternative to, or in addition to, cover portion 224, adhesives, tape, or other devices. Cover portion 224 may include at least a portion of bottom wall 443*b* of base insulating structure 404. In other embodiments, cover portion 224 may engage an inside surface of cavity 214.

Cover portion 224 may be fastened to base insulating structure 404 by any means suitable, including for example, using chemical bonding agents including adhesives, using mechanical fasteners including screws, and/or using thermal bonding (e.g. melting or welding), with or without a separate bonding agent such as low melting point polymer. In some examples, fasteners may be concealed by feet 425. In some examples, cover portion 224 may be engaged with the base insulating structure 404 such that a watertight seal is created. This can advantageously prevent liquids from reaching cavity 214 and/or insulating portion 615 which may reduce the efficiency of insulating portion 615 and insulating container 100 in general.

Cover portion 224 of insulating component 201, in the case of bottom insulating structure 465 being used in conjunction with insulating component 201, may be manufactured of any suitable material. In some examples the cover portion 224 may be manufactured of metals such as stainless steel, plastics, and composites including, for example, carbon fiber. As described above, in some examples cover portion 224 and retaining portion 205 of insulating component 201 may be molded, for example through rotomolding, as a single piece and in other examples cover portion 224 and retaining portion 205 of insulating component 201 may be molded as separate pieces. In some examples, insulating portion 615 may be included within the cavity 214 of insulating component during the molding, for example rotomolding, process. In still other examples, cover portion 224 and other elements may be molded as a single piece without insulating portion 615 included within the cavity 214. In such a process cover portion 224 may be removed, for example, by cutting. Cover portion 224, followed by re-engagement with retaining portion 205.

Similar to the lid insulating structure 102 described above, base insulating structure 404 may be formed from a molded polymer. The molded polymer may offer a comparatively lower thermal conductivity than other structural materials (e.g. metals or alloys). As such, this comparatively lower thermal conductivity may be desirable in order to reduce a rate of heat transfer to or from the inner trough structure 445 from/to an outside environment. Additionally, as described above, the insulating container 100 may comprise one or more voids, or cavities, configured to be filled with one or more additional insulating materials. In one example, internal cavity such as enclosed space 480*a*, 480*b* may be, or configured to be, filled with an additional insulating material. This additional insulating material may exhibit higher thermal resistivity properties than the polymer used to mold the structural elements (e.g., walls 437*a*, 439*a*, 441*a*, and 443*a*) of the insulating container 100. In this way, a material that exhibits higher thermal resistivity, but may be unsuitable for construction of structural elements due to less favorable mechanical properties (e.g. comparatively lower mechanical strength and rigidity than a molded polymer) may be utilized in conjunction with the molded polymer used to construct the structural elements of insulating container 100. The resulting structure of an insulating device, such as container 100, may be a compound, or composite, having a combination of high mechanical strength and rigidity and high thermal resistivity.

In one example, an internal cavity such as enclosed space 480*a* may comprise multiple sub-cavities separated by one or more by internal structures (e.g. ribs, baffles, flanges, or other structural elements). An internal cavity may comprise multiple discrete cavities. In one implementation, multiple discrete cavities represented by an internal cavity such as enclosed space 480*a* or cavity 214 of insulation component 201 may be connected to one another by smaller openings. In another example, an internal cavity may be one continuous cavity.

In one specific example, base insulating structure 104 and/or the lid insulating structure 102 may be formed from polyethylene. In another implementation, the systems and methods described herein may be utilized with additional or alternative polymers. For example, the insulating container 100 as a whole, and/or either or both of the base insulating structure 104 and lid insulating structure 102 may utilize polytetrafluoroethylene, polymethylmethacrylate, polypropylene, polyvinyl chloride, polyethylene terephthalate, polystyrene, polycarbonate, polyurethane, and/or blends comprising or consisting of any two or more of these. Further, an internal cavity, as described herein, may be, or may be configured to be, filled with an insulating material. In one example, the insulating material may comprise a polymeric foam, such as a polyurethane foam. However, in another example, additional or alternative insulating materials may be utilized to fill, and adhere to one or more surfaces of an internal cavity, without departing from the scope of the disclosures described herein. The internal cavity may be, or may be configured to be, filled with polystyrene foam, polyvinyl chloride foam, or polyimide foam, among many others. As such, in one example, a polymer or polymer blend used to mold the various structural elements of the insulating container 100, and/or either or both of the base insulating structure 104 and lid insulating structure 102, may have a first thermal resistivity, and an additional insulating material used to fill an internal cavity may have a second thermal resistivity, higher than that of the molded polymer or polymer blend. In yet another implementation, an internal cavity may be filled with a second insulating material that adheres to one or more molded polymeric surfaces of the internal cavity. The second insulating material may also adhere the insulating material to these molded polymeric surfaces or may adhere the insulating material to itself (i.e., act as a binder for the insulating material. For example, a mix of polymer flakes, or pellets, in addition to a second insulating material that is namely a binder may be injected into, or otherwise provided to, an internal cavity.

In one example, an internal cavity such as enclosed space 480*a*, 480*b* may be partially filled with an insulating material as described above, such as an insulating foam (polyurethane foam). Partially filling an internal cavity may refer to injecting, or otherwise providing, insulating foam such that an internal cavity may be at least about 50% filled, at least about 80% filled, at least about 85% filled, at least about 90% filled, at least about 95% filled, at least about 97% filled, at least about 99% filled, at least about 99.7% filled, or at least about 99.9% filled, with the percentage filled meaning the total volume, in bulk form, of the insulating material and any second insulation material, divided by the volume of the internal cavity.

In one implementation, specific thermal properties of the insulating container 100 and/or insulating lid structure 102 and/or insulating base structure 104 will depend upon specific dimensions and corresponding surface areas, as well as upon the thicknesses of the molded polymeric structures (e.g. thicknesses of walls 437*a*, 439*a*, 441*a*, 443*a*, 437*b*, 439*b*, 441*b*, 443*b* of base insulating structure 404), as well as the dimensions, including thicknesses of one or more cavities 214, hollow portions 351, enclosed spaces 480*a,b* and/or other internal cavities. Such dimensions affect volumes and hence the amount of insulating material that may be contained therein.

In one implementation, the insulating container 100 and/or the insulating lid structure 102 and/or the insulating base structure 104 may be manufactured using one or more rotational molding processes for molding a polymer. As such, those of ordinary skill in the art will recognize various details of a rotational molding processes that may be utilized with the systems and methods described herein without departing from the scope of the disclosures described herein. In another example, the insulating container 100 and/or the insulating lid structure 102 and/or the insulating base structure 104 may be manufactured using one or more additional or alternative molding processes. The insulating container 100 may be molded from one or more polymers using an injection molding process, among others. Furthermore, the insulating container 100 and/or the insulating lid structure 102 and/or the insulating base structure 104 may be further processed using one or more additional manufacturing processes, including, among others, drilling and deburring, cutting, and sanding, without departing from the scope of the disclosures described herein. As depicted in FIGS. 4A-4C, the insulating base structure 404 may be embodied with a substantially cuboidal shape. However, in other implementations, the insulating base structure 404 may be embodied with additional or alternative geometries (e.g. circular, prismoidal, among others), without departing from the scope of these disclosures.

As described above, the insulating portion 615 of an insulating component 201 may comprise one or more vacuum insulated panels 625. Likewise, a hollow portion 351, an enclosed space 480*a,b*, or other internal cavity as described herein may contain a vacuum insulated panel 625. Vacuum insulated panels as described herein generally comprise a substantially gas-tight enclosure surrounding a rigid core, from which air has been substantially evacuated. The enclosure may comprise membrane walls, which surround a rigid, highly-porous material, such as fumed silica, aerogel, perlite or glass fiber. Vacuum insulated panels may be composed of any other materials commonly known in the industry.

In some embodiments, the one or more vacuum insulated panels may have a thickness of about 0.065 inches or in the range of about 0.03 inches to about 0.1 inches; may have a density (as tested under ASTM D 1622-93) of about 16 lb/ft$^3$ or in the range of about 10 lb/ft$^3$ to about 20 lb/ft$^3$; may have a thermal conductivity (as tested under ASTM C518-93) of about 0.020 BTU-in/ft$^2$-hr-° F. or in the range of about 0.010 BTU-in/ft$^2$-hr-° F. to about 0.030 BTU-in/ft$^2$-hr-° F.; and may have a specific heat of about 0.2 BTU/lb ° F. or in the range of about 0.1 BTU/lb ° F. to about 0.3 BTU/lb ° F.

Vacuum insulated panels 625 used, for example, as insulating portion 615, hollow portion 351, enclosed space 480*a,b*, or other internal cavity can have any number of different configurations and sizes, including all the configurations and sizes depicted in FIGS. 5A-5H with respect to their use in insulating portion 615. As shown, for example, in FIG. 5A the insulating portion 615 can comprise a single vacuum insulated panel 625.

Figure 5A:
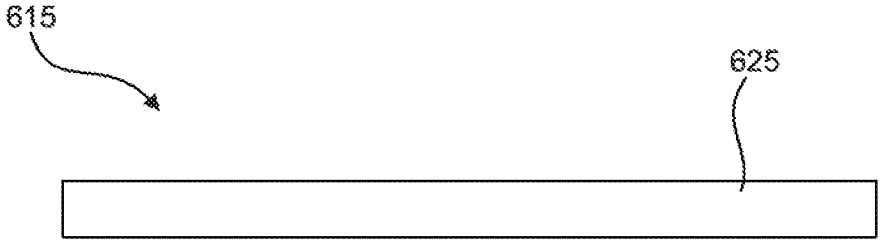
FIGS. 5A-5H schematically depict insulating portions comprising one or more vacuum insulated panels according to one or more aspects described herein.
Figure 5B:
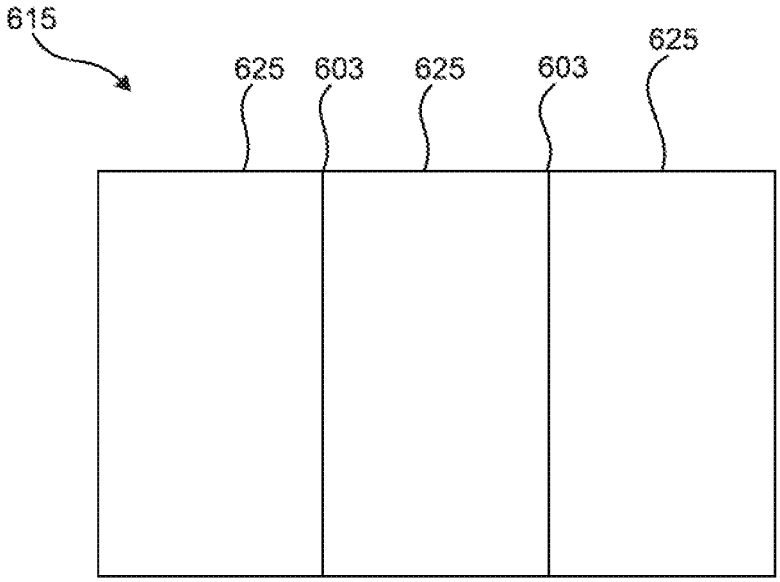

In embodiments, as shown in FIG. 5B, insulating portion 615 can comprise multiple separate vacuum insulated panels 625 engaged together and forming seams 603 between the separate panels 625. Advantageously, in such a configuration, if one panel 625 fails, the remaining panels 625 may still provide increased thermal resistance.

In still other embodiments as shown in FIGS. 5C-5H the insulating portion 615 can comprise multiple separate vacuum insulated panels 625 having multiple layers of vacuum insulated panels. Similarly as discussed above, in such a configuration if one panel 625 fails, the remaining panels 625 may still provide increased thermal resistance.

Figure 5C:
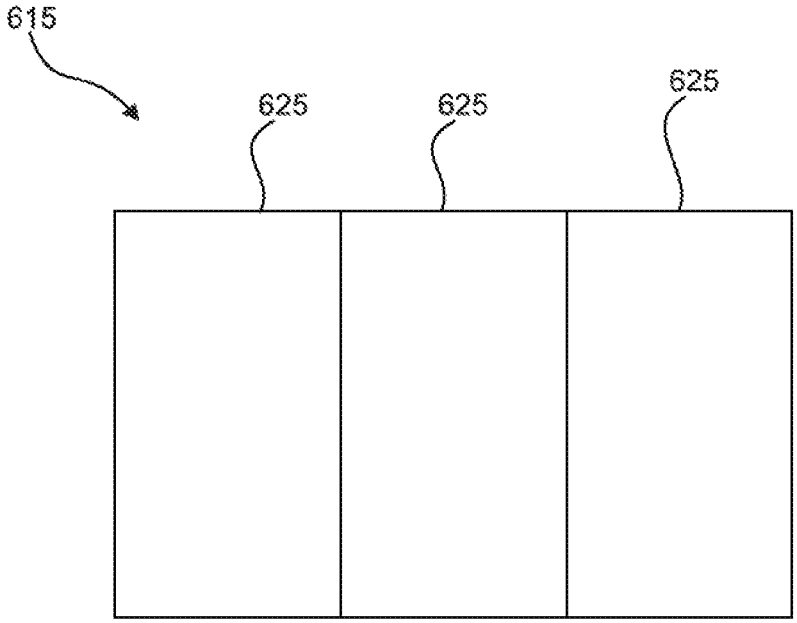
Figure 5D:
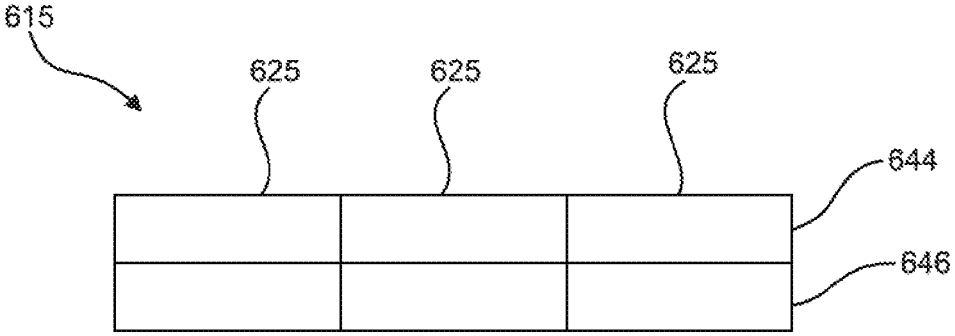

FIGS. 5C and 5D depict six vacuum insulated panels 625 configured in two layers 644, and 646 each have three panels 625 side by side. Although only six panels 625 are shown more panels 625 may be used and insulating portions 615 may be constructed using more than two layers of panels 625. In some embodiments, for example, three or more layers of panels may be used. Similarly as discussed above, in such a configuration if one panel 625 fails, the remaining panels 625 may still provide increased thermal resistance.

Figure 5E:
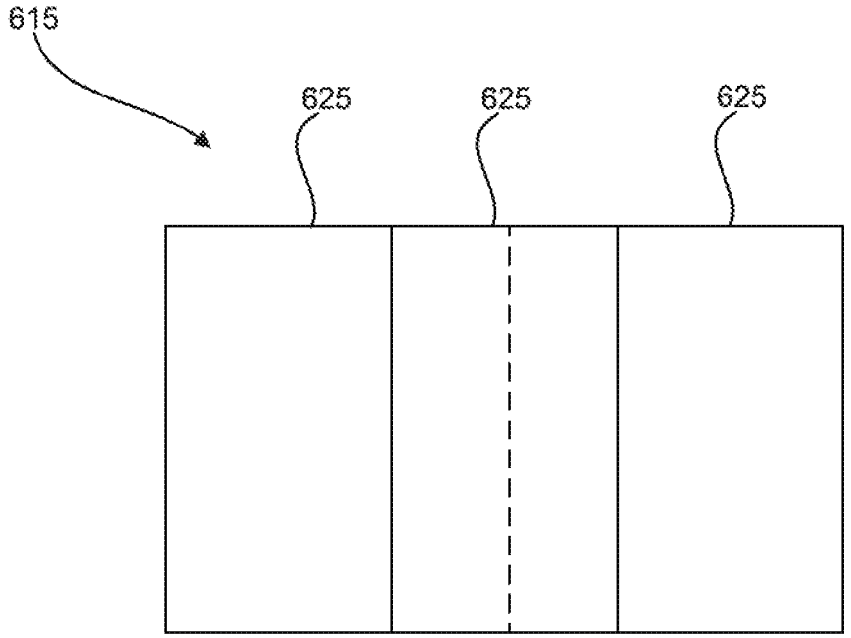
Figure 5F:
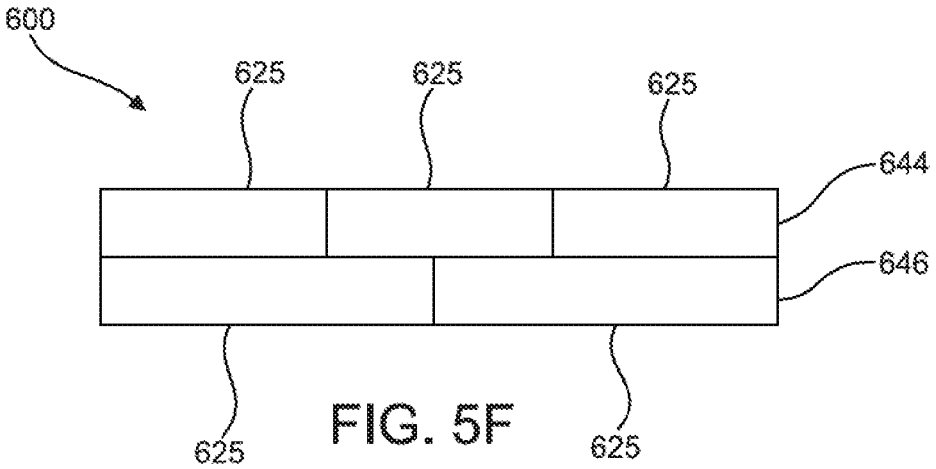

FIGS. 5E and 5F depict another alternative configuration of the insulating portion 615 comprising five vacuum insulated panels 625 having a first layer 644 with three vacuum panels 625 side by side and second layer 646 with two vacuum panels side by side. In some embodiments, as shown in FIGS. 5E and 5F the vacuum panels 625 may be arranged such that seams between vacuum panels of first layer 644 do not contact seams between vacuum panels of second layer 646.

Figure 5G:
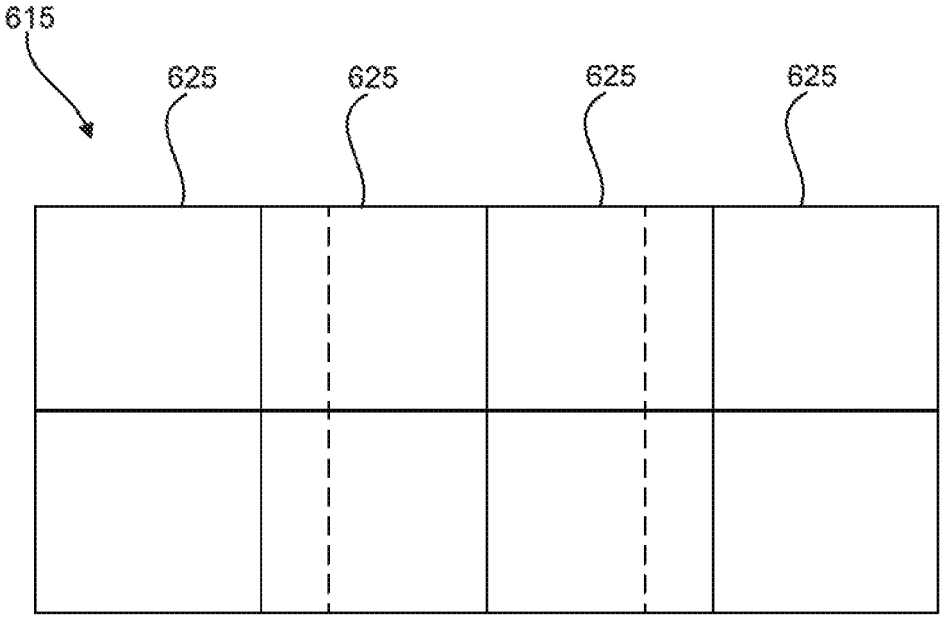
Figure 5H:
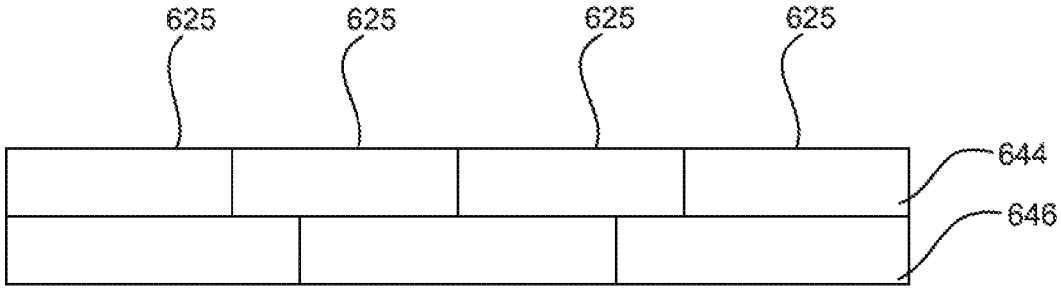

In still other embodiments as shown in, for example, FIGS. 5G and 5H, the vacuum insulated panels 625 forming insulating portion 615 can have other configurations. As shown in FIGS. 5G and 5H the vacuum insulated panels of a first layer 644 may be arranged such that seams of a the first layer 644 do not touch parallel seams of a second layer 646.

Figure 6:
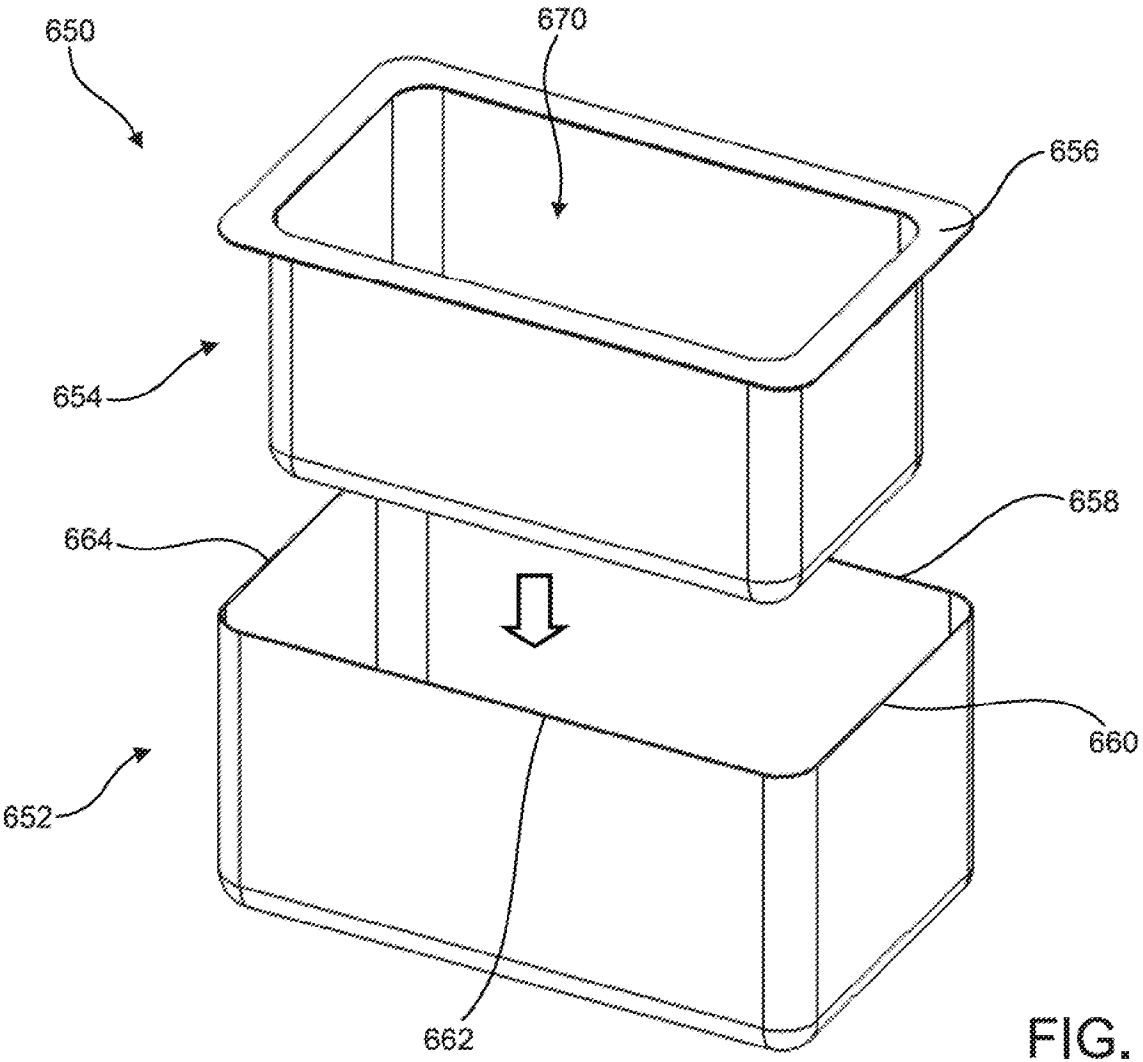
FIG. 6 schematically depicts an exploded isometric view of a base insulating structure of an insulating container, according to one or more aspects described herein.
Figure 7A:
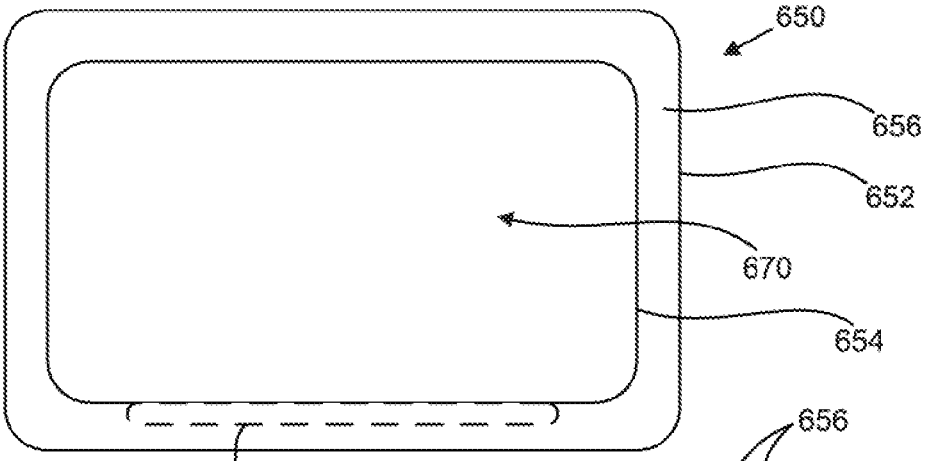
FIGS. 7A-7D schematically depict third angle orthographic projection views of a base insulating structure, according to one or more aspects described herein.
Figure 7B:
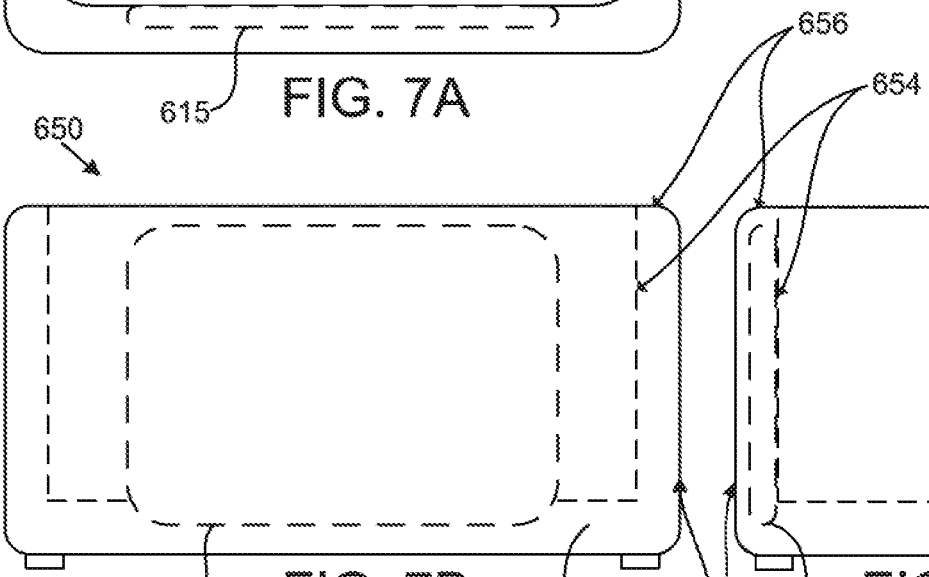
Figure 7D:
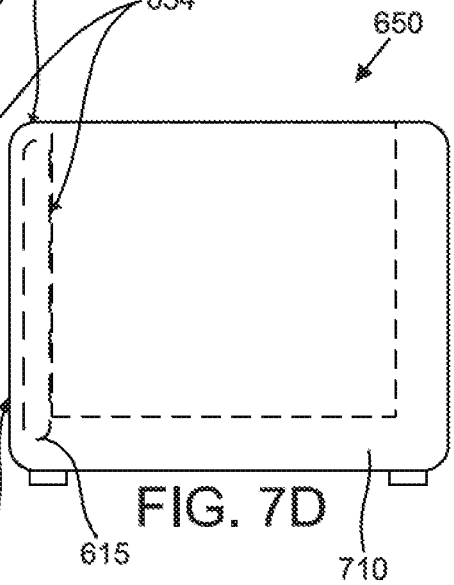
Figure 7C:
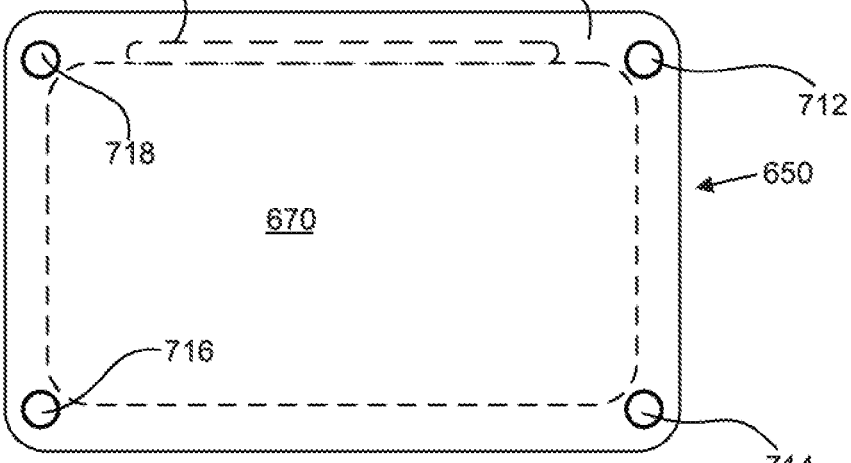

FIG. 6 schematically depicts an exploded isometric view of a base insulating structure 650 of an insulating container, similar to insulating container 100, according to one or more aspects described herein. In one example, the insulating structure 650 may be similar to the base insulating structure 104, and include one or more elements similar to those described in relation to the base insulating structure 104. In one implementation, and as schematically depicted in FIG. 6, the base insulating structure 650 may be constructed from two primary elements, including an outer shell 652, and an inner wall structure 654. The outer shell 652 may be constructed using one or more sheet metal deep-drawing and/or stamping processes, and using, in one example, a stainless steel material. It is contemplated, however, that the outer shell 652 may be constructed from one or more additional or alternative metals, alloys, polymers or composite materials, and constructed using one or more deep drawing or molding processes. Similarly, the inner wall structure 654 may be constructed using one or more sheet metal deep-drawing and/or stamping processes, and from one or more same or different materials to the outer shell 652. As such, the inner wall structure 654 may be constructed using a stainless steel material. However, it is contemplated that the base insulating structure 650 may be constructed using one or more additional or alternative metals and/or alloys, one or more fiber-reinforced materials, one or more polymers, or one or more ceramics, or combinations thereof, among others, without departing from the scope of these disclosures. In one example, the one or more deep drawing, stamping, and/or molding processes utilized to produce the geometry of the inner wall structure 654 may also form a flange surface 656.

In one example, the inner wall structure 654 of the base insulating structure 650 may be rigidly coupled to the outer shell 652 by one or more coupling processes that are configured to couple the flange surface 656 to one or more of the edges 658, 660, 662, and/or 664. In one specific example, the inner wall structure 654 may be secured to the outer shell 652 by one or more welding or brazing processes, including, among others, shielded metal arc, gas tungsten arc, gas metal arc, flux-cored arc, submerged arc, electroslag, ultrasonic, cold pressure, electromagnetic pulse, laser beam, or friction welding processes. In another example, the outer shell 652 may be rigidly coupled to the inner wall structure 654 by one or more adhesives, by a sheet metal hem joint, or by one or more fastener elements (e.g. one or more screws, rivets, pins, bolts, or staples, among others). In yet another example, the outer shell 652 may be coupled to the inner wall structure 654 by one or more processes configured to couple two polymeric structures together, including ultrasonic welding, among others.

As depicted in FIG. 6, the inner wall structure 654 includes a cavity 670, that, when the base insulating structure 650 is coupled (hingedly, removably, or otherwise) to the lid insulating structure, such as lid insulating structure 102, forms an internal storage compartment. Additionally, when coupled to one another, the outer shell 652 and the inner wall structure 654 form a cavity therebetween, as schematically depicted as cavity 710 in FIGS. 7A-7D.

FIGS. 7A-7D schematically depict a plan view, front elevation view, bottom view, and an end elevation view, respectively, of the base insulating structure 650, according to one or more aspects described herein. As schematically depicted in FIGS. 7A-7D, a cavity 710 is formed between the outer shell 652 and the inner wall structure 654. Further, the base insulating structure 650 may include four feet elements 712, 714, 716, and 718 configured to support the structure 650 on a surface.

Figure 8:
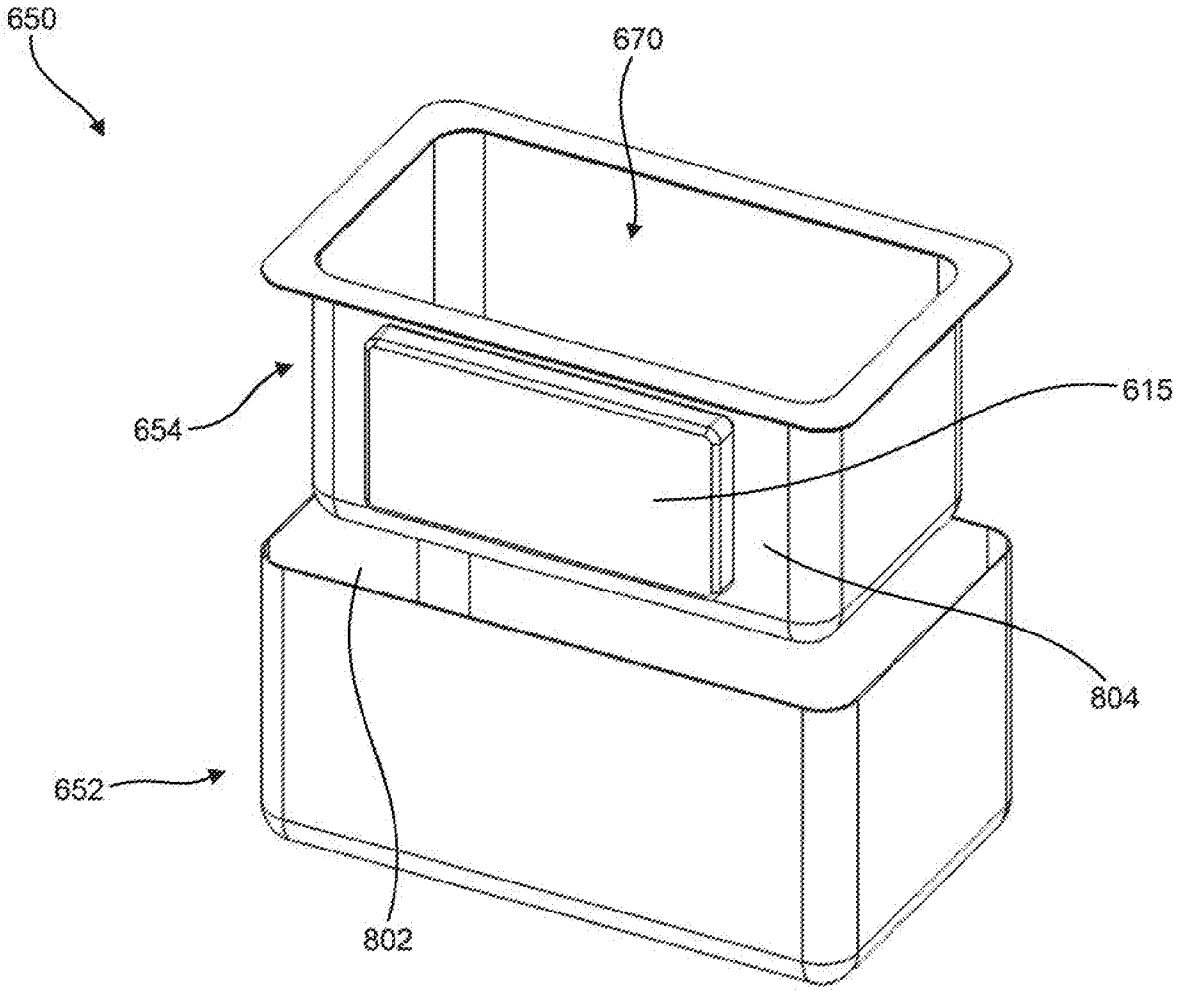
FIG. 8 schematically depicts an exploded isometric view of a base insulating structure that has an insulating portion, according to one or more aspects described herein.

Additionally, the base insulating structure 650 may include an insulating portion 615 positioned within the cavity 710. FIG. 8 schematically depicts an exploded isometric view of the base insulating structure 650 having an insulating portion 615 coupled to an internal surface 804 of the inner wall structure 654, according to one or more aspects described herein. It is contemplated that the insulating portion 615 may be coupled to the internal surface 804 by any coupling means, including one or more adhesives, or mechanical fasteners, among others. Alternatively, it is contemplated that the insulating portion 615 may be coupled to an internal surface of the outer shell 652, e.g. internal surface 802, without departing from the scope of these disclosures. Additionally, while a single insulating portion 615 is depicted in FIG. 8, it is contemplated that multiple insulating portions 615 may be integrated into the insulating structure 650, and may partially or wholly cover the internal surface 804, in addition to one or more additional internal surfaces of the inner wall structure 654, without departing from the scope of these disclosures.

In one example, the one or more insulating portion 615 may partially or wholly fill the cavity 710 between the outer shell 652 and the inner wall structure 654. In one implementation, the cavity 710 may be partially filled with an insulating foam, such as one or more of the insulating foams previously described. Accordingly, the base insulating structure 650 may be constructed by positioning and insulating portion 615 in the cavity 710 prior to the outer shell 652 being rigidly coupled to the inner wall structure 654. For example, the insulating portion 615 may be loosely positioned within the cavity 710, or introduced into the cavity 710 by being adhered to the internal surface 804. Subsequently, following one or more processes configured to couple the outer shell 652 to the inner wall structure 654, an insulating foam may be introduced into the cavity 710 to partially or wholly fill an unfilled volume of the cavity 710. In one example, the insulating foam may be introduced into the cavity 710 through one or more openings in the bottom surface of the base insulating structure 650, with said one or more openings sealed by one or more of the depicted feet elements 712-718.

Figure 9:
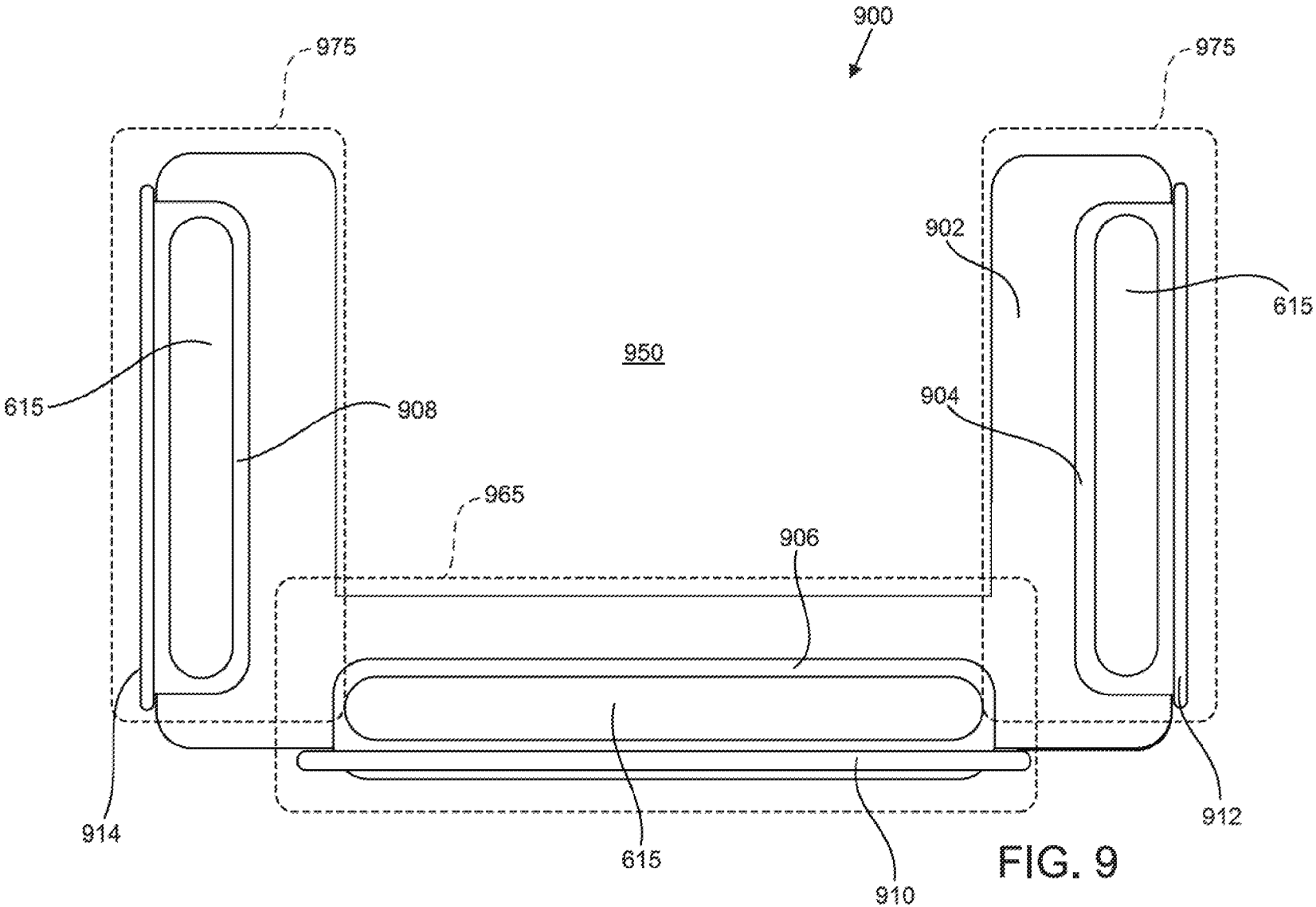
FIG. 9 schematically depicts a cross-sectional front elevation view of an implementation of a base insulating structure, according to one or more aspects described herein.

FIG. 9 schematically depicts a cross-sectional front elevation view of another implementation of a base insulating structure 900, according to one or more aspects described herein. In one example, the base insulating structure 900 may be similar to the base insulating structure 104, and constructed using one or more materials and/or processes described in relation to base insulating structure 104. In one implementation, the base insulating structure 900 includes side insulating structures 975 and a bottom insulating structure 965 that form an inner trough structure/internal storage compartment 950, and that is used as an internal storage compartment when the base insulating structure 900 is coupled to a lid structure, such as lid insulating structure 102. Accordingly, the bottom insulating structure 965 and side insulating structures 975 may comprise an insulated wall structure 902 that may be constructed from one or more insulating materials similar to those described throughout these disclosures. In one specific example, the insulating wall structure 902 may comprise one or more polymers, such as polyethylene or polycarbonate, or any other polymer, described in these disclosures. Additionally or alternatively, the insulated wall structure 902 may comprise one or more metals, alloys, or composite materials.

As depicted in FIG. 9, the insulated wall structure 902 may connect to, or otherwise share common portions with, the bottom insulating structure 965 and the side insulating structures 975. In one example, the bottom insulating structure 965 and the side insulating structures 975 may be similar to the insulating component 201, and such that a portion of the insulated wall structure 902 is similar to the retaining portion 205. Additionally, the bottom insulating structure 965 and the side insulating structures 975 may include cavities 904, 906, and 908 that may be similar to cavity 214 described in relation to the retaining portion 205. Further, the base insulating structure 900 may include cover portions 910, 912, and 914, which may be similar to cover portion 224, as previously described. As such, the bottom insulating structure 965 and the side insulating structures 975 may be configured to receive insulating portions 615 into the respective cavities 904, 906, and 908.

In one implementation, the cover portions 910, 912, and 914 may be rigidly coupled to the bottom insulating structure 965 and the side insulating structures 975 to retain the insulating portions 615 within the cavities 904, 906, 908. As such, it is contemplated that any coupling means may be utilized to rigidly couple the cover portions 910, 912, and 914 to the structures 965 and 975, including, among others, one or more mechanical fasteners, adhesives, or welding processes. Further, it is contemplated that the coupling between the cover portions 910, 912, and 914 and the structures 965 and 975 may be water and airtight.

In one example, the insulating portion 615 may fill the respective cavities 904, 906, and 908. In another example, a mass of additional insulating material, such as an insulating foam may be introduced into one or more of the cavities 904, 906, and 908 to partially or wholly fill a volume unfilled by the insulating portions 615.

It is contemplated that the insulating wall structure 902 of the base insulating structure 900 may be constructed using any combination of forming processes and materials described in these disclosures, including, among others, rotational molding, injection molding, blow molding, or deep forming, among others. Further, it is contemplated that the insulating wall structure 902 may include additional structural elements, such as one or more cavities, or one or more additional layers of materials to those schematically depicted in FIG. 9.

As depicted in FIG. 9, the cover portions 910, 912, and 914 form one or more external walls of the base insulating structure 900. In another implementation, one or more insulating portions 615 may be positioned within an insulating wall structure, similar to insulating wall structure 902, by accessing cavities configured to receive the insulating portion 615 from within an internal storage compartment, similar to internal storage compartment 950. As such, FIG. 10 schematically depicts a cross-sectional front elevation view of another implementation of a base insulating structure 1000, according to one or more aspects described herein.

Figure 10:
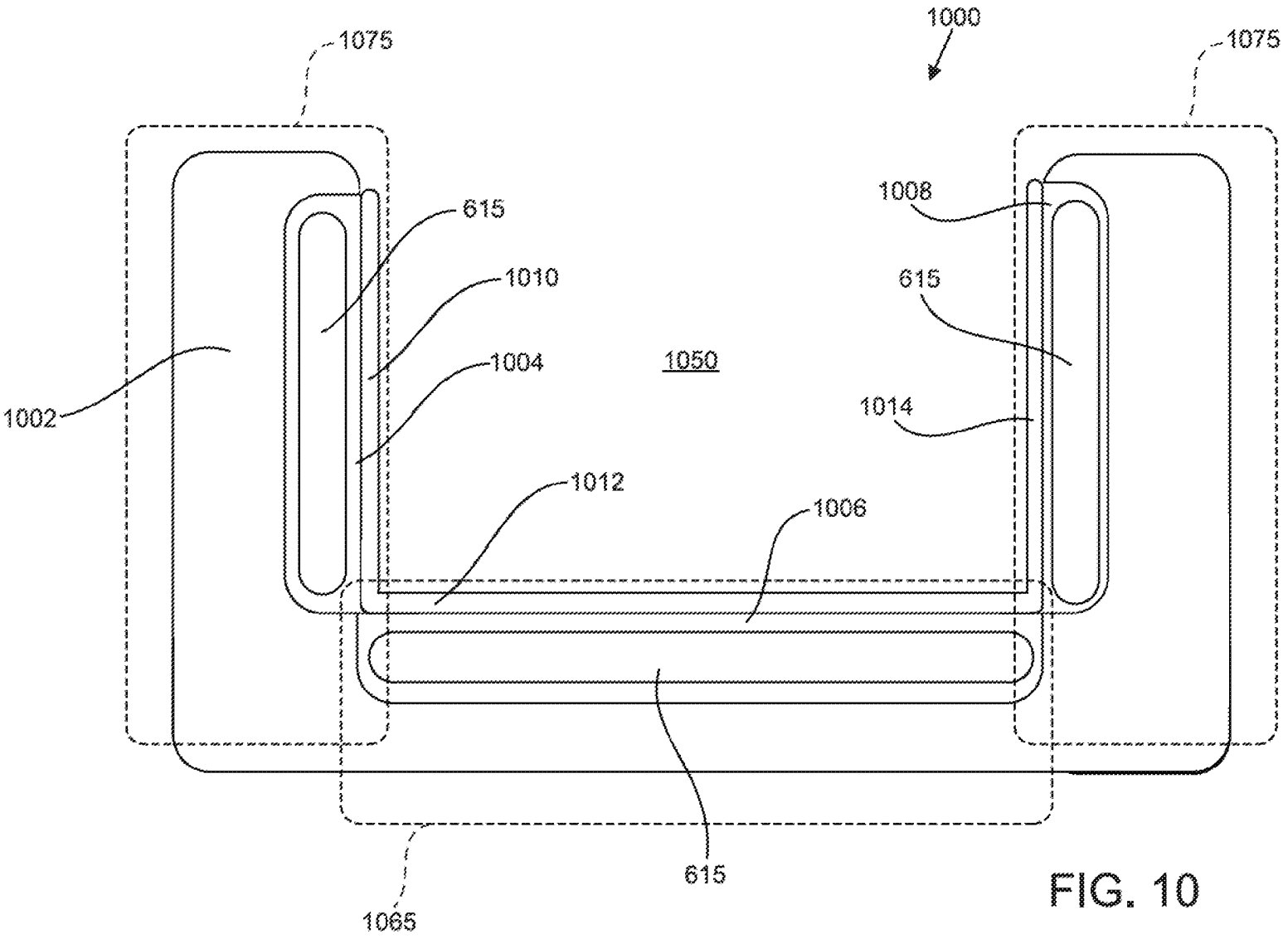
FIG. 10 schematically depicts another cross-sectional front elevation view of an implementation of a base insulating structure, according to one or more aspects described herein.

As depicted in FIG. 10, the base insulating structure 1000 may be similar to the base insulating structure 900 described in relation to FIG. 9. As such, the base insulating structure 1000 includes a bottom insulating structure 1065 that is similar to the bottom insulating structure 965, and side insulating structures 1075 that are similar to the side insulating structures 975. Further, the insulating wall structure 1002 may be similar to the insulating wall structure 902, and the cavities 1004, 1006, and 1008 may be similar to cavities 904, 906, 908. As such, the insulating wall structure 1002 may be similar to the retaining portion 205 described in relation to the insulating component 201. However, in the depicted implementation of FIG. 10, the insulating portions 615 are received into cavities 1004, 1006, and 1008 through openings in the internal storage compartment 1050, which are enclosed by cover portions 1010, 1012, and 1014. In one implementation, the cover portions 1010, 1012, and 1014 may form inner walls of the internal storage compartment 1050. Additionally, it is contemplated that the cover portions 1010, 1012, and 1014 may be formed as a single contiguous liner element, or as separate elements. It is further contemplated that the cover portions 1010, 1012, and 1014 may be coupled to the insulating wall structure 1002 by any suitable coupling means, such as those means described in relation to the cover portions 910, 912, and 914, among others.

Figure 11B:
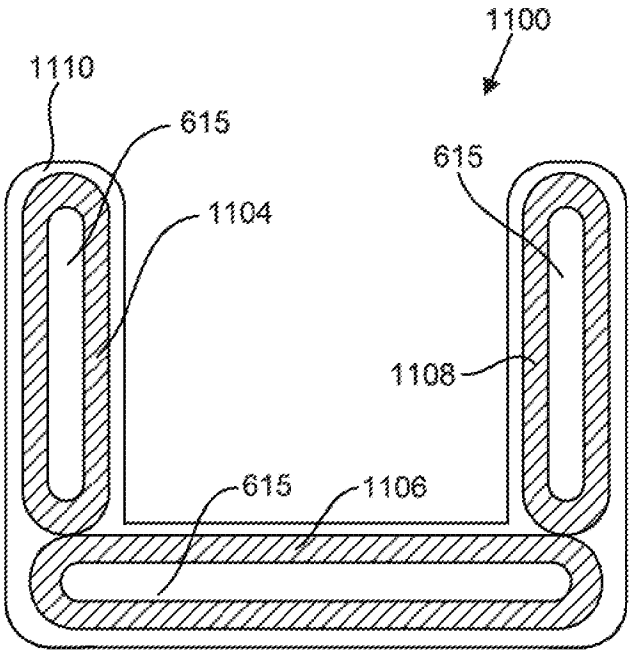
FIGS. 11A-11B schematically depict cross-sectional views of another implementation of a base insulating structure, according to one or more aspects described herein.
Figure 11A:
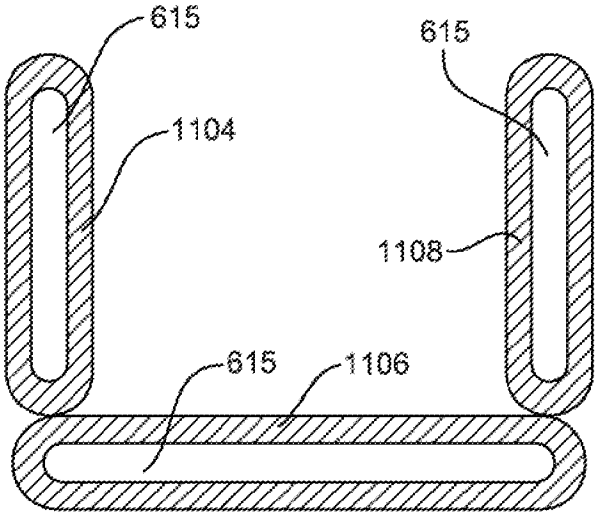

FIGS. 11A-11B schematically depict cross-sectional views of another implementation of a base insulating structure 1100, according to one or more aspects described herein. In particular, FIG. 11A schematically depicts a first stage of a manufacturing process of the base insulating structure 1100, and FIG. 11B schematically depicts a cross-sectional view of the complete base insulating structure 1100. In one example, the base insulating structure 1100 may be similar to the base insulating structure 104, and constructed using one or more similar materials and processes. In one specific implementation, the first stage depicted in FIG. 11A may mold a polymer foam around insulating portions 615 to form core structures 1104, 1106, and 1108. In one example, the core structures may be referred to as side core structures 1104 and 1008, and bottom core structure 1106. It is contemplated that the core structures 1104, 1106, and 1108 may be formed as a single structure, or as multiple separate structures coupled to one another by connection elements. It is contemplated that any connection elements may be utilized, including, among others, one or more wire elements, or sacrificial polymer elements configured to position the core structures 1104, 1106, and 1108 relative to one another prior to one or more rotational molding processes. Further, it is contemplated that a similar process to that described in relation to FIGS. 11A-11B may be utilized to construct a lid insulating portion, similar to lid insulating portion 102 described in relation to FIG. 1.

In one implementation, the core structures 1104, 1106, and 1108 may be constructed from polymeric foam, such as polyurethane. However, additional polymeric foams may be utilized, without departing from the scope of these disclosures. Advantageously, the core structures 1104, 1106, and 1108 may provide increased protection to the partially or wholly covered insulating portion 615 to mechanical stresses and/or thermal stresses that might otherwise damage the insulating portion 615 during one or more rotational molding processes. Accordingly, FIG. 11B schematically depicts a cross sectional view of the base insulating structure 1100 following one or more rotational molding processes to add an outer shell structure 1110 around the core structures 1104, 1106, and 1108. As such, it is contemplated that the outer shell structure 1110 may be formed using any known rotational molding processes, and any one or more polymers, such as those polymers described throughout these disclosures.

Figure 12:
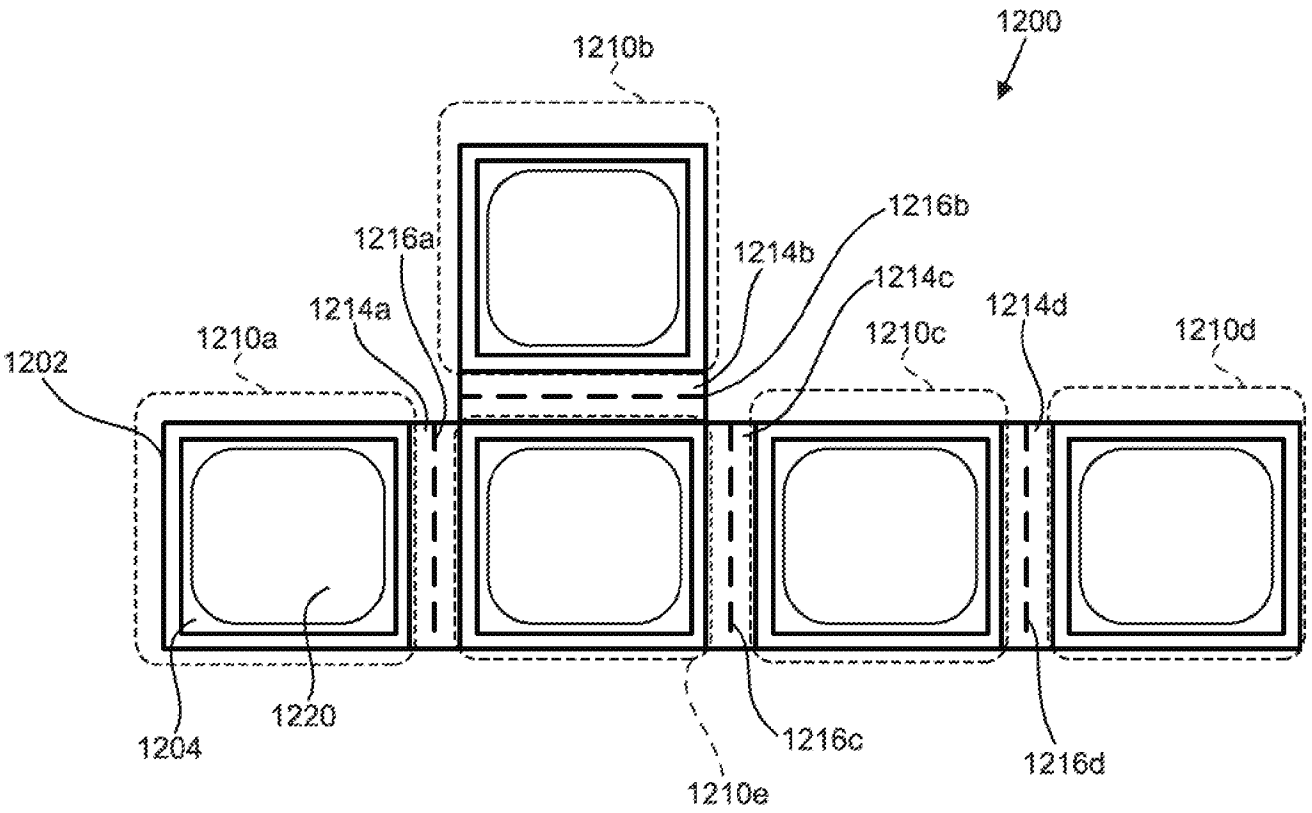
FIG. 12 schematically depicts one implementation of a foldable insulating portion, according to one or more aspects described herein.

FIG. 12 schematically depicts one implementation of a foldable insulating portion 1200, according to one or more aspects described herein. The foldable insulating portion 1200 may comprise multiple insulating components 1210*a*-1210*e* coupled to one another by flexure elements 1214*a*-1214*d*. Accordingly, the flexure elements 1214*a*-1214*d* facilitate rotation of the insulating components 1210*a*-1210*e* relative to one another along hinge lines schematically depicted as lines 1216*a*-1216*d*. In one implementation, the combination of the insulating components 1210*a*-1210*e* and flexure elements 1214*a*-1214*d* may be referred to as a foldable support structure. Further, each of the insulating components 1210*a*-1210*e* may include a retaining portion 1202 that may be similar to the retaining portion 205, and a cavity 1204, which may be similar to cavity 214. Element 1220 may include a single vacuum insulated panel, or multiple vacuum insulated panels arranged in a manner similar to that described in relation to the insulating portion 615. In various implementations, the foldable insulating portion 1200 may be utilized as an alternative to the insulating portion 615, where described throughout these disclosures. For example, the foldable insulating portion 1200 may be utilized within the base insulating structures 650, 900, 1000, and/or 1100, without departing from the scope of these disclosures.

In one implementation, the foldable insulating portion 1200 may be utilized in the various implementations described throughout this disclosure in addition to, or as an alternative to, the described insulating portion 615. In the depicted implementation of FIG. 12, the foldable insulating portion 1200 includes five insulating components 1210*a*-1210*e* hingedly coupled by four flexure elements 1214*a*-1214*d* having four hinge lines 1216*a*-1216*d*. Accordingly, the depicted implementation of the foldable insulating portion 1200 is configured to be folded into a five-sided assembly that may form part of a base insulating structure, similar to base insulating structure 104. Advantageously, the foldable insulating portion 1200 may allow for more precise placement of the vacuum insulated panels 1220 within, in one example, a base insulating structure. This, in turn, may provide enhanced insulating performance to the base insulating structure by providing enhanced insulation at, among others, one or more edges of a structure as the folded assembly extends around one or more corners of a structure into which it is received and coupled. Additionally, the foldable insulating portion 1200 may provide for increased precision during one or more assembly operations of, in one example, base insulating structure 104.

Figure 13:
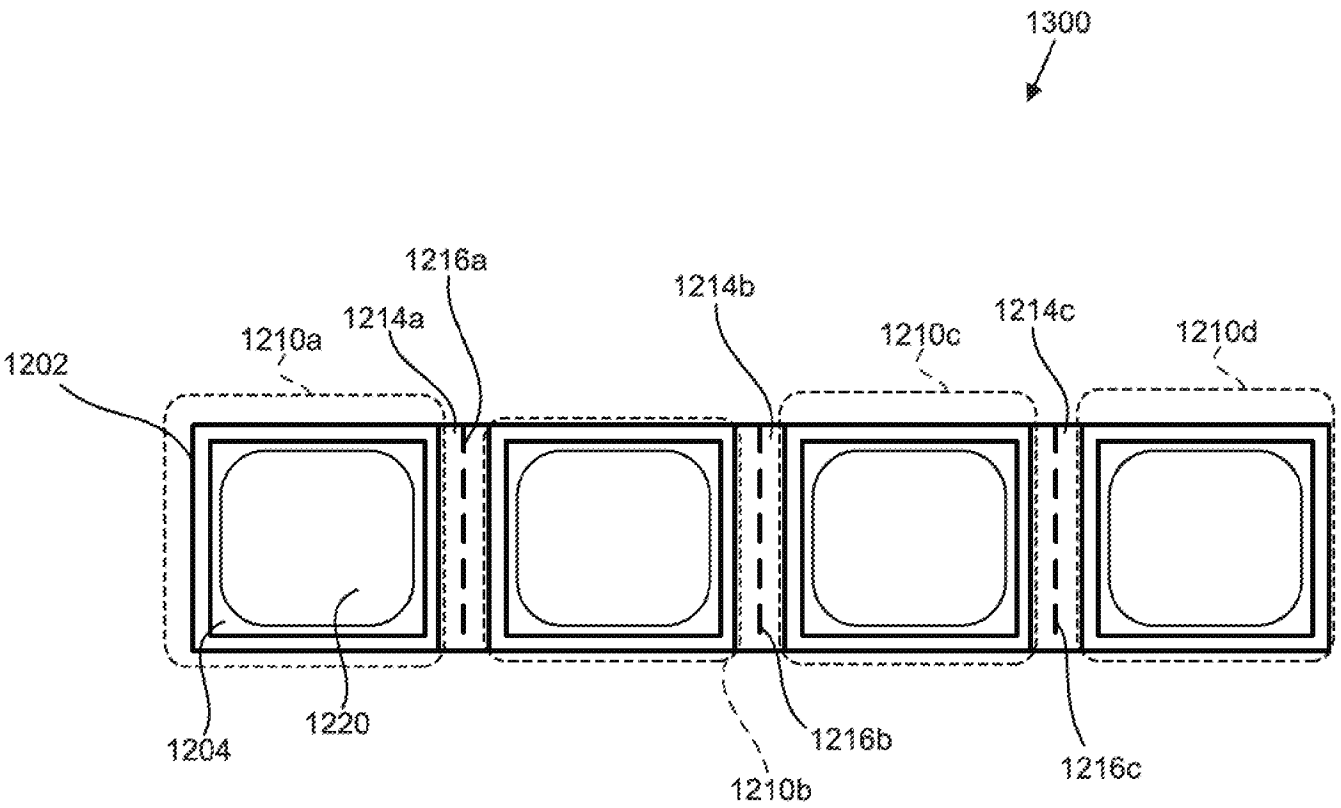
FIG. 13 schematically depicts another implementation of a foldable insulating portion, according to one or more aspects described herein.

It is contemplated that alternative implementations of a foldable insulating portion may be utilized, without departing from the scope of these disclosures. In one example, and as depicted in FIG. 13 as foldable insulating portion 1300, a four-sided foldable insulating portion may be utilized. Accordingly, the foldable insulating portion 1300 may be configured to be folded into an assembly having four sides that extend around at least one corner of a base insulating structure, such as base insulating structure 104. It is further contemplated that alternative implementations of a foldable insulating portion utilizing multiple insulating components 1210 and flexure elements 1214 may be envisioned, without departing from the scope of these disclosures. For example, a foldable insulating portion may utilize two insulating components 1210, three insulating components 1210, or six insulating components 1210, and interconnected by flexure elements 1214 in any configuration, without departing from the scope of these disclosures.

Figure 14A:
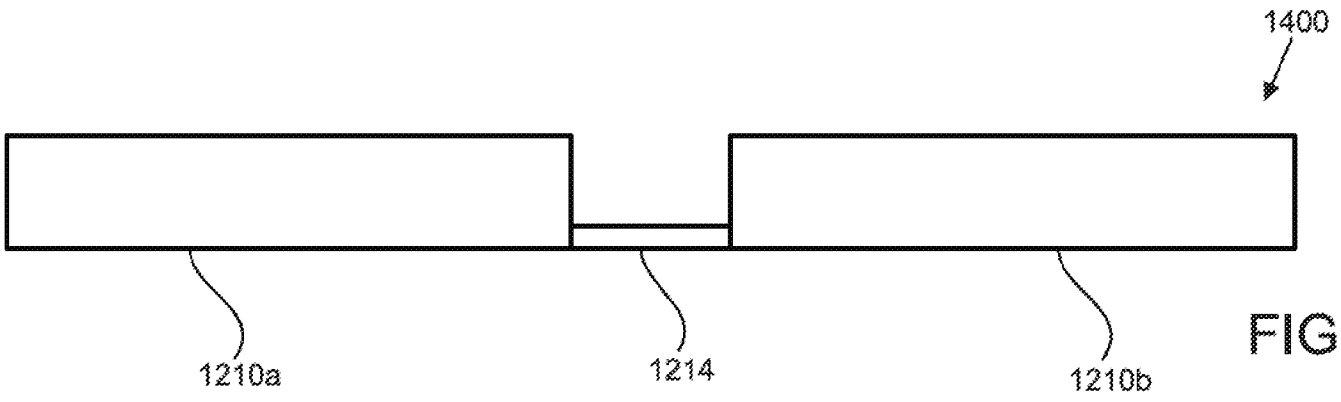
FIGS. 14A-14B schematically depict end views of another implementation of a foldable insulating portion, according to one or more aspects described herein.
Figure 14B:
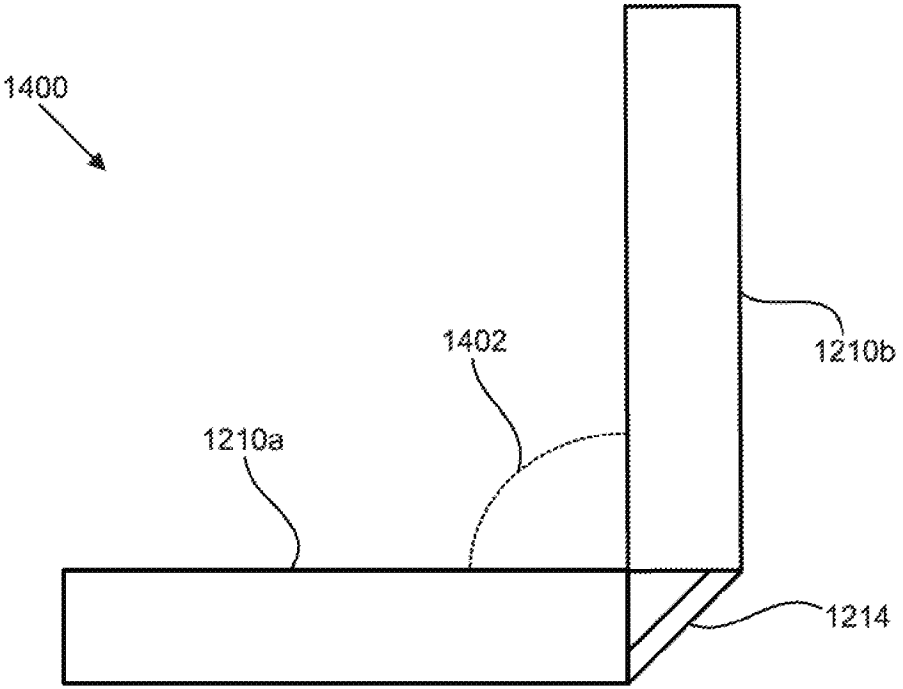

FIGS. 14A-14B schematically depict end views of another implementation of a foldable insulating portion 1400, according to one or more aspects described herein. In this schematic depiction, two insulating components 1210*a*-1210*b* may be coupled to one another by flexure element 1214. It is contemplated, however, that additional insulating components and flexure elements may be utilized, without departing from the scope of these disclosures. The insulating components 1210*a*-1210*b* may be folded from an unassembled configuration, depicted in FIG. 14A, to an assembled configuration, depicted in FIG. 14B. The assembled configuration of FIG. 14B may result in the insulating components 1210*a*-1210*b* being positioned at an angle 1402 relative to one another. This angle 1402 may measure approximately 90°. However, it is contemplated that angle 1402 may have any value, without departing from the scope of these disclosures.

In the depicted implementation in FIGS. 14A-14B, the insulating components 1210*a*-1210*b*, when folded into the assembly of FIG. 14B results in a non-overlapping configuration of the insulating components 1210*a*-1210*b*. In an alternative implementation, the insulating components

Figure 15A:
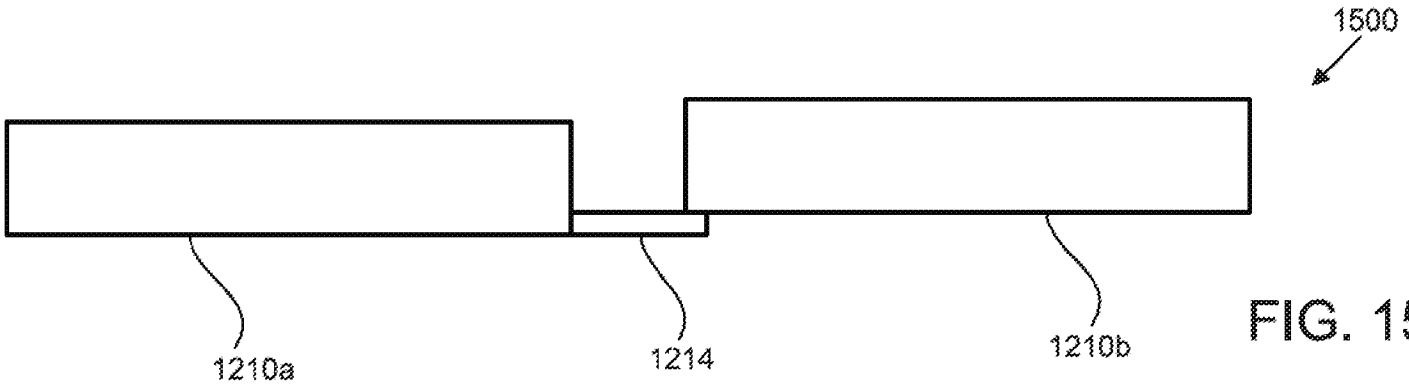
FIGS. 15A-15B schematically depict end views another implementation of a foldable insulating portion, according to one or more aspects described herein.
Figure 15B:
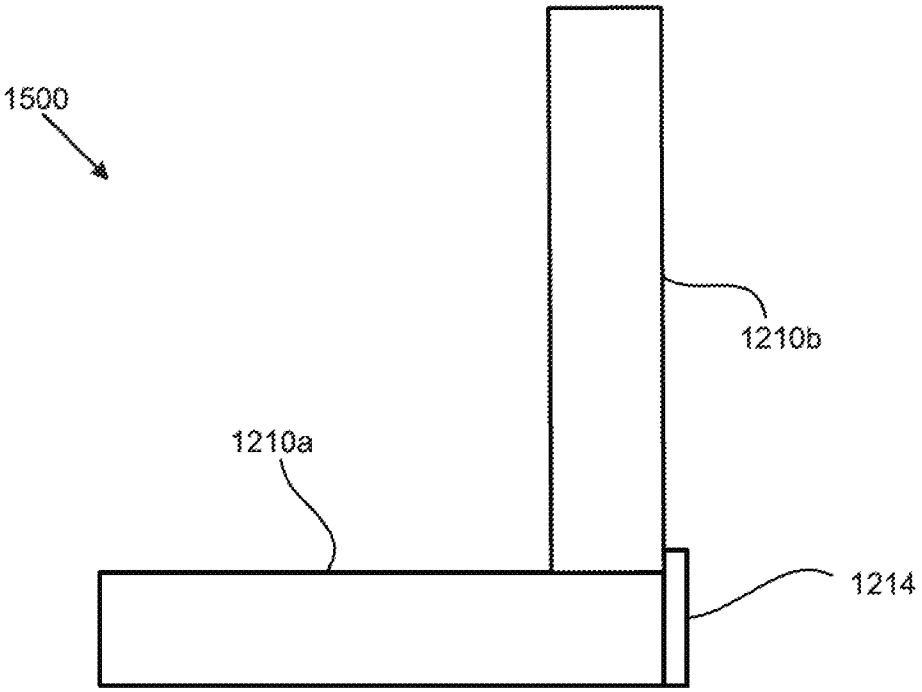

1210*a*-1210*b* may overlap when folded into an assembled configuration, as described in relation to FIGS. 15A-15B. Accordingly, FIGS. 15A-15B schematically depict end views another implementation of a foldable insulating portion 1500, according to one or more aspects described herein. When folded from the unassembled configuration of FIG. 15A to the assembled configuration of FIG. 15B, the insulating components 1210*a*-1210*b* may overlap one another, which may result in enhanced insulation performance (i.e. higher insulation value). However, it is contemplated that additional or alternative folding methodologies, such as partial overlapping of insulating components 1210, among others, may be utilized, without departing from the scope of these disclosures.

Further alternative implementations of insulating structures are contemplated, as schematically depicted in FIGS. 16-20. Accordingly, it is contemplated that the insulating containers depicted in FIGS. 16-20 may be constructed using any methodologies discussed throughout these disclosures, and from one or more polymer, metal, alloy, composite, or ceramic materials. Where one or more couplings are discussed in relation to the insulating structures of FIGS. 16-20, it is contemplated that any coupling methodology may be utilized, including one or more mechanical fasteners (e.g. screws, rivets, bolts, interference fittings, among others), chemical fasteners (e.g. adhesives/resins, among others), or other coupling methodologies (e.g. welding, among others), without departing from the scope of these disclosures. Further, it is contemplated that the insulating containers depicted in FIGS. 16-20 may utilize one or more vacuum insulated panels 625, which may be within one or more of the insulating portion 615 and/or foldable insulating portions 1200 and 1300, among others. The insulating container 1600 depicted in FIG. 16 includes a lid insulating structure 1602 and a base insulating structure 1604 configured to be hingedly or removably coupled to one another. In one implementation, the lid insulating structure 1602 may comprise an inner wall structure 1608 that is configured to be coupled to an outer shell 1606. Further, the base insulating structure 1604 may comprise an inner wall structure 1610 that is configured to be coupled to an outer shell 1612.

Figure 17:
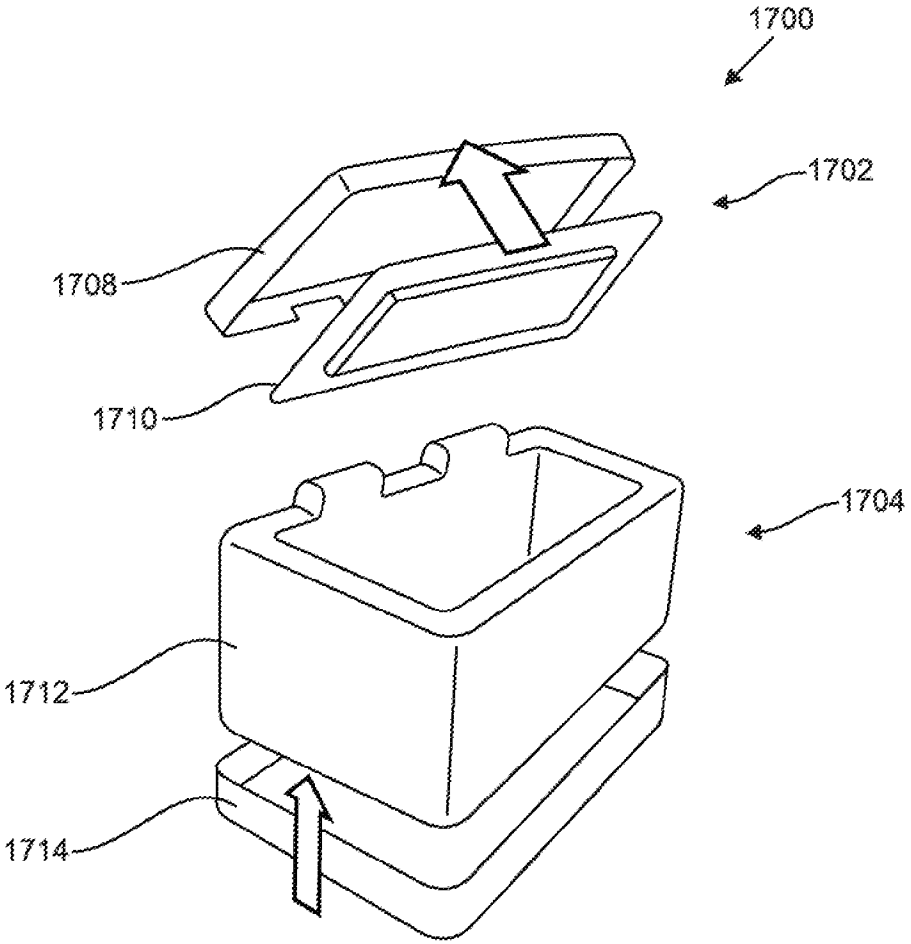
FIG. 17 schematically depicts an exploded view of another implementation of an insulating container, according to one or more aspects described herein.

FIG. 17 schematically depicts another implementation of an insulating container 1700, according to one or more aspects described herein. The insulating container 1700 includes a lid insulating structure 1702 and a base insulating structure 1704 configured to be hingedly and/or removably coupled to one another. Further, the lid insulating structure 7002 comprises an inner wall structure 1710 that is configured to be coupled to an outer shell 1708. The base insulating structure 1704 comprises a compartment structure 1712 configured to be rigidly coupled to an end cap structure 1714.

Figure 18:
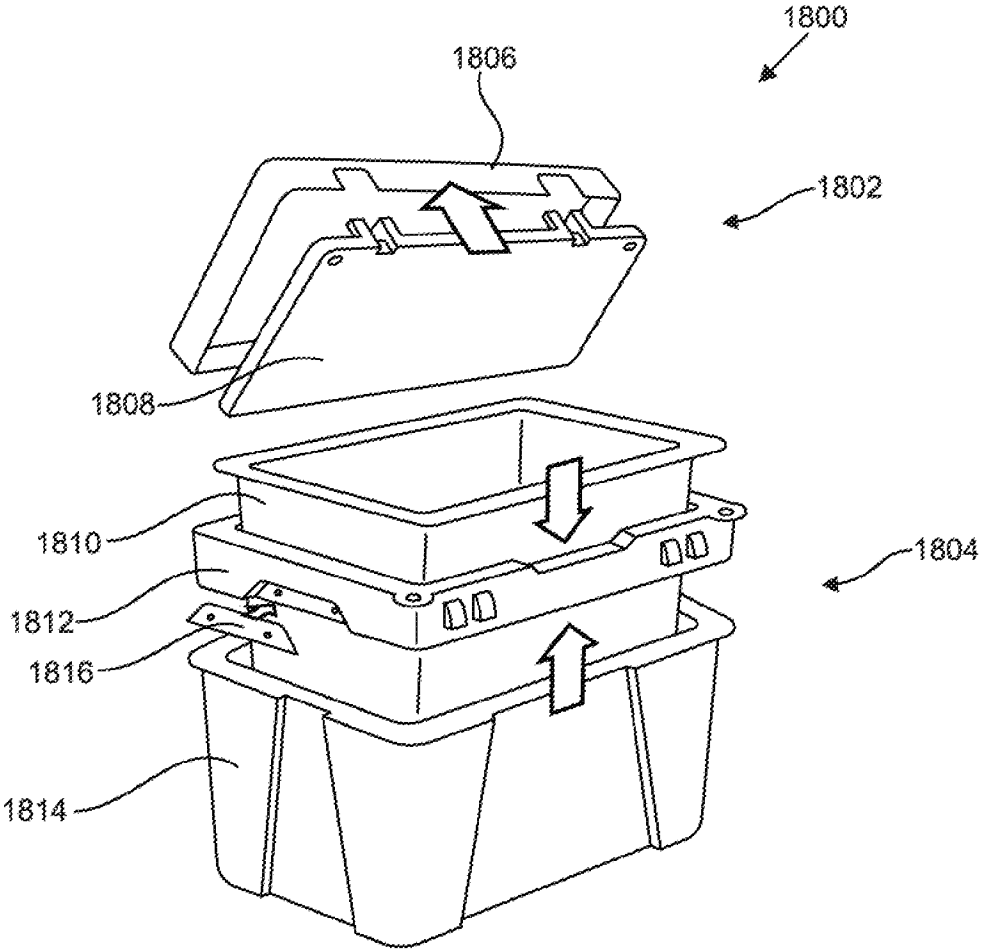
FIG. 18 schematically depicts an exploded view of another implementation of an insulating container, according to one or more aspects described herein.

FIG. 18 schematically depicts another implementation of an insulating container 1800, according to one or more aspects described herein. The insulating container 1800 includes a lid insulating structure 1802, and a base insulating structure 1804, configured to be hingedly and/or removably coupled to one another. The lid insulating structure 1802 includes an inner wall structure 1808 that is configured to be coupled to an outer shell 1806. The base insulating structure 1804 includes an inner wall structure 1810 configured to be received into an outer shell structure 1814. A collar structure 1812 is configured to be positioned between the inner wall structure 1810 and the outer shell structure 1814 around a perimeter of the base insulating structure 1804. Additionally, one or more grip elements 1816 are configured to be coupled to the collar structure 1812, and configured to provide one or more handles for manual repositioning of the insulating container 1800.

Figure 19:
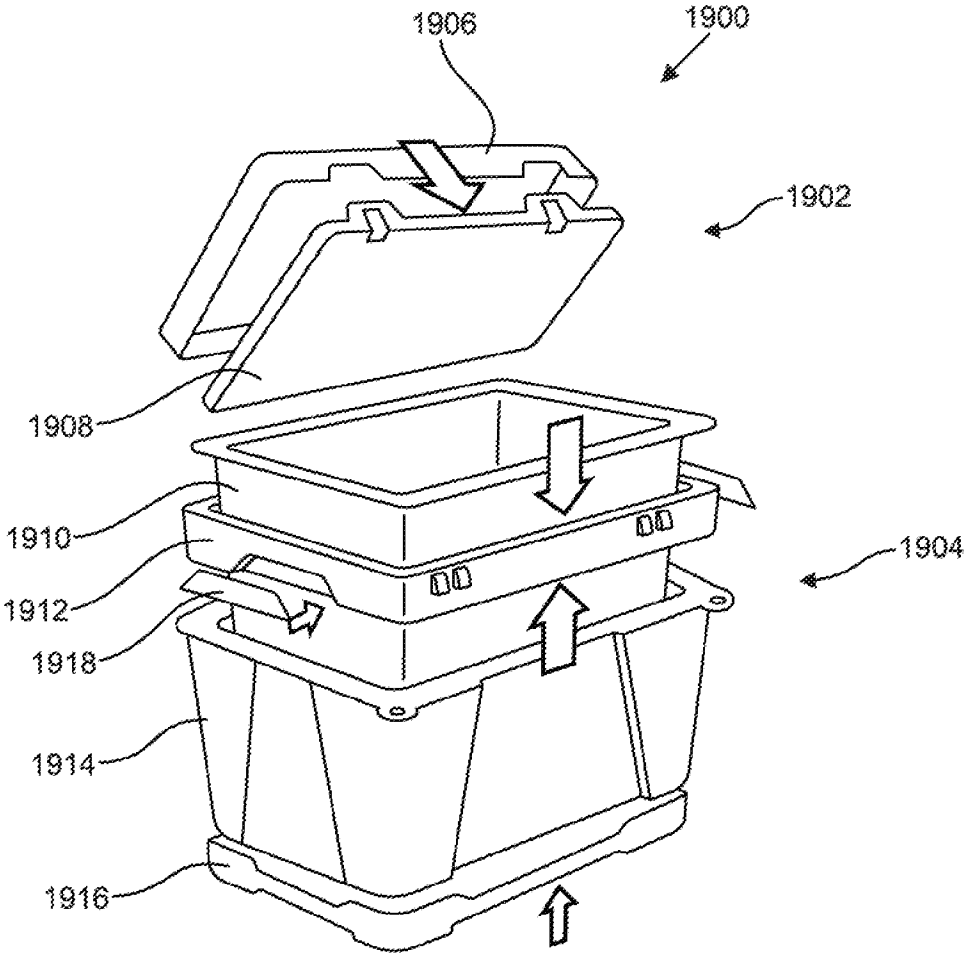
FIG. 19 schematically depicts an exploded view of another implementation of an insulating container, according to one or more aspects described herein.

FIG. 19 schematically depicts another implementation of an insulating container 1900, according to one or more aspects described herein. The insulating container 1900 includes a lid insulating structure 1902, and a base insulating structure 1904, configured to be hingedly and/or removably coupled to one another. The lid insulating structure 1902 includes an inner wall structure 1908 that is configured to be coupled to an outer shell 1906. The base insulating structure 1904 includes an inner wall structure 1910 configured to be received into an outer shell structure 1914. A collar structure 1912 is configured to be positioned between the inner wall structure 1910 and the outer shell structure 1914 around a perimeter of the base insulating structure 1904. Additionally, an end cap structure 1916 is configured to be rigidly coupled to the outer shell structure 1914. Further, one or more grip elements 1980 configured to be coupled to the collar structure 1912.

Figure 20:
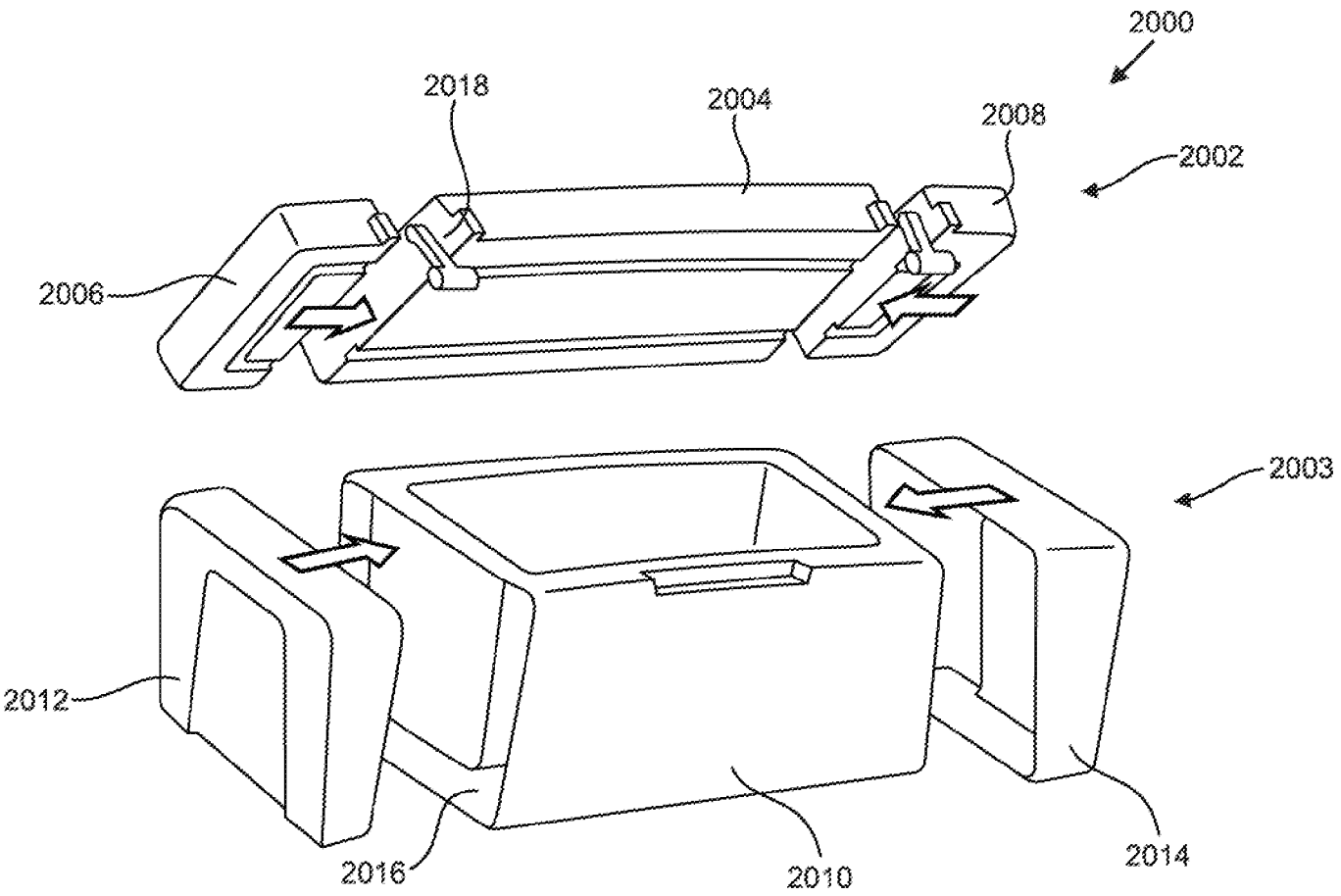
FIG. 20 schematically depicts an exploded view of another implementation of an insulating container, according to one or more aspects described herein.
Figure 21:
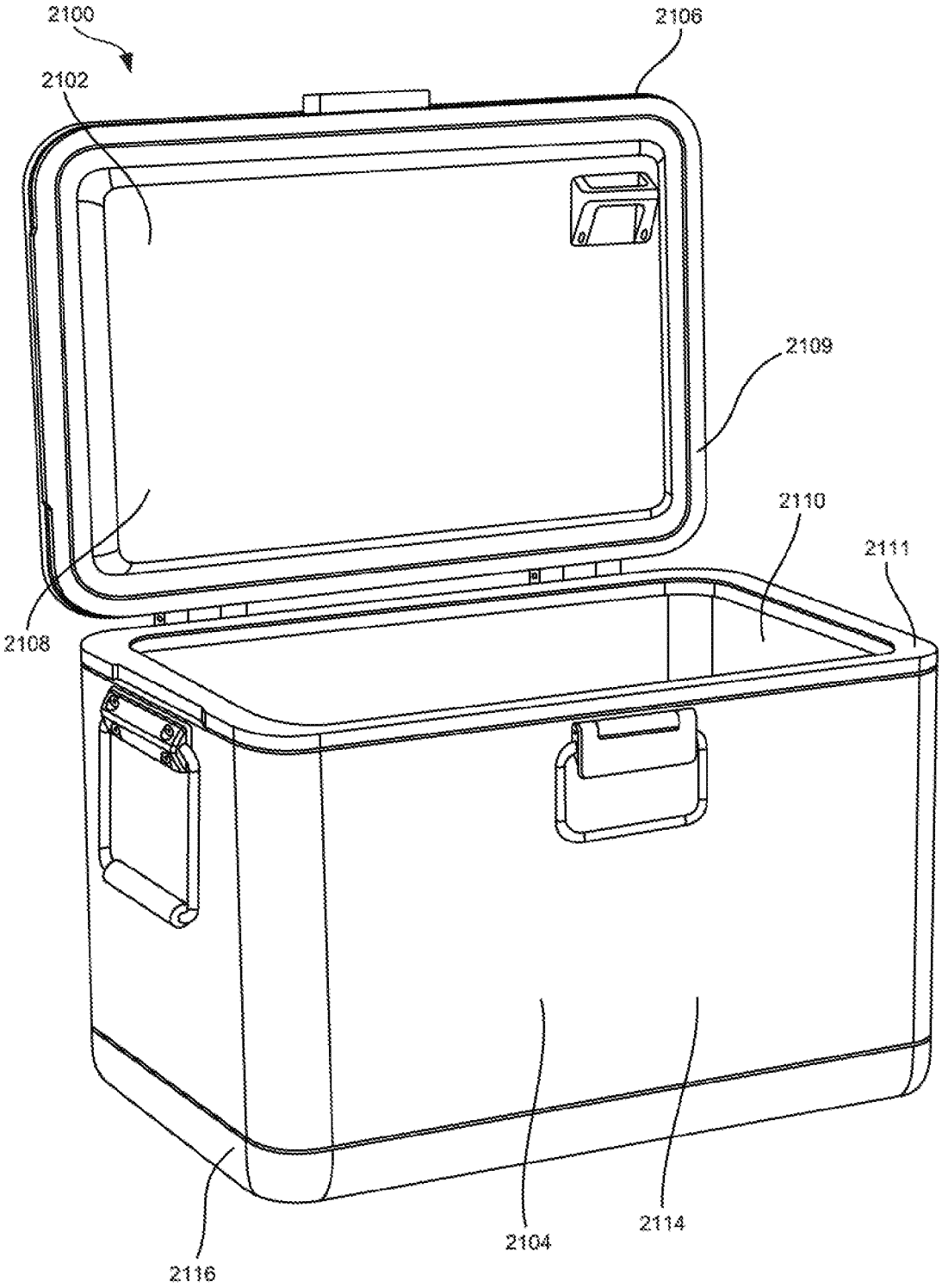
FIG. 21 depicts an isometric view of an example of an insulating container with a lid in an open position, according to one or more aspects described herein.
Figure 22:
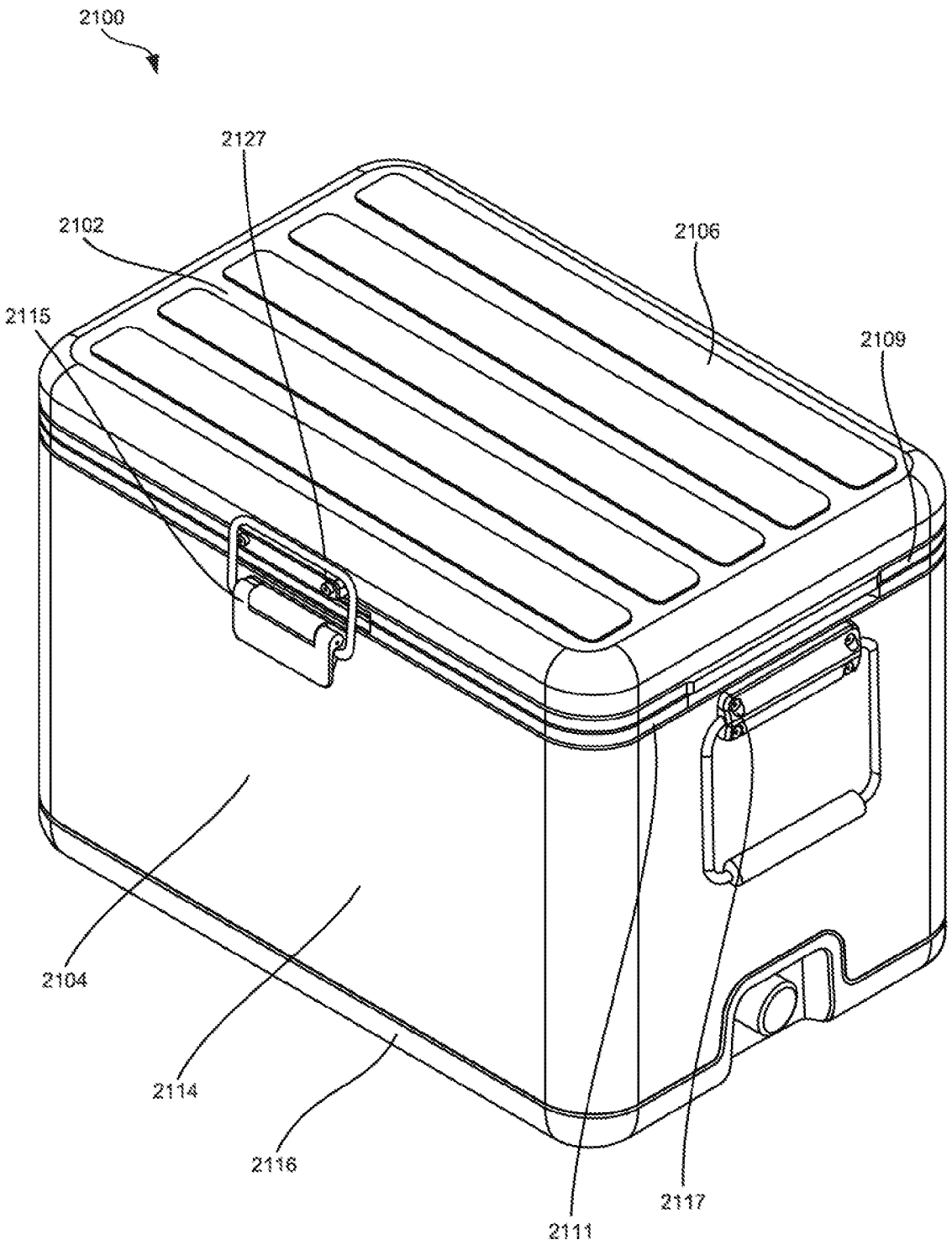
FIG. 22 depicts an isometric view of the insulating container of FIG. 21 with a lid in a closed position, according to one or more aspects described herein.
Figure 23:
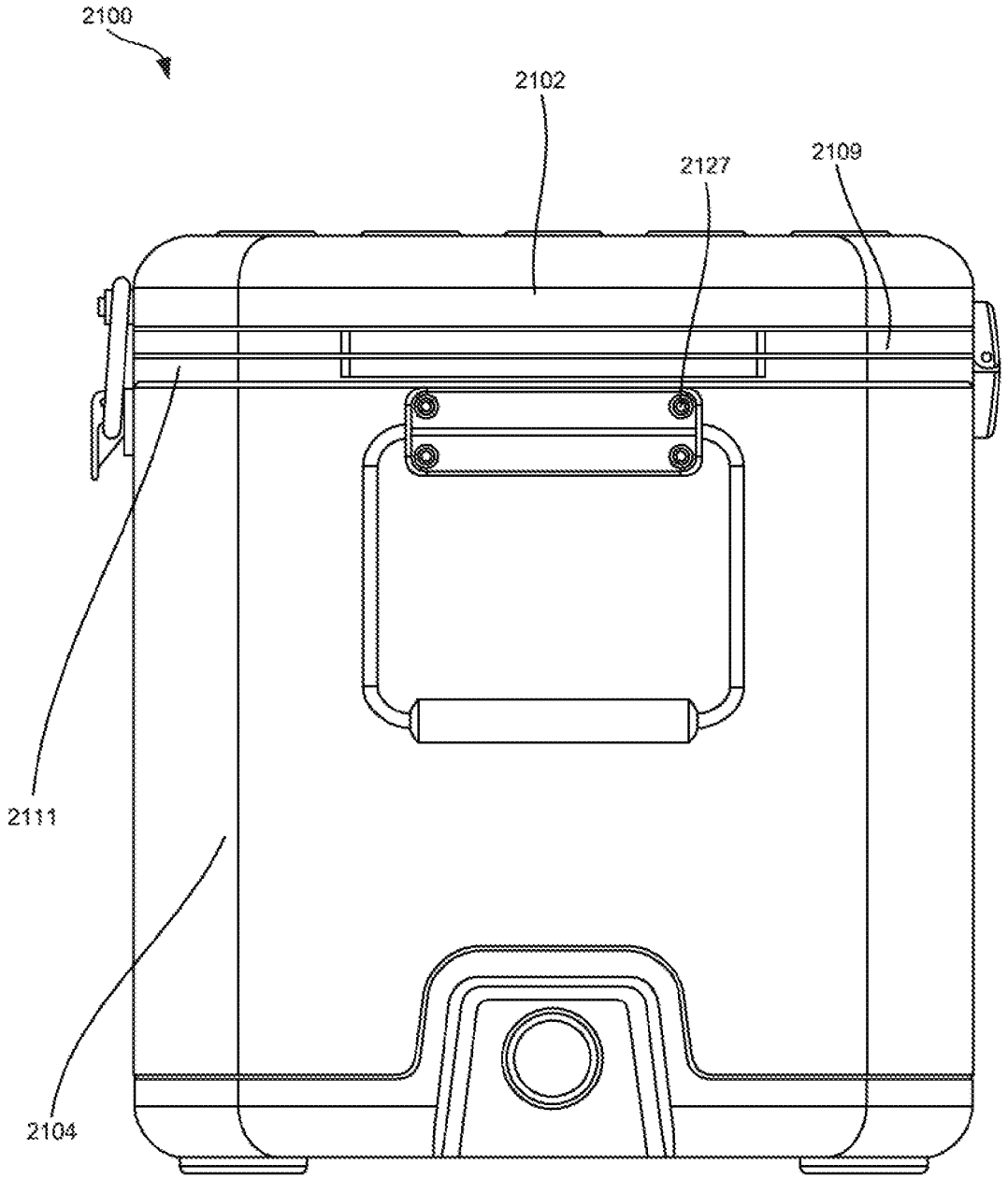
FIG. 23 depicts a side view of the insulating container of FIG. 22, according to one or more aspects described herein.

FIG. 20 schematically depicts yet another implementation of an insulating container 2000, according to one or more aspects described herein. The insulating container 2000 includes a lid insulating structure 2002, and a base insulating structure 2003, configured to be hingedly and/or removably coupled to one another. The lid insulating structure 2002 includes a central portion 2004 configured to be rigidly coupled to two end portions 2006 and 2008. The end portions 2006 and 2008 may, upon coupling to the central portion 2004, close and seal an inner cavity 2018 of the lid insulating structure 2002. The base insulating structure 2003 includes a central compartment structure 2010 configured to be rigidly coupled to two end caps 2012 and 2014. In one implementation, coupling of the end caps 2012 and 2014 to the central compartment structure 2010 may seal an internal cavity 2016.

Additional implementations of insulating structures are contemplated, as depicted in FIGS. 21-30C. Accordingly, it is contemplated that the insulating containers depicted in FIGS. 21-30C may be constructed using any methodologies discussed throughout these disclosures, and from one or more polymer, metal, alloy, composite, or ceramic materials. Where one or more couplings are discussed in relation to the insulating structures of FIGS. 21-30C, it is contemplated that any coupling methodology may be utilized, including one or more mechanical fasteners (e.g. screws, rivets, bolts, interference fittings, among others), chemical fasteners (e.g. adhesives/resins, among others), or other coupling methodologies (e.g. welding, among others), without departing from the scope of these disclosures. Further, it is contemplated that the insulating containers depicted in FIGS. 21-30C may utilize one or more vacuum insulated panels 625, which may be within one or more of the insulating portion 615 and/or foldable insulating portions 1200 and 1300, among others.

Figure 24:
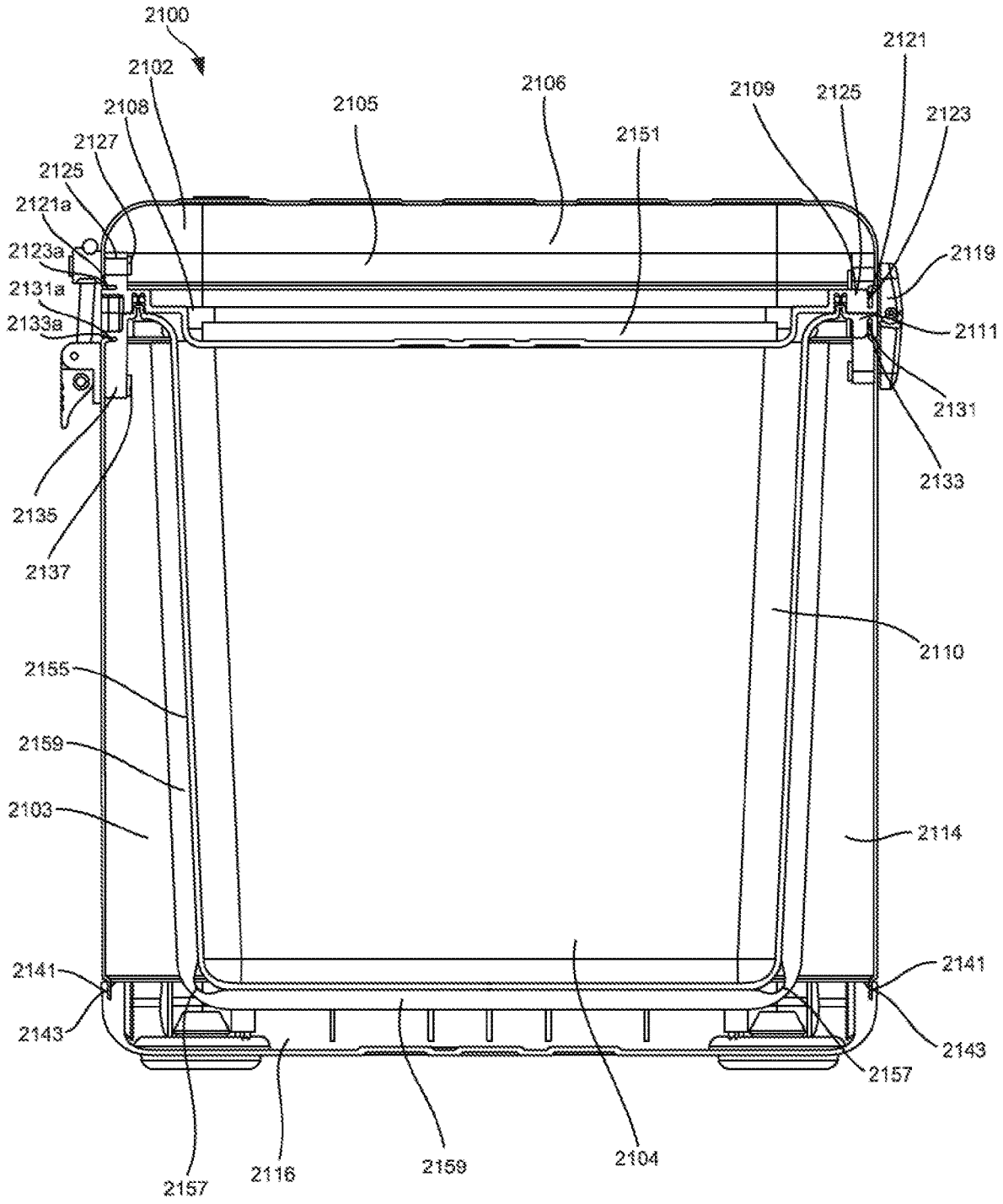
FIG. 24 depicts a side cross-sectional view of the insulating container of FIG. 22, according to one or more aspects described herein.

FIG. 21-30C schematically depict another implementation of an insulating container 2100, according to one or more aspects described herein and is similar to insulating containers discussed above. The insulating container 2100 includes a lid insulating structure 2102, and a base insulating structure 2104 configured to be pivotally, hingedly and/or removably coupled to one another. The lid insulating structure 2102 includes a lid inner wall structure 2108 that is configured to be coupled to a lid outer shell 2106 forming a lid cavity 2103 between the inner wall structure 2108 and the outer shell 2106. The base insulating structure 2104 includes a base inner wall structure 2110 configured to be received into a base outer shell structure 2114 forming a base cavity 2105 between the inner wall structure 2110 and the outer shell structure 2114. The lid inner wall structure 2108 may include a collar structure 2109 extending around the bottom of the perimeter of the lid insulating structure 2102 and the base inner wall structure 2110 may include a collar structure 2111 extending around the top of the perimeter of the base insulating structure 2104. The collar structures 2109, 2111 are configured to be to be positioned between the outer wall structures 2106, 2114 and are configured to engage each other around a perimeter of the insulating container 2100. Additionally, an end cap structure 2116 is configured to be rigidly coupled to a bottom of the base outer shell structure 2114 and/or the base inner wall structure 2110. As shown in FIG. 24, the cavity 2105 also extends between the end cap structure 2116 and the inner wall structure 2110 and the outer shell structure 2114. The insulating container 2100 may also comprise one or more latches 2115, handles 2117, and/or hinges 2119 which may be similar to latches, handles, and hinges described herein.

In some examples, and as shown in FIG. 24, the lid outer shell 2106 and the base outer shell 2114 may be formed of sheet metal such as stainless steel material. It is contemplated, however, that the lid outer shell 2106 the base outer shell 2114 may be constructed from one or more additional or alternative metals, alloys, polymers or composite materials, and constructed using one or more deep drawing or molding processes.

The lid inner wall structure 2108, the base inner wall structure 2110, and the end cap structure 2116 may comprise one or more polymers, such as polyethylene or polycarbonate, or any other polymer, described in these disclosures. However, it is contemplated that lid inner wall structure 2108, the base inner wall structure 2110, and/or the end cap structure 2116 may be constructed using one or more additional or alternative metals and/or alloys, one or more fiber-reinforced materials, one or more polymers, or one or more ceramics, or combinations thereof, among others, without departing from the scope of these disclosures. It is contemplated that the lid inner wall structure 2108, the base inner wall structure 2110, and/or the end cap structure 2116 may be constructed using any combination of forming processes and materials described in these disclosures, including, among others, rotational molding, injection molding, blow molding, or deep forming, among others.

Figure 27A:
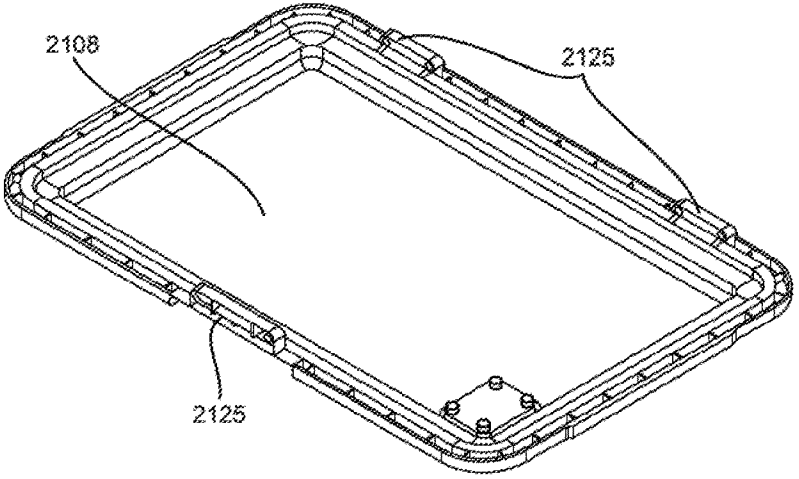
FIGS. 27A-27D depict isometric views of components of an insulating container, according to one or more aspects described herein.
Figure 27B:
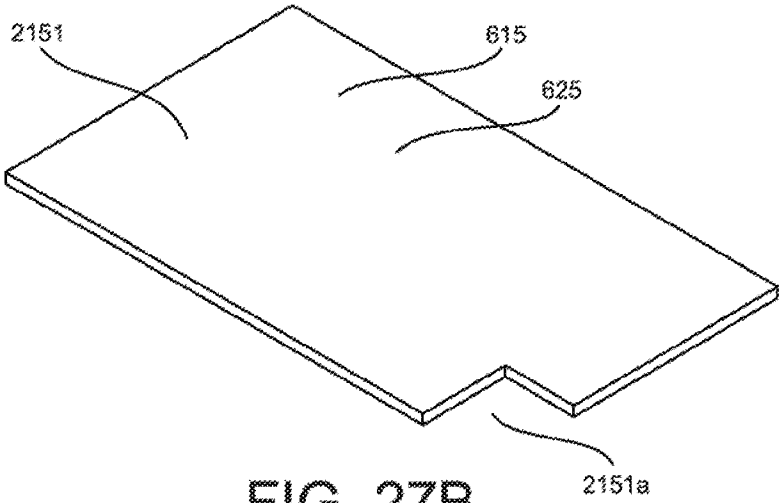
Figure 27C:
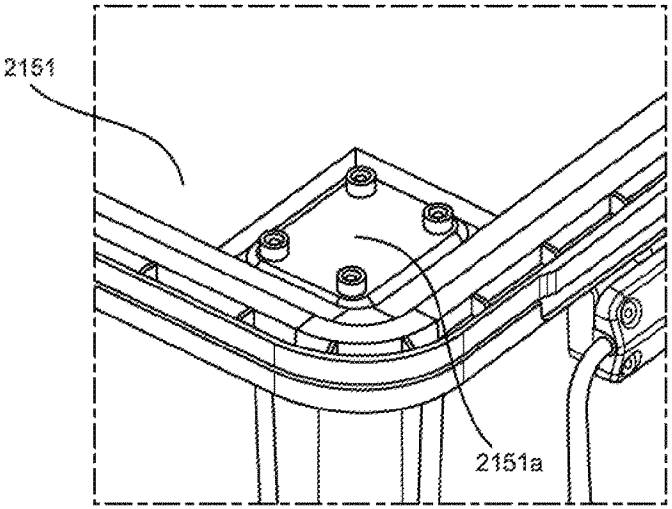
Figure 27D:
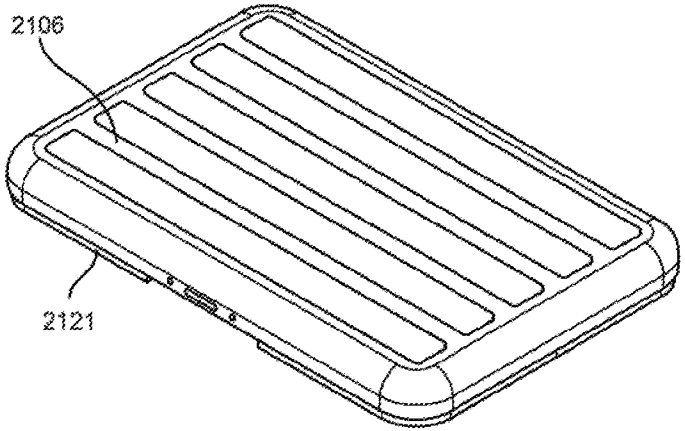

The inner wall structures 2108, 2110 and/or end cap 2116 may be engaged or coupled with the outer shells 2106, 2114 using methods described herein. In one example, and as best shown in FIGS. 24, 25A, 27A, 27D, and 30A, the insulating container outer shells 2106, 2114 may contain flanges and corresponding channels or grooves that act to engage the inner wall structures 2108, 2110 and/or end cap 2116 with the outer shells 2106, 2114. As shown in FIGS. 24, 27A, and 27D, the lid outer shell 2106 may include a substantially vertical downward flange 2121. The flange 2121 may extend substantially, or all of the way around the perimeter of the lid outer shell 2106. The lid inner wall structure 2108 may include a corresponding channel or groove 2123 which the flange 2121 engages within. Additionally, lid inner wall structure 2108 may contain one or more lid engagement structures 2125 that extend substantially vertically upward from the collar structure 2109 of the lid inner wall structure 2108 as shown in FIG. 24. The lid engagement structures 2125 may be formed integrally with the lid inner wall structure 2108. In areas adjacent the lid engagement structures 2125, the flange 2121 may have portions 2121 that extend substantially inward (or perpendicular to the other flange portions) and engage corresponding channels or grooves 2123*a* in the lid engagement structure 2125. Additionally, the latches 2115, handles 2117, and/or hinges 2119 may be engaged to the insulating container 2100 using fasteners 2127 that travel through the lid outer shell 2106 and the lid engagement structure 2125. Advantageously, such an engagement between the outer shell 2106 and the inner wall 2108 may serve to enhance the overall strength of the insulating structure 2100.

Figure 25A:
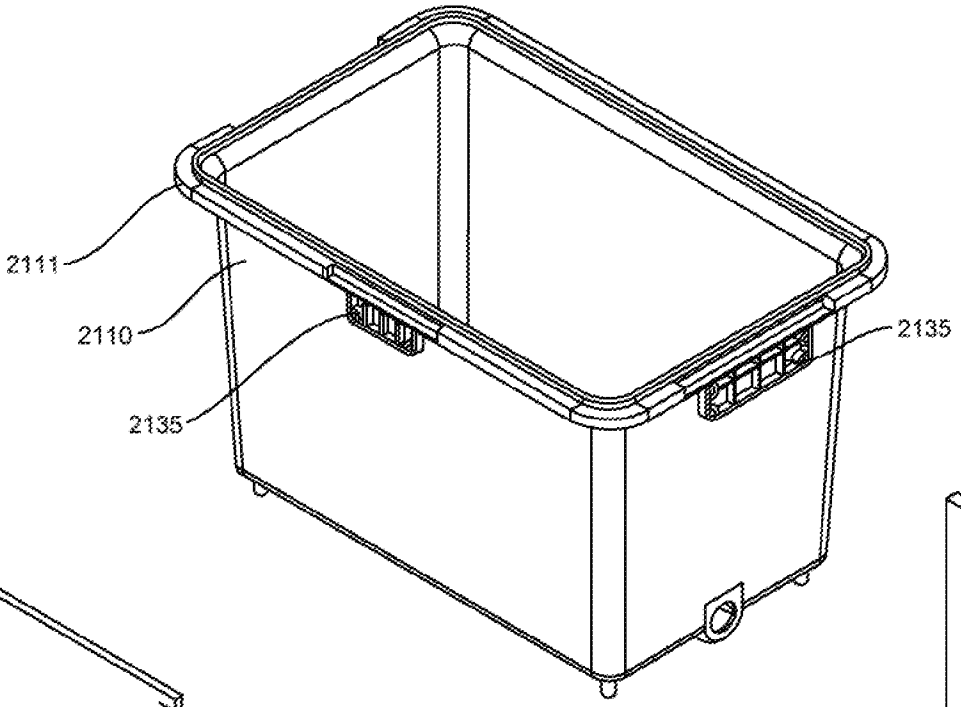
FIGS. 25A-25C depict isometric views of components of an insulating container, according to one or more aspects described herein.
Figure 25C:
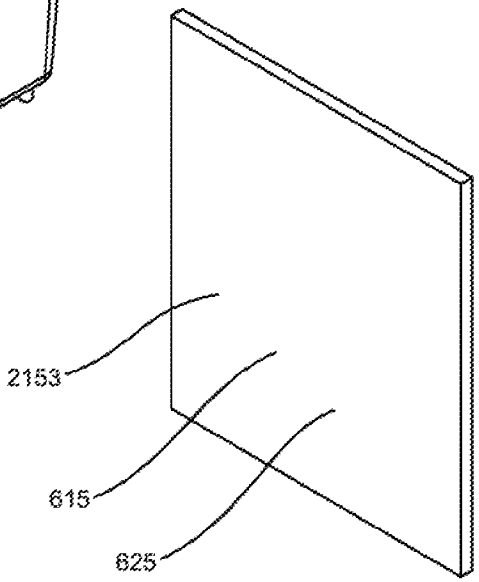
Figure 30A:
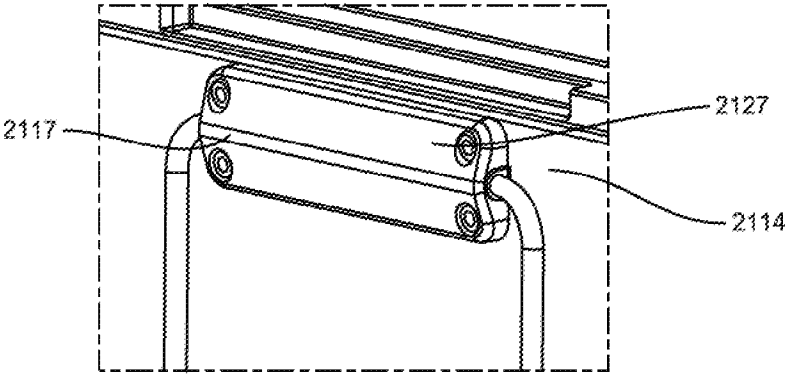
FIG. 30A depicts an isometric view of a portion of an insulating container, according to one or more aspects described herein.
Figure 30C:
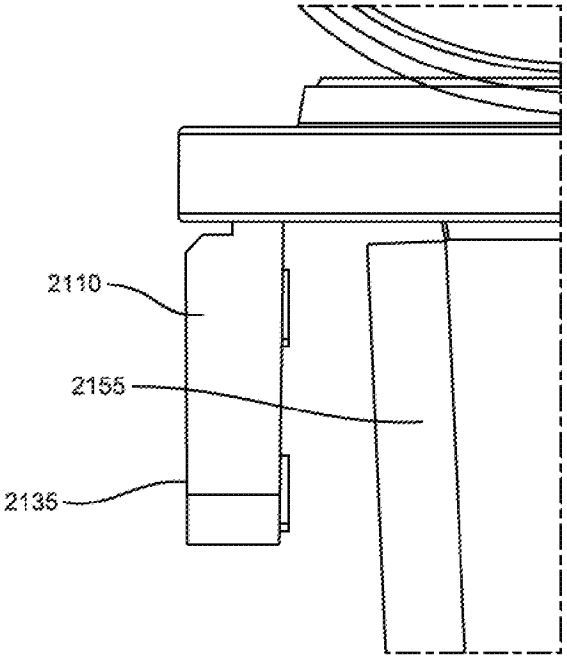
FIG. 30C depicts a side cross-sectional view of a portion of an insulating container, according to one or more aspects described herein.
Figure 30B:
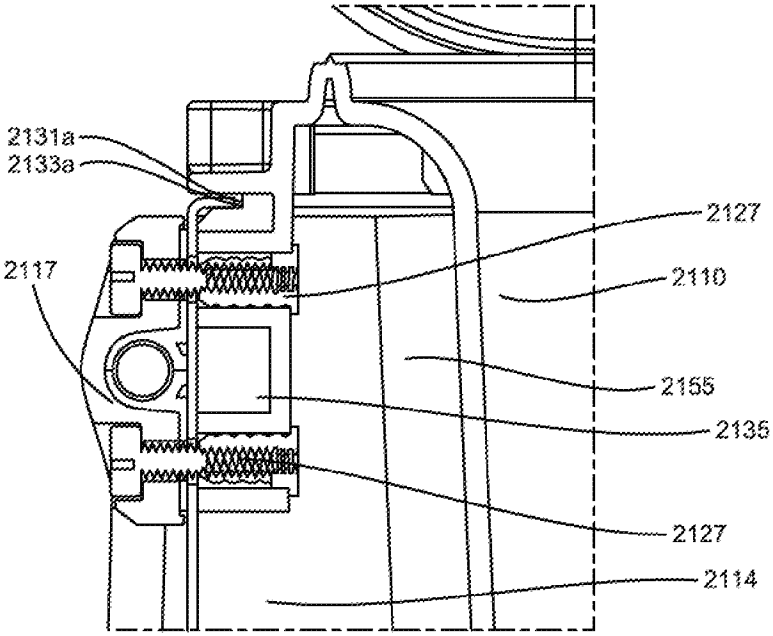
FIG. 30B. depicts a side cross-sectional view of the portion of an insulating container of FIG. 30B, according to one or more aspects described herein

The base outer shell 2114 may engage the base inner wall structure 2110. As shown in FIGS. 24, 25A, and 30A, the base outer shell 2114 may include a top, substantially upward, flange 2131. The flange 2131 may extend substantially, or all of the way around the perimeter of the base outer shell 2114. The base inner wall structure 2110 may include a corresponding channel or groove 2133 which the flange 2131 engages within. Additionally, the base inner wall structure 2110 may contain one or more base engagement structures 2135 that extend substantially vertically downward from the collar structure 2111 of the base inner wall structure 2110 as shown in FIG. 24. The base engagement structures 2135 may be formed integrally with the base inner wall structure 2114. In areas adjacent the base engagement structures 2135, the flange 2131 may have portions 2131*a* that extend substantially inward (or perpendicular to the other flange portions) and engage corresponding channels or grooves 2133*a* in the base engagement structure 2135. Additionally, the latches 2115, handles 2117, and/or hinges 2119 may be engaged to the insulating container 2100 using fasteners 2127 that travel through the outer shell 2114 and the base engagement structure 2135. Advantageously, such an engagement between the outer shell 2114 and the inner wall 2110 may serve to enhance the overall strength of the insulating structure 2100.

The base outer shell 2114 may engage or be coupled to the end cap 2116 similarly. As shown in FIGS. 24, 25A, and 30A, the base outer shell 2114 may include a bottom, substantially downward, flange 2141. The flange 2141 may extend substantially, or all of the way around the perimeter of the base outer shell 2114. The end cap 2116 may include a corresponding channel 2143 which the flange 2131 engages within. Advantageously, such an engagement between the outer shell 2114 and the end cap 2116 may serve to enhance the overall strength of the insulating structure 2100.

Figure 25B:
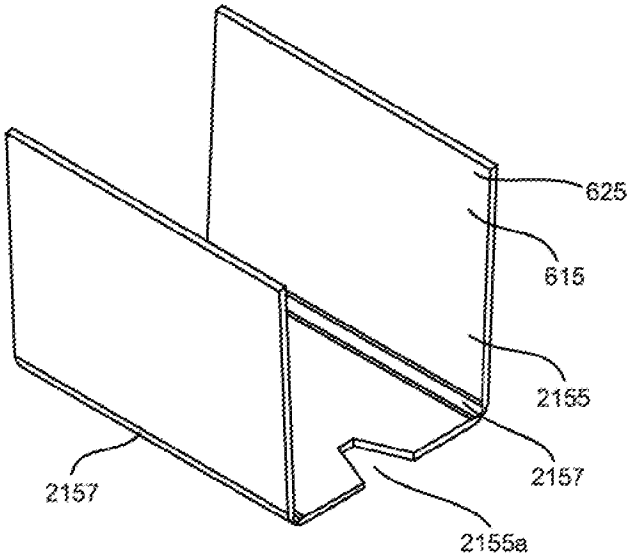
Figure 26B:
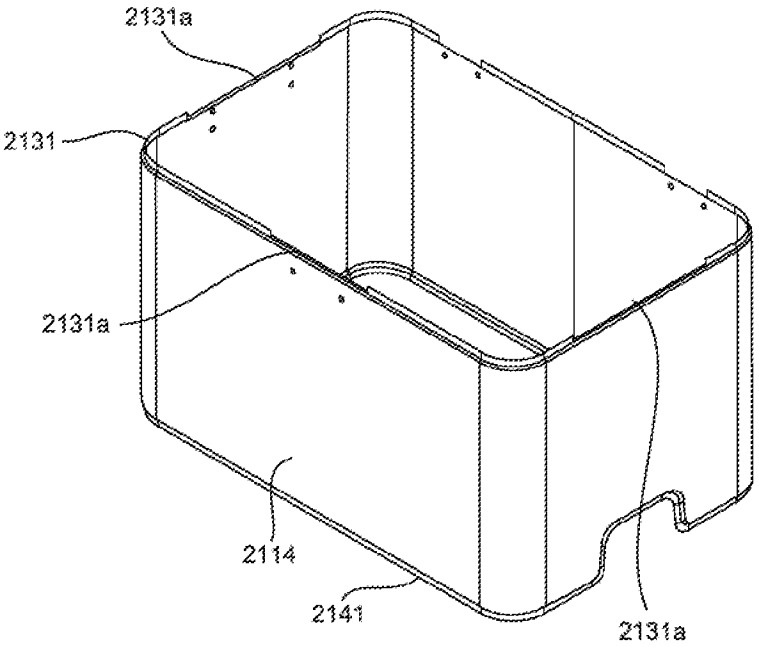
FIGS. 26A-26B depict isometric views of components of an insulating container, according to one or more aspects described herein.
Figure 26A:
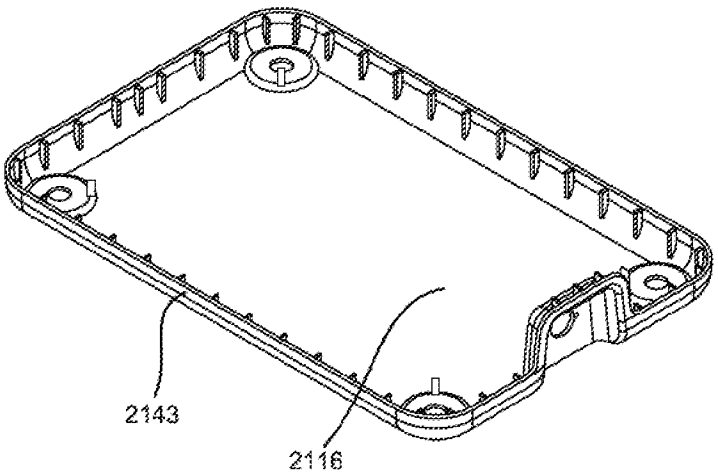
Figure 28B:
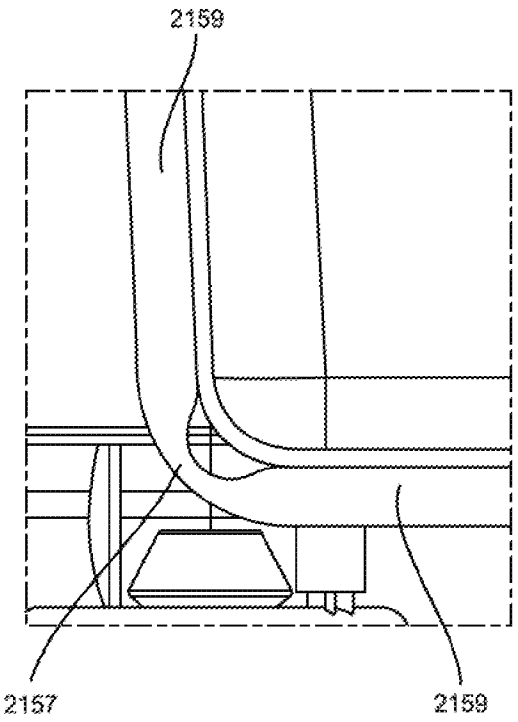
FIG. 28B depicts a side cross-sectional view of a portion of an insulating container, according to one or more aspects described herein.
Figure 28A:
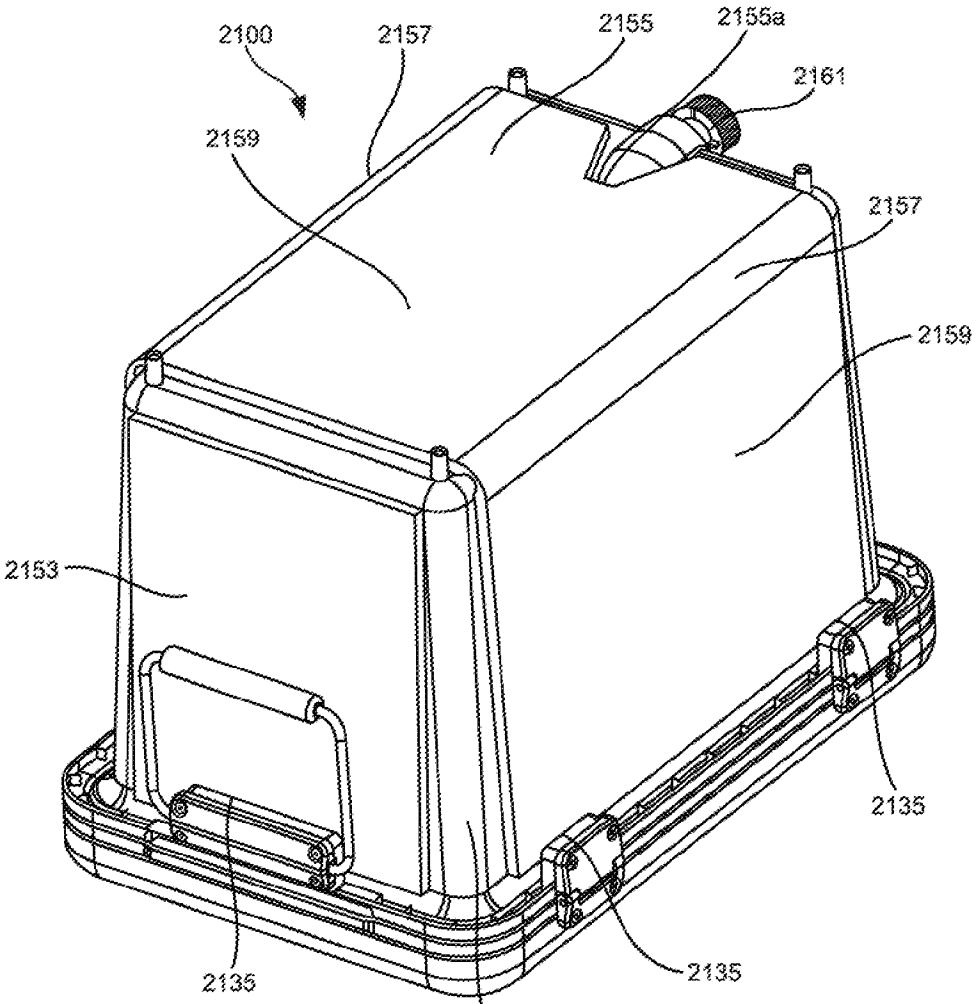
FIG. 28A depicts an isometric view of a portion of an insulating container, according to one or more aspects described herein.

The insulating structure 2100 may include insulating portions 615 including vacuum insulated panels 625 similar to those discussed above including any foldable and/or bendable portions such as 1200,1300, 1400 and shown in FIGS. 12-15. For example, insulating structure 2100 may in one embodiment include a lid insulating portion or lid insulating panel 2151 in the cavity 2103. The lid insulating portion 2151 may be engaged with the inner wall structure 2108. Similarly, the insulating structure 2100 may in one embodiment include a base insulating structure comprised of two separate side insulating panels 2153 and a 3-sided foldable or bendable insulating panel 2155. Panels 2153 and 2155 may be engaged with the base inner wall structure 2110. Similarly, to foldable insulating portions 1200,1300, and 1400, the 3-sided insulating panel 2155 may comprise multiple insulating components coupled to to one another by flexure elements. Additionally, also like panels 1200, 1300, and 1400, the 3-sided insulating panel 2155 may be a single vacuum insulated panel, or multiple vacuum insulated panels arranged in a manner similar to that described in relation to the insulating portion 615. In one example, as best shown in FIGS. 28A and 28B, the 3-sided insulating panel 2155 may comprise a single vacuum insulated panel and including folded areas 2157. The folded areas 2157 of the 3-sided vacuum insulate insulated panel 2155 may be compressed more than the non-folded portions 2159 of the panel 2155 such that the thickness of the folded area 2157 is less than the thickness of the non-folded portions 2159. Additionally, in some embodiments, the panels 2151, 2153, and/or 2155 may include one or more cut-out or notched portions. As shown in FIGS. 27B and 27C the lid insulating panel 2153 may have a cut-out or notched portion 2153*a* which may be used to accommodate a bottle opener. Similarly, as shown in FIGS. 25B and 28A, the insulating panel 2155 may include a cut-out or notched portion 2155*a* which may be used to accommodate a drain 2161. In other embodiments, panels 2153 and 2155 may not include cut-out or notched portions and may instead be made smaller to accommodate additional hardware including the bottle opener and the drain 2161. As discussed above, insulating panels 2151, 2153, 2155 may be constructed similar to any of the vacuum insulated panels discussed herein.

Figure 29B:
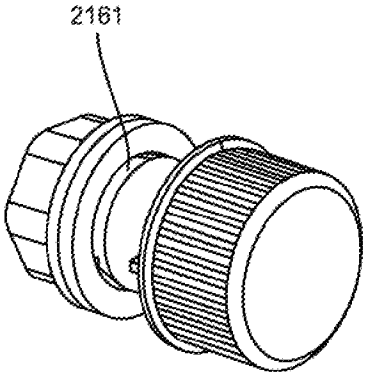
FIG. 29B depicts an isometric view of a portion of an insulating container, according to one or more aspects described herein.
Figure 29A:
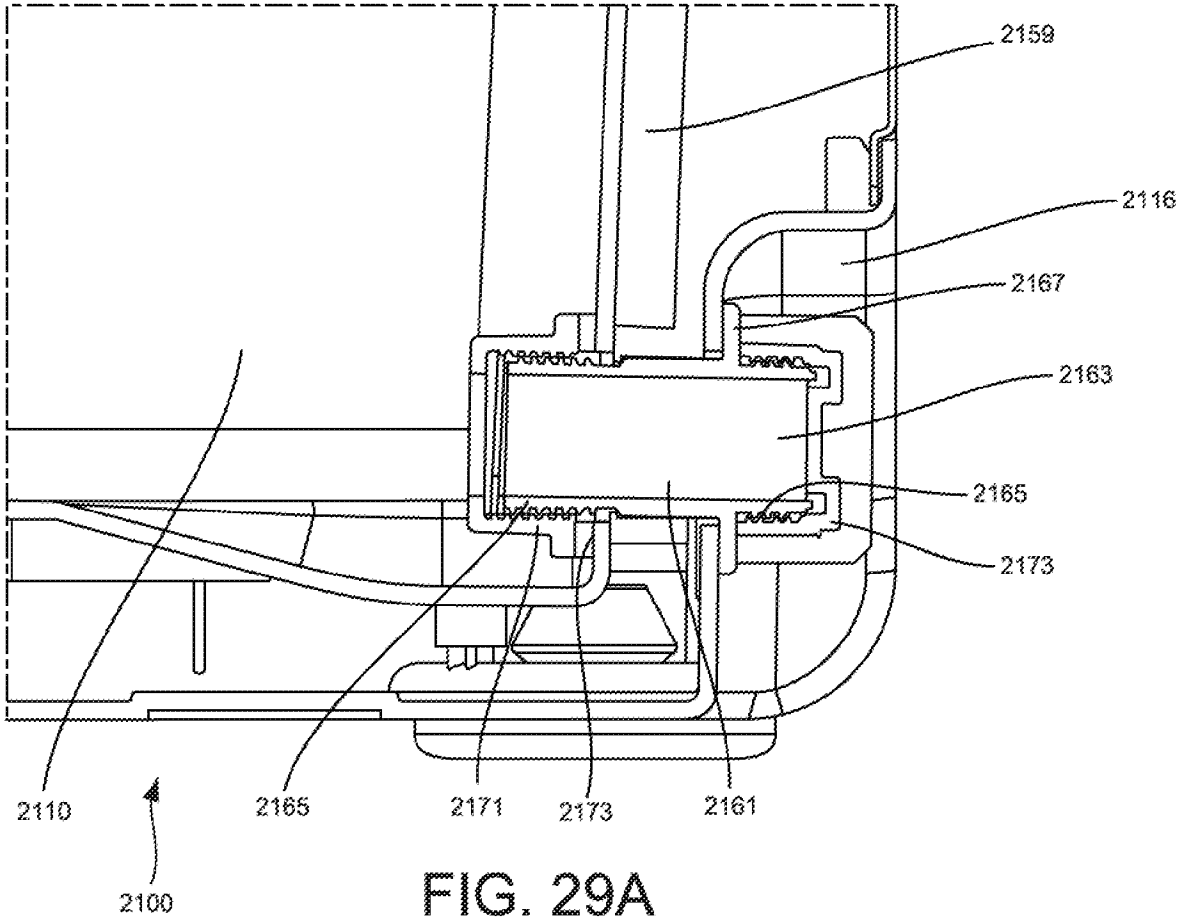
FIG. 29A depicts a side cross-sectional view of a portion of an insulating container, according to one or more aspects described herein.

As shown in FIGS. 29A and 29B, the drain 2161 may pass through the end cap 2116, and the base inner wall structure 2110. The drain 2161 may include a drain pass-through portion 2163 having a threaded connection 2165 on either end and a rim 2167 on at least one end. The drain 2161 may also include a gasket 2169, a nut 2171 having an aperture, and cap 2173. As shown in FIG. 29A, the rim 2167 may engage the end cap 2116 and the gasket may engage the inner wall structure 2110. The nut 2171 may then tighten the drain portions together.

As discussed above, in one example, after installing vacuum insulated panels (including panels 2151, 2153, and 2155) into cavities 2103 and 2105 the cavities 2103 and 2105 may be partially or wholly filled with an insulating foam, such as one or more of the insulating foams previously described. Accordingly, the lid insulating structure 2102 may be constructed by positioning vacuum insulated panel 2151 in cavity 2103. In some embodiments, panel 2151 may be coupled with lid inner wall structure 2108. Lid inner wall structure 2108 may then be coupled with lid outer shell 2106 including by engaging some or all of the mechanical fasteners 2127. Insulating foam may then be injected into the remaining portions of cavity 2103. The insulating foam may partially or wholly fill an unfilled volume of the cavity 2103. Similarly, the base insulating structure 2104 may be constructed by positioning vacuum insulated panels 2153, 2155 in cavity 2105. In some embodiments, panels 2153, 2155 may be coupled with base inner wall structure 2110. Base outer shell 2114 may then be coupled with base inner wall structure 2110 and end cap 2116 including by engaging some or all of the mechanical fasteners 2127. Insulating foam may then be injected into the remaining portions of cavity 2105. The insulating foam may partially or wholly fill an unfilled volume of the cavity 2105.

Figure 16:
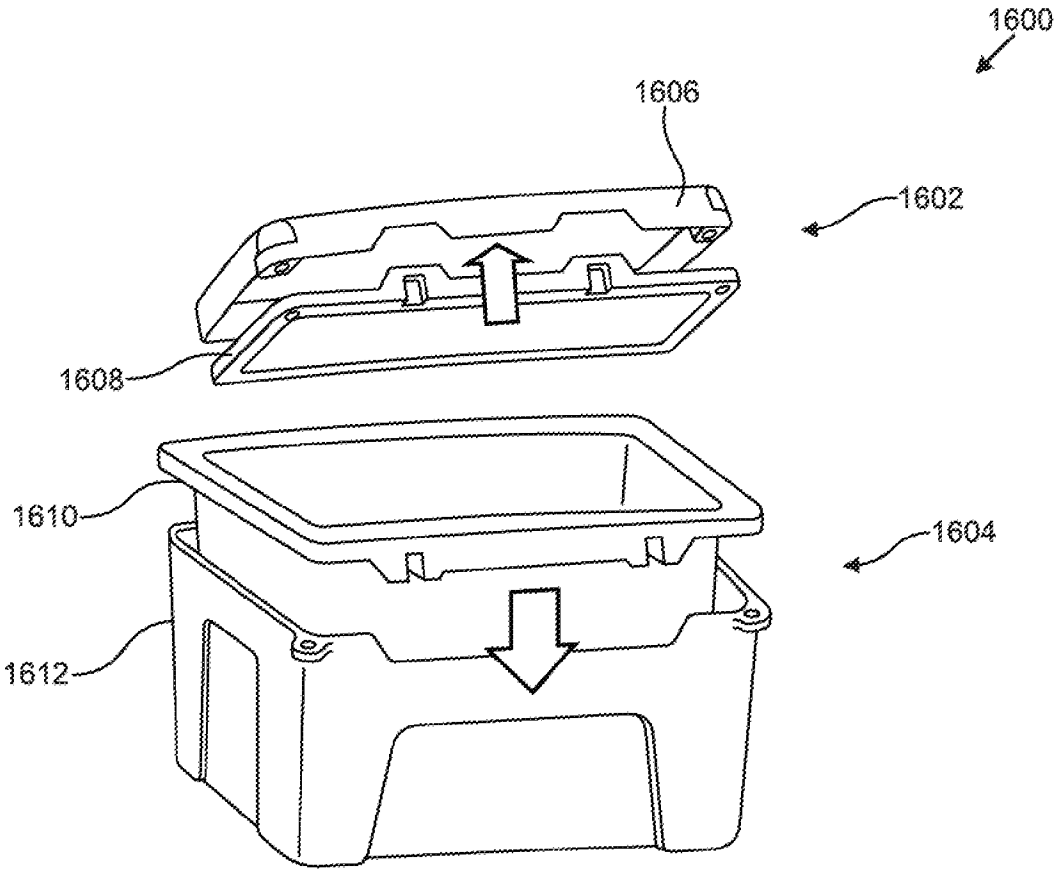
FIG. 16 schematically depicts an exploded view of an implementation of an insulating container, according to one or more aspects described herein.

It is contemplated that the vacuum insulated panels 625 may comprise any vacuum insulated panel type, including any commercially available vacuum insulated panel. Further, it is contemplated that the vacuum insulated panels 625 may be utilized with the disclosures described herein to reduce heat transfer to/from an insulating container, such as insulating container 100, insulating structure 404, insulating structure 650, insulating structure 900, insulating structure 1000, insulating structure 1100, and/or insulating portions 1200, 1300, 1400 and 1500, among others. In certain examples, specific models of vacuum insulated panels 625 were tested to determine their relative efficacy. FIG. 16 depicts a table of results of heat transfer tests conducted on insulating containers configured with five different types of vacuum insulated panels. The tested insulating containers are similar to insulating container 100, and the five different types of vacuum insulated panels include: i) 10 mm Panasonic Aluminum (type A), ii) 10 mm Panasonic vaporized metal (type C), iii) 6 mm Va-Q-Tec, iv) 12 mm Va-Q-Tec, and v) 18 mm Va-Q-Tec. The testing methodology included adjusting a temperature within an internal storage compartment of an insulating container to a temperature below 10° F. by introducing 19.5 lbs of ice cooled to −22° F. into the internal storage compartment. The test results presented in table 1600 of FIG. 16 measure the time taken for the internal temperature to rise from 10° F. to 50° F. when the insulating container is closed, and placed within an external environment having an ambient temperature of 100° F.

Benefits

Embodiments of this disclosure present many benefits over existing insulating containers.

Vacuum insulated panels may provide a similar thermal resistance to an insulating foam while having a reduced thickness as compared to the insulating foam. Thus, for example, as described above, strategic placement of vacuum insulated panels within an insulating container may improve the thermal resistance of the insulating container and/or allow more space to store items within the storage compartment.

For example, an insulating container containing vacuum insulated panels as described above, may provide increased thermal resistance as compared to a similarly sized insulating container molded from a polymer and filled with an insulating foam that does not have vacuum insulated panels. Additionally, for example, an insulating container containing vacuum insulated panels as described above, may provide increased storage room within the storage compartment as compared to an insulating container having similar thermal resistance molded from a polymer and filled with an insulating foam that does not have vacuum insulated panels.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. An insulating container having a base insulating structure and lid insulating structure that when closed, enclose an internal storage compartment, the insulating container comprising:

a base insulating structure comprising:

a base cavity enclosed by a base outer shell structure and a base inner wall structure, the base inner wall structure including a base collar extending around the perimeter of the base insulating structure; and a base insulating portion positioned within the base cavity;

a drain passing through the base cavity;

a lid insulating structure pivotally engaged with the base insulating structure, the lid insulating structure comprising:

a lid cavity enclosed by a lid outer shell structure and a lid inner wall structure, the lid inner wall structure including a lid collar extending around the perimeter of the lid insulating structure; and a lid insulating portion positioned within the cavity;

wherein the base insulating portion comprises at least one vacuum insulated panel; and wherein and the lid insulating portion comprises at least one vacuum insulated panel.

2. The insulating container of claim 1, wherein the base insulating portion comprises a first sidewall vacuum insulated panel, a second sidewall vacuum insulated panel, and a 3-piece vacuum insulated panel.

3. The insulating container of claim 2, wherein the 3-piece vacuum insulated panel comprises a foldable insulating panel having two foldable portions such that the foldable insulating portions are folded to extend around two corners of the base insulating structure.

4. The insulating container of claim 3, wherein the 3-piece vacuum insulated panel comprises one vacuum insulated panel.

5. The insulating container of claim 4, wherein the two foldable portions of the insulating container are compressed such that a thickness of the two foldable portions is less than a thickness of the remaining portions of the 3-piece vacuum insulated panel.

6. The insulating container of claim 5, wherein the lid insulating portion comprises one vacuum insulated panel.

7. The insulating container of claim 1, further comprising an end cap engaged with a bottom end of the base outer shell structure.

8. The insulating container of claim 7, wherein the base outer shell structure further comprises a top flange and a bottom flange, wherein the top flange is engaged within a channel in the base inner wall structure, and wherein the bottom flange is engaged within a channel in the end cap.

9. The insulating container of claim 8, wherein the lid outer shell structure further comprises a flange, and wherein the flange is engaged within a channel in the lid collar.

10. The insulating container of claim 9, further comprising at least one base engagement structure extending from the base collar, wherein the base engagement structure includes a base engagement structure channel that is substantially perpendicular to the channel in the base inner wall structure and wherein the top flange is engaged within the base engagement channel.

11. The insulating container of claim 10, wherein at least one of a latch, a handle, and a hinge is engaged with the base engagement structure using at least one mechanical fastener.

12. The insulating container of claim 11, further comprising at least one lid engagement structure extending from the lid collar, wherein the lid engagement structure includes a lid engagement structure channel that is substantially perpendicular to the channel in the lid inner wall structure and wherein the flange of the lid outer shell is engaged within the lid engagement channel.

13. The insulating container of claim 12, wherein at least one of a latch, a handle, and a hinge is engaged with the base engagement structure and the lid engagement structure using at least one mechanical fastener.

14. An insulating container having a base insulating structure and lid insulating structure that when closed, enclose an internal storage compartment, the insulating container comprising:

a base insulating structure comprising:

a base cavity enclosed by a base outer shell structure and a base inner wall structure composed of polyethylene; and a base insulating portion positioned within the base cavity;

a lid insulating structure pivotally engaged with the base insulating structure, the lid insulating structure comprising:

a lid cavity enclosed by a lid outer shell structure and a lid inner wall structure composed of polyethylene; and a lid insulating portion positioned within the cavity;

wherein the base insulating portion and the lid insulating portion each comprise at least one vacuum insulated panel.

15. The insulating container of claim 14, wherein the base insulating portion comprises a foldable vacuum insulated panel having at least one foldable portion such that the foldable portion is folded to extend around at least one corner of the base insulating structure; and wherein the foldable portion of the folded vacuum insulated panel is compressed such that a thickness of the foldable portion is less than a thickness of the remaining portions of the foldable vacuum insulated panel.

16. The insulating container of claim 15, further comprising at least one hinge connecting the base insulating structure and the lid insulating structure.

17. The insulating container of claim 15, further comprising at least one handle engaged with the base insulating structure.

18. The insulating container of claim 17, further comprising at least one latch.

19. An insulating container having a base insulating structure and lid insulating structure that when closed, enclose an internal storage compartment, the insulating container comprising:

a base insulating structure comprising:

a base cavity enclosed by a base outer shell structure and a base inner wall structure composed of polyethylene, the base inner wall structure including a base collar extending around the perimeter of the base insulating structure; and a base insulating portion positioned within the base cavity;

a lid insulating structure pivotally engaged with the base insulating structure, the lid insulating structure comprising:

a lid cavity enclosed by a lid outer shell structure and a lid inner wall structure composed of polyethylene, the lid inner wall structure including a lid collar extending around the perimeter of the lid insulating structure; and a lid insulating portion positioned within the cavity;

wherein the base insulating portion and the lid insulating portion each comprise at least one vacuum insulated panel; and wherein the lid outer shell further comprises a flange, and wherein the flange is engaged within a channel in the lid collar.

20. The insulating container of claim 19, wherein at least one of a latch, a handle, and a hinge is engaged with the base engagement structure using at least one mechanical fastener and wherein the at least one mechanical fastener passes through the base engagement structure and the base outer shell.

* * * * *